US008826973B2

(12) United States Patent
Moxley et al.

(10) Patent No.: US 8,826,973 B2
(45) Date of Patent: Sep. 9, 2014

(54) METHOD AND SYSTEM FOR ADVANCEMENT OF A BOREHOLE USING A HIGH POWER LASER

(75) Inventors: Joel F. Moxley, Denver, CO (US); Mark S. Land, Denver, CO (US); Charles C. Rinzler, Denver, CO (US); Brian O. Faircloth, Evergreen, CO (US); Mark S. Zediker, Weldon Spring, MO (US)

(73) Assignee: Foro Energy, Inc., Houston, TX (US)

( * ) Notice: Subject to any disclaimer, the term of this patent is extended or adjusted under 35 U.S.C. 154(b) by 706 days.

(21) Appl. No.: 12/543,986

(22) Filed: Aug. 19, 2009

(65) Prior Publication Data

US 2010/0044103 A1 Feb. 25, 2010

Related U.S. Application Data

(60) Provisional application No. 61/090,384, filed on Aug. 20, 2008, provisional application No. 61/102,730, filed on Oct. 3, 2008, provisional application No. 61/106,472, filed on Oct. 17, 2008, provisional application No. 61/153,271, filed on Feb. 17, 2009.

(51) Int. Cl.

| | |
|---|---|
| ***E21B 19/22*** | (2006.01) |
| ***E21B 17/20*** | (2006.01) |
| ***H02G 1/08*** | (2006.01) |
| ***B65H 59/00*** | (2006.01) |
| ***E21B 10/60*** | (2006.01) |
| ***E21B 21/10*** | (2006.01) |
| ***E21B 7/14*** | (2006.01) |
| ***E21B 43/11*** | (2006.01) |
| ***E21B 29/00*** | (2006.01) |
| ***E21B 7/15*** | (2006.01) |

(52) U.S. Cl.

CPC ..... *E21B 29/00* (2013.01); *E21B 10/60* (2013.01); *E21B 21/103* (2013.01); *E21B 7/14* (2013.01); *E21B 43/11* (2013.01); *E21B 7/15* (2013.01)

USPC ..... 166/77.2; 166/242.2; 166/384; 166/385; 254/134.3 FT; 254/134.3 R; 254/134.4

(58) Field of Classification Search

USPC ..... 254/134.3 FT, 134.3 R, 134.4; 166/77.1, 166/242.2, 380, 385, 384, 77.2, 65.1

See application file for complete search history.

(56) References Cited

U.S. PATENT DOCUMENTS

| | | | |
|---|---|---|---|
| 914,636 | A | 3/1909 | Case |
| 2,548,463 | A | 4/1951 | Blood |

(Continued)

FOREIGN PATENT DOCUMENTS

| | | | |
|---|---|---|---|
| EP | 0295 045 | A2 | 12/1988 |
| EP | 0515983 | A1 | 12/1992 |

(Continued)

OTHER PUBLICATIONS

U.S. Appl. No. 12/543,968, filed Aug. 19, 2009, Rinzler et al.

(Continued)

*Primary Examiner* — Jennifer H Gay

(74) *Attorney, Agent, or Firm* — Glen P. Belvis; Steptoe & Johnson LLP

(57) ABSTRACT

There is provided a system, apparatus and methods for the laser drilling of a borehole in the earth. There is further provided with in the systems a means for delivering high power laser energy down a deep borehole, while maintaining the high power to advance such boreholes deep into the earth and at highly efficient advancement rates, a laser bottom hole assembly, and fluid directing techniques and assemblies for removing the displaced material from the borehole.

54 Claims, 35 Drawing Sheets

(56) References Cited

U.S. PATENT DOCUMENTS 2,742,555 A 4/1956 Murray
3,122,212 A 2/1964 Karlovitz
3,383,491 A 5/1968 Muncheryan
3,461,964 A 8/1969 Venghiattis
3,493,060 A 2/1970 Van Dyk
3,503,804 A 3/1970 Schneider et al.
3,539,221 A 11/1970 Gladstone
3,544,165 A 12/1970 Snedden
3,556,600 A 1/1971 Shoupp et al.
3,574,357 A 4/1971 Tirgoviste et al.
3,586,413 A 6/1971 Adams
3,652,447 A 3/1972 Yant
3,693,718 A 9/1972 Stout
3,699,649 A 10/1972 McWilliams
3,802,203 A 4/1974 Ichise et al.
3,820,605 A 6/1974 Barber et al.
3,821,510 A 6/1974 Muncheryan
3,823,788 A 7/1974 Garrison et al.
3,871,485 A 3/1975 Keenan, Jr.
3,882,945 A 5/1975 Keenan, Jr.
3,938,599 A 2/1976 Horn
3,960,448 A 6/1976 Schmidt et al.
3,977,478 A 8/1976 Shuck
3,992,095 A 11/1976 Jacoby et al.
3,998,281 A 12/1976 Salisbury et al.
4,019,331 A 4/1977 Rom et al.
4,025,091 A 5/1977 Zeile, Jr.
4,026,356 A 5/1977 Shuck
4,047,580 A 9/1977 Yahiro et al.
4,057,118 A 11/1977 Ford
4,061,190 A 12/1977 Bloomfield
4,066,138 A 1/1978 Salisbury et al.
4,090,572 A 5/1978 Welch
4,113,036 A 9/1978 Stout
4,125,757 A 11/1978 Ross
4,151,393 A 4/1979 Fenneman et al.
4,162,400 A 7/1979 Pitts, Jr.
4,189,705 A 2/1980 Pitts, Jr.
4,194,536 A 3/1980 Stine et al.
4,199,034 A 4/1980 Salisbury et al.
4,227,582 A 10/1980 Price
4,228,856 A 10/1980 Reale
4,243,298 A 1/1981 Kao et al.
4,249,925 A 2/1981 Kawashima et al.
4,252,015 A 2/1981 Harbon et al.
4,256,146 A 3/1981 Genini et al.
4,266,609 A 5/1981 Rom et al.
4,280,535 A 7/1981 Willis
4,281,891 A 8/1981 Shinohara et al.
4,282,940 A 8/1981 Salisbury et al.
4,332,401 A 6/1982 Stephenson et al.
4,336,415 A 6/1982 Walling
4,340,245 A 7/1982 Stalder
4,367,917 A 1/1983 Gray
4,370,886 A 2/1983 Smith, Jr. et al.
4,374,530 A 2/1983 Walling
4,375,164 A 3/1983 Dodge et al.
4,389,645 A 6/1983 Wharton
4,415,184 A 11/1983 Stephenson et al.
4,417,603 A 11/1983 Argy
4,436,177 A 3/1984 Elliston
4,444,420 A 4/1984 McStravick et al.
4,453,570 A 6/1984 Hutchison
4,459,731 A 7/1984 Hutchison
4,477,106 A 10/1984 Hutchison
4,504,112 A 3/1985 Gould et al.
4,522,464 A 6/1985 Thompson et al.
4,531,552 A 7/1985 Kim
4,565,351 A 1/1986 Conti et al.
4,662,437 A 5/1987 Renfro
4,694,865 A 9/1987 Tauschmann
4,725,116 A 2/1988 Spencer et al.
4,741,405 A 5/1988 Moeny et al.
4,744,420 A 5/1988 Patterson et al.
4,770,493 A 9/1988 Ara et al.
4,793,383 A 12/1988 Gyory et al.
4,830,113 A 5/1989 Geyer
4,860,654 A 8/1989 Chawla et al.
4,860,655 A 8/1989 Chawla
4,872,520 A 10/1989 Nelson
4,924,870 A 5/1990 Wlodarczyk et al.
4,952,771 A 8/1990 Wrobel
4,989,236 A 1/1991 Myllymäki
4,997,250 A 3/1991 Ortiz, Jr.
5,003,144 A 3/1991 Lindroth et al.
5,004,166 A 4/1991 Sellar
5,033,545 A 7/1991 Sudol
5,049,738 A 9/1991 Gergely et al.
5,084,617 A 1/1992 Gergely
5,086,842 A 2/1992 Cholet
5,107,936 A 4/1992 Foppe
5,121,872 A 6/1992 Legget
5,125,061 A 6/1992 Marlier et al.
5,125,063 A 6/1992 Panuska et al.
5,128,882 A 7/1992 Cooper et al.
5,140,664 A 8/1992 Bosisio et al.
5,163,321 A 11/1992 Perales
5,168,940 A 12/1992 Foppe
5,172,112 A 12/1992 Jennings
5,212,755 A 5/1993 Holmberg
5,269,377 A 12/1993 Martin
5,285,204 A 2/1994 Sas-Jaworsky
5,348,097 A 9/1994 Giannesini et al.
5,351,533 A 10/1994 Macadam et al.
5,353,875 A 10/1994 Schultz et al.
5,355,967 A 10/1994 Mueller et al.
5,356,081 A 10/1994 Sellar
5,396,805 A 3/1995 Surjaatmadja
5,411,081 A 5/1995 Moore et al.
5,411,085 A 5/1995 Moore et al.
5,411,105 A 5/1995 Gray
5,413,045 A 5/1995 Miszewski
5,413,170 A 5/1995 Moore
5,419,188 A 5/1995 Rademaker et al.
5,423,383 A 6/1995 Pringle
5,425,420 A 6/1995 Pringle
5,435,351 A 7/1995 Head
5,435,395 A 7/1995 Connell
5,463,711 A 10/1995 Chu
5,465,793 A 11/1995 Pringle
5,469,878 A 11/1995 Pringle
5,479,860 A 1/1996 Ellis
5,483,988 A 1/1996 Pringle
5,488,992 A 2/1996 Pringle
5,500,768 A 3/1996 Doggett et al.
5,503,014 A 4/1996 Griffith
5,503,370 A 4/1996 Newman et al.
5,505,259 A 4/1996 Wittrisch et al.
5,515,926 A 5/1996 Boychuk
5,526,887 A 6/1996 Vestavik
5,561,516 A 10/1996 Noble et al.
5,566,764 A 10/1996 Elliston
5,573,225 A 11/1996 Boyle et al.
5,577,560 A 11/1996 Coronado et al.
5,586,609 A 12/1996 Schuh
5,599,004 A 2/1997 Newman et al.
5,615,052 A 3/1997 Doggett
5,638,904 A 6/1997 Misselbrook et al.
5,655,745 A 8/1997 Morrill
5,694,408 A 12/1997 Bott et al.
5,699,974 A * 12/1997 Jenkins et al. ..... 242/361.4
5,699,996 A * 12/1997 Boyle et al. ..... 254/134.4
5,707,939 A 1/1998 Patel
5,757,484 A 5/1998 Miles et al.
5,759,859 A 6/1998 Sausa
5,771,984 A 6/1998 Potter et al.
5,773,791 A 6/1998 Kuykendal
5,794,703 A 8/1998 Newman et al.
5,813,465 A 9/1998 Terrell et al.
5,828,003 A 10/1998 Thomeer et al.
5,832,006 A 11/1998 Rice et al.
5,833,003 A 11/1998 Longbottom et al.
5,847,825 A 12/1998 Alexander
5,862,273 A 1/1999 Pelletier

(56) References Cited

U.S. PATENT DOCUMENTS 5,862,862 A 1/1999 Terrell
5,896,482 A 4/1999 Blee et al.
5,896,938 A 4/1999 Moeny et al.
5,902,499 A 5/1999 Richerzhagen
5,909,306 A 6/1999 Goldberg et al.
5,913,337 A 6/1999 Williams et al.
5,924,489 A 7/1999 Hatcher
5,929,986 A 7/1999 Slater et al.
5,933,945 A 8/1999 Thomeer et al.
5,938,954 A 8/1999 Onuma et al.
5,946,788 A * 9/1999 Griffioen et al. ..... 29/433
5,950,298 A * 9/1999 Griffioen et al. ..... 29/433
5,973,783 A 10/1999 Goldner et al.
5,986,756 A 11/1999 Slater et al.
RE36,525 E 1/2000 Pringle
6,015,015 A 1/2000 Luft et al.
6,038,363 A 3/2000 Slater et al.
6,059,037 A 5/2000 Longbottom et al.
6,060,662 A 5/2000 Rafie et al.
6,065,540 A 5/2000 Thomeer et al.
RE36,723 E 6/2000 Moore et al.
6,076,602 A 6/2000 Gano et al.
6,092,601 A 7/2000 Gano et al.
6,104,022 A 8/2000 Young et al.
RE36,880 E 9/2000 Pringle
6,116,344 A 9/2000 Longbottom et al.
6,135,206 A 10/2000 Gano et al.
6,147,754 A 11/2000 Theriault et al.
6,157,893 A 12/2000 Berger et al.
6,166,546 A 12/2000 Scheihing et al.
6,215,734 B1 4/2001 Moeny et al.
6,227,300 B1 5/2001 Cunningham et al.
6,250,391 B1 6/2001 Proudfoot
6,273,193 B1 8/2001 Hermann et al.
6,275,645 B1 8/2001 Vereecken et al.
6,281,489 B1 8/2001 Tubel et al.
6,301,423 B1 10/2001 Olson
6,309,195 B1 10/2001 Bottos et al.
6,321,839 B1 11/2001 Vereecken et al.
6,352,114 B1 3/2002 Toalson et al.
6,355,928 B1 3/2002 Skinner et al.
6,356,683 B1 3/2002 Hu et al.
6,377,591 B1 4/2002 Hollister et al.
6,384,738 B1 5/2002 Carstensen et al.
6,386,300 B1 5/2002 Curlett et al.
6,401,825 B1 6/2002 Woodrow
6,409,155 B1 * 6/2002 Brown et al. ..... 254/134.4
6,426,479 B1 7/2002 Bischof
6,437,326 B1 8/2002 Yamate et al.
6,450,257 B1 9/2002 Douglas
6,494,259 B2 12/2002 Surjaatmadja
6,497,290 B1 12/2002 Misselbrook et al.
6,557,249 B1 5/2003 Pruett et al.
6,561,289 B2 5/2003 Portman et al.
6,564,046 B1 5/2003 Chateau
6,591,046 B2 7/2003 Stottlemyer
6,615,922 B2 9/2003 Deul et al.
6,626,249 B2 9/2003 Rosa
6,644,848 B1 11/2003 Clayton et al.
6,661,815 B1 12/2003 Kozlovsky et al.
6,710,720 B2 3/2004 Carstensen et al.
6,712,150 B1 3/2004 Misselbrook et al.
6,725,924 B2 4/2004 Davidson et al.
6,747,743 B2 6/2004 Skinner et al.
6,755,262 B2 6/2004 Parker
6,808,023 B2 10/2004 Smith et al.
6,832,654 B2 12/2004 Ravensbergen et al.
6,847,034 B2 1/2005 Shah et al.
6,851,488 B2 2/2005 Batarseh
6,867,858 B2 3/2005 Owen et al.
6,870,128 B2 3/2005 Kobayashi et al.
6,874,361 B1 4/2005 Meltz et al.
6,880,646 B2 4/2005 Batarseh
6,885,784 B2 4/2005 Bohnert
6,888,097 B2 5/2005 Batarseh
6,888,127 B2 5/2005 Jones et al.
6,912,898 B2 7/2005 Jones et al.
6,913,079 B2 7/2005 Tubel
6,920,395 B2 7/2005 Brown
6,920,946 B2 7/2005 Oglesby
6,923,273 B2 8/2005 Terry et al.
6,957,576 B2 10/2005 Skinner et al.
6,967,322 B2 11/2005 Jones et al.
6,977,367 B2 12/2005 Tubel et al.
6,978,832 B2 12/2005 Gardner et al.
6,981,561 B2 1/2006 Krueger et al.
6,994,162 B2 2/2006 Robison
7,013,993 B2 3/2006 Masui
7,040,746 B2 5/2006 McCain et al.
7,055,604 B2 6/2006 Jee et al.
7,055,629 B2 6/2006 Oglesby
7,072,044 B2 7/2006 Kringlebotn et al.
7,072,588 B2 7/2006 Skinner
7,086,484 B2 8/2006 Smith, Jr.
7,087,865 B2 8/2006 Lerner
7,088,437 B2 8/2006 Blomster et al.
7,126,332 B2 10/2006 Blanz et al.
7,134,488 B2 11/2006 Tudor et al.
7,134,514 B2 11/2006 Riel et al.
7,140,435 B2 11/2006 Defretin et al.
7,147,064 B2 12/2006 Batarseh et al.
7,152,685 B2 * 12/2006 Adnan et al. ..... 166/380
7,152,700 B2 12/2006 Church et al.
7,163,875 B2 1/2007 Richerzhagen
7,172,026 B2 2/2007 Misselbrook
7,172,038 B2 2/2007 Terry et al.
7,174,067 B2 2/2007 Murshid et al.
7,188,687 B2 3/2007 Rudd et al.
7,195,731 B2 3/2007 Jones
7,196,786 B2 3/2007 DiFoggio
7,199,869 B2 4/2007 MacDougall
7,201,222 B2 4/2007 Kanady et al.
7,210,343 B2 5/2007 Shammai et al.
7,212,283 B2 5/2007 Hother et al.
7,249,633 B2 7/2007 Ravensbergen et al.
7,264,057 B2 9/2007 Rytlewski et al.
7,270,195 B2 9/2007 MacGregor et al.
7,273,108 B2 9/2007 Misselbrook
7,334,637 B2 2/2008 Smith, Jr.
7,337,660 B2 3/2008 Ibrahim et al.
7,362,422 B2 4/2008 DiFoggio et al.
7,372,230 B2 5/2008 McKay
7,394,064 B2 7/2008 Marsh
7,395,696 B2 7/2008 Bissonnette et al.
7,416,032 B2 8/2008 Moeny et al.
7,416,258 B2 8/2008 Reed et al.
7,424,190 B2 9/2008 Dowd et al.
7,471,831 B2 12/2008 Bearman et al.
7,487,834 B2 2/2009 Reed et al.
7,490,664 B2 2/2009 Skinner et al.
7,503,404 B2 3/2009 McDaniel et al.
7,515,782 B2 4/2009 Zhang et al.
7,516,802 B2 4/2009 Smith, Jr.
7,518,722 B2 4/2009 Julian et al.
7,527,108 B2 5/2009 Moeny
7,530,406 B2 5/2009 Moeny et al.
7,559,378 B2 7/2009 Moeny
7,587,111 B2 9/2009 de Montmorillon et al.
7,600,564 B2 10/2009 Shampine et al.
7,603,011 B2 10/2009 Varkey et al.
7,617,873 B2 11/2009 Lovell et al.
7,624,743 B2 12/2009 Sarkar et al.
7,628,227 B2 12/2009 Marsh
7,646,953 B2 1/2010 Dowd et al.
7,647,948 B2 1/2010 Quigley et al.
7,671,983 B2 3/2010 Shammai et al.
7,715,664 B1 5/2010 Shou et al.
7,720,323 B2 5/2010 Yamate et al.
7,769,260 B2 8/2010 Hansen et al.
7,802,384 B2 9/2010 Kobayashi et al.
7,834,777 B2 11/2010 Gold
7,845,419 B2 * 12/2010 Naumann ..... 166/380
7,848,368 B2 12/2010 Gapontsev et al.
7,900,699 B2 3/2011 Ramos et al.

(56) References Cited

U.S. PATENT DOCUMENTS 7,938,175 B2 5/2011 Skinner et al.
8,011,454 B2 9/2011 Castillo
8,074,332 B2 12/2011 Keatch et al.
8,082,996 B2 12/2011 Kocis et al.
8,091,638 B2 1/2012 Dusterhoft et al.
8,109,345 B2 2/2012 Jeffryes
8,118,282 B2 * 2/2012 Griffioen et al. ..... 254/134.4
8,175,433 B2 5/2012 Caldwell et al.
2002/0007945 A1 1/2002 Neuroth et al.
2002/0039465 A1 4/2002 Skinner
2002/0189806 A1 12/2002 Davidson et al.
2003/0000741 A1 1/2003 Rosa
2003/0053783 A1 3/2003 Shirasaki
2003/0056990 A1 3/2003 Oglesby
2003/0085040 A1 5/2003 Hemphill et al.
2003/0094281 A1 5/2003 Tubel
2003/0132029 A1 7/2003 Parker
2003/0145991 A1 8/2003 Olsen
2003/0159283 A1 8/2003 White
2003/0160164 A1 8/2003 Jones et al.
2003/0226826 A1 12/2003 Kobayashi et al.
2004/0006429 A1 1/2004 Brown
2004/0016295 A1 1/2004 Skinner et al.
2004/0020643 A1 2/2004 Thomeer et al.
2004/0026127 A1 2/2004 Masui
2004/0026382 A1 2/2004 Richerzhagen
2004/0033017 A1 2/2004 Kringlebotn et al.
2004/0074979 A1 4/2004 McGuire
2004/0093950 A1 5/2004 Bohnert
2004/0112642 A1 6/2004 Krueger et al.
2004/0119471 A1 6/2004 Blanz et al.
2004/0129418 A1 7/2004 Jee et al.
2004/0195003 A1 10/2004 Batarseh
2004/0206505 A1 10/2004 Batarseh
2004/0207731 A1 10/2004 Bearman et al.
2004/0211894 A1 10/2004 Hother et al.
2004/0218176 A1 11/2004 Shammal et al.
2004/0244970 A1 12/2004 Smith, Jr.
2004/0252748 A1 12/2004 Gleitman
2004/0256103 A1 12/2004 Batarseh
2005/0007583 A1 1/2005 DiFoggio
2005/0012244 A1 1/2005 Jones
2005/0034857 A1 2/2005 Defretin et al.
2005/0094129 A1 5/2005 MacDougall
2005/0099618 A1 5/2005 DiFoggio et al.
2005/0115741 A1 6/2005 Terry et al.
2005/0121235 A1 6/2005 Larsen et al.
2005/0189146 A1 9/2005 Oglesby
2005/0201652 A1 9/2005 Ellwood, Jr.
2005/0230107 A1 10/2005 McDaniel et al.
2005/0252286 A1 11/2005 Ibrahim et al.
2005/0263281 A1 12/2005 Lovell et al.
2005/0268704 A1 12/2005 Bissonnette et al.
2005/0269132 A1 12/2005 Batarseh et al.
2005/0272512 A1 12/2005 Bissonnette et al.
2005/0272513 A1 12/2005 Bissonnette et al.
2005/0272514 A1 12/2005 Bissonnette et al.
2005/0279511 A1 * 12/2005 Adnan et al. ..... 166/380
2005/0282645 A1 12/2005 Bissonnette et al.
2006/0038997 A1 2/2006 Julian et al.
2006/0049345 A1 3/2006 Rao et al.
2006/0065815 A1 3/2006 Jurca
2006/0070770 A1 4/2006 Marsh
2006/0102343 A1 5/2006 Skinner et al.
2006/0118303 A1 6/2006 Schultz et al.
2006/0137875 A1 6/2006 Dusterhoft et al.
2006/0185843 A1 8/2006 Smith, Jr.
2006/0191684 A1 8/2006 Smith, Jr.
2006/0204188 A1 9/2006 Clarkson et al.
2006/0207799 A1 9/2006 Yu
2006/0231257 A1 10/2006 Reed et al.
2006/0237233 A1 10/2006 Reed et al.
2006/0260832 A1 11/2006 McKay
2006/0266522 A1 11/2006 Eoff et al.
2006/0283592 A1 12/2006 Sierra et al.
2006/0289724 A1 12/2006 Skinner et al.
2007/0034409 A1 2/2007 Dale et al.
2007/0081157 A1 4/2007 Csutak et al.
2007/0125163 A1 6/2007 Dria et al.
2007/0193990 A1 8/2007 Richerzhagen et al.
2007/0217736 A1 9/2007 Zhang et al.
2007/0227741 A1 10/2007 Lovell et al.
2007/0242265 A1 10/2007 Vessereau et al.
2007/0247701 A1 10/2007 Akasaka et al.
2007/0267220 A1 11/2007 Magiawala et al.
2007/0278195 A1 12/2007 Richerzhagen et al.
2007/0280615 A1 12/2007 de Montmorillon et al.
2008/0023202 A1 1/2008 Keatch et al.
2008/0053702 A1 3/2008 Smith, Jr.
2008/0073077 A1 3/2008 Tunc et al.
2008/0093125 A1 4/2008 Potter et al.
2008/0112760 A1 5/2008 Curlett
2008/0128123 A1 6/2008 Gold
2008/0135818 A1 * 6/2008 Griffioen et al. ..... 254/134.4
2008/0138022 A1 6/2008 Tassone
2008/0165356 A1 7/2008 DiFoggio et al.
2008/0166132 A1 7/2008 Lynde et al.
2008/0180787 A1 7/2008 DiGiovanni et al.
2008/0245568 A1 10/2008 Jeffryes
2008/0273852 A1 11/2008 Parker et al.
2009/0020333 A1 1/2009 Marsh
2009/0031870 A1 2/2009 O'Connor
2009/0033176 A1 2/2009 Huang et al.
2009/0049345 A1 2/2009 Mock et al.
2009/0050371 A1 2/2009 Moeny
2009/0078467 A1 3/2009 Castillo
2009/0105955 A1 4/2009 Castillo et al.
2009/0126235 A1 5/2009 Kobayashi et al.
2009/0133871 A1 5/2009 Skinner et al.
2009/0133929 A1 5/2009 Rodland
2009/0139768 A1 6/2009 Castillo
2009/0166042 A1 7/2009 Skinner
2009/0190887 A1 7/2009 Freeland et al.
2009/0194292 A1 8/2009 Oglesby
2009/0205675 A1 8/2009 Sarkar et al.
2009/0260834 A1 10/2009 Henson et al.
2009/0266562 A1 10/2009 Greenaway
2009/0272424 A1 11/2009 Ortabasi
2009/0272547 A1 11/2009 Dale et al.
2009/0279835 A1 11/2009 Montmorillon et al.
2009/0294050 A1 12/2009 Traggis et al.
2009/0308852 A1 12/2009 Alpay et al.
2009/0324183 A1 12/2009 Bringuier et al.
2010/0000790 A1 1/2010 Moeny
2010/0001179 A1 1/2010 Kobayashi et al.
2010/0008631 A1 1/2010 Herbst
2010/0013663 A1 1/2010 Cavender et al.
2010/0018703 A1 1/2010 Lovell et al.
2010/0025032 A1 2/2010 Smith et al.
2010/0032207 A1 2/2010 Potter et al.
2010/0044102 A1 2/2010 Rinzler et al.
2010/0044103 A1 2/2010 Moxley et al.
2010/0044104 A1 2/2010 Zediker et al.
2010/0044105 A1 2/2010 Faircloth et al.
2010/0044106 A1 2/2010 Zediker et al.
2010/0071794 A1 3/2010 Homan
2010/0078414 A1 4/2010 Perry et al.
2010/0084132 A1 4/2010 Noya et al.
2010/0089571 A1 4/2010 Revellat et al.
2010/0089574 A1 4/2010 Wideman et al.
2010/0089576 A1 4/2010 Wideman et al.
2010/0089577 A1 4/2010 Wideman et al.
2010/0096124 A1 * 4/2010 Naumann ..... 166/250.01
2010/0111474 A1 5/2010 Satake
2010/0155059 A1 6/2010 Ullah
2010/0170672 A1 7/2010 Schwoebel et al.
2010/0170680 A1 7/2010 McGregor et al.
2010/0187010 A1 7/2010 Abbasi et al.
2010/0197116 A1 8/2010 Shah et al.
2010/0215326 A1 8/2010 Zediker et al.
2010/0218993 A1 9/2010 Wideman et al.
2010/0224408 A1 9/2010 Kocis et al.
2010/0226135 A1 9/2010 Chen
2010/0236785 A1 9/2010 Collis et al.

(56) References Cited

U.S. PATENT DOCUMENTS

| | | | | |
|---|---|---|---|---|
| 2010/0326659 | A1 | 12/2010 | Schultz et al. | |
| 2010/0326665 | A1 | 12/2010 | Redlinger et al. | |
| 2011/0030957 | A1 | 2/2011 | Constantz et al. | |
| 2011/0035154 | A1 | 2/2011 | Kendall et al. | |
| 2011/0048743 | A1 | 3/2011 | Stafford et al. | |
| 2011/0061869 | A1 | 3/2011 | Abass et al. | |
| 2011/0079437 | A1 | 4/2011 | Hopkins et al. | |
| 2011/0127028 | A1 | 6/2011 | Strickland | |
| 2011/0139450 | A1 | 6/2011 | Vasques et al. | |
| 2011/0147013 | A1 | 6/2011 | Kilgore | |
| 2011/0162854 | A1 | 7/2011 | Bailey et al. | |
| 2011/0168443 | A1 | 7/2011 | Smolka | |
| 2011/0174537 | A1 | 7/2011 | Potter et al. | |
| 2011/0186298 | A1 | 8/2011 | Clark et al. | |
| 2011/0198075 | A1 | 8/2011 | Okada et al. | |
| 2011/0205652 | A1 | 8/2011 | Abbasi et al. | |
| 2011/0220409 | A1 | 9/2011 | Foppe | |
| 2011/0240314 | A1 | 10/2011 | Greenaway | |
| 2011/0266062 | A1 | 11/2011 | Shuman, V et al. | |
| 2011/0278070 | A1 | 11/2011 | Hopkins et al. | |
| 2011/0290563 | A1 | 12/2011 | Kocis et al. | |
| 2011/0303460 | A1 | 12/2011 | Von Rohr et al. | |
| 2012/0000646 | A1 | 1/2012 | Liotta et al. | |
| 2012/0012392 | A1 | 1/2012 | Kumar | |
| 2012/0012393 | A1 | 1/2012 | Kumar | |
| 2012/0020631 | A1 | 1/2012 | Rinzler et al. | |
| 2012/0048550 | A1 | 3/2012 | Dusterhoft et al. | |
| 2012/0048568 | A1 | 3/2012 | Li et al. | |
| 2012/0061091 | A1 | 3/2012 | Radi | |
| 2012/0067643 | A1 | 3/2012 | DeWitt et al. | |
| 2012/0068086 | A1 | 3/2012 | DeWitt et al. | |
| 2012/0068523 | A1 | 3/2012 | Bowles | |
| 2012/0074110 | A1 | 3/2012 | Zediker et al. | |
| 2012/0103693 | A1 | 5/2012 | Jeffryes | |
| 2012/0111578 | A1 | 5/2012 | Tverlid | |
| 2012/0118568 | A1 | 5/2012 | Kleefisch et al. | |
| 2012/0118578 | A1 | 5/2012 | Skinner | |
| 2012/0217015 | A1 | 8/2012 | Zediker et al. | |
| 2012/0217017 | A1 | 8/2012 | Zediker et al. | |
| 2012/0217018 | A1 | 8/2012 | Zediker et al. | |
| 2012/0217019 | A1 | 8/2012 | Zediker et al. | |
| 2012/0248078 | A1 | 10/2012 | Zediker et al. | |
| 2012/0255774 | A1 | 10/2012 | Grubb et al. | |
| 2012/0255933 | A1 | 10/2012 | McKay et al. | |
| 2012/0255993 | A1* | 10/2012 | Bandholz et al. | 235/375 |
| 2012/0261188 | A1 | 10/2012 | Zediker et al. | |
| 2012/0266803 | A1 | 10/2012 | Zediker et al. | |
| 2012/0267168 | A1 | 10/2012 | Grubb et al. | |
| 2012/0273269 | A1 | 11/2012 | Rinzler et al. | |
| 2012/0273470 | A1 | 11/2012 | Zediker et al. | |
| 2012/0275159 | A1 | 11/2012 | Fraze et al. | |
| 2013/0011102 | A1 | 1/2013 | Rinzler et al. | |

FOREIGN PATENT DOCUMENTS

| | | | |
|---|---|---|---|
| EP | 0 565 287 | A1 | 10/1993 |
| EP | 0 950 170 | B1 | 9/2002 |
| FR | 2 716 924 | | 9/1995 |
| GB | 1 284 454 | | 8/1972 |
| GB | 2420358 | B | 5/2006 |
| JP | 1987-011804 | | 1/1987 |
| JP | 1993-118185 | | 5/1993 |
| JP | 1993-33574 | | 9/1993 |
| JP | 09072738 | A | 3/1997 |
| JP | 09-242453 | A | 9/1997 |
| JP | 2000-334590 | A | 12/2000 |
| JP | 2001-208924 | | 8/2001 |
| JP | 2003-239673 | | 8/2003 |
| JP | 2004-108132 | | 4/2004 |
| JP | 2004-108132 | A | 4/2004 |
| JP | 2006-039147 | | 2/2006 |
| JP | 2006-509253 | | 3/2006 |
| JP | 2006-307481 | A | 11/2006 |
| JP | 2007-120048 | A | 5/2007 |
| JP | 2008-242012 | | 10/2008 |
| WO | WO 95/32834 | A1 | 12/1995 |
| WO | WO 97/49893 | A1 | 12/1997 |
| WO | WO 98/50673 | A1 | 11/1998 |
| WO | WO 98/56534 | A1 | 12/1998 |
| WO | WO 02/057805 | A2 | 7/2002 |
| WO | WO 03/027433 | A1 | 4/2003 |
| WO | WO 03/060286 | A1 | 7/2003 |
| WO | WO 2004/009958 | A1 | 1/2004 |
| WO | WO2004/052078 | | 6/2004 |
| WO | WO 2004/094786 | A1 | 11/2004 |
| WO | WO 2005/001232 | A2 | 1/2005 |
| WO | WO 2005/001239 | A1 | 1/2005 |
| WO | WO 2006/008155 | A1 | 1/2006 |
| WO | WO 2006/041565 | A1 | 4/2006 |
| WO | WO 2006/054079 | A1 | 5/2006 |
| WO | WO 2007/002064 | A1 | 1/2007 |
| WO | WO 2007/112387 | A2 | 10/2007 |
| WO | WO 2007/136485 | A2 | 11/2007 |
| WO | WO 2008/016852 | A1 | 2/2008 |
| WO | WO 2008/070509 | A2 | 6/2008 |
| WO | WO 2008/085675 | A1 | 7/2008 |
| WO | WO 2009/042774 | A2 | 4/2009 |
| WO | WO 2009/042781 | A2 | 4/2009 |
| WO | WO 2009/042785 | A2 | 4/2009 |
| WO | WO 2009/131584 | A1 | 10/2009 |
| WO | WO 2010/036318 | A1 | 4/2010 |
| WO | WO 2010/060177 | A1 | 6/2010 |
| WO | WO 2010/087944 | A1 | 8/2010 |
| WO | WO 2011/008544 | A2 | 1/2011 |
| WO | WO 2011/032083 | A1 | 3/2011 |
| WO | WO 2011/041390 | A2 | 4/2011 |
| WO | WO 2011/075247 | A2 | 6/2011 |
| WO | WO 2011/106078 | A2 | 9/2011 |
| WO | WO 2012/003146 | A2 | 1/2012 |
| WO | WO 2012/012006 | A1 | 1/2012 |
| WO | WO 2012/027699 | A1 | 3/2012 |
| WO | WO 2012/064356 | A1 | 5/2012 |
| WO | WO 2012/116189 | A2 | 8/2012 |

OTHER PUBLICATIONS

U.S. Appl. No. 12/544,038, filed Aug. 19, 2009, Zediker et al.
U.S. Appl. No. 12/544,094, filed Aug. 19, 2009, Faircloth et al.
U.S. Appl. No. 12/544,136, filed Aug. 19, 2009, Zediker et al.
U.S. Appl. No. 12/706,576, filed Feb. 16, 2010, Zediker et al.
U.S. Appl. No. 12/840,978, filed Jul. 21, 2010, Rinzler et al.
U.S. Appl. No. 12/896,021, filed Oct. 1, 2010, Underwood et al.
U.S. Appl. No. 13/034,017, filed Feb. 24, 2011, Zediker et al.
U.S. Appl. No. 13/034,037, filed Feb. 24, 2011, Zediker et al.
U.S. Appl. No. 13/034,175, filed Feb. 24, 2011, Zediker et al.
U.S. Appl. No. 13/034,183, filed Feb. 24, 2011, Zediker et al.
U.S. Appl. No. 13/210,581, filed Aug. 16, 2011, DeWitt et al.
U.S. Appl. No. 13/211,729, filed Aug. 17, 2011, DeWitt et al.
U.S. Appl. No. 13/222,931, filed Aug. 31, 2011, Zediker et al.
U.S. Appl. No. 13/347,445, filed Jan. 10, 2012, Zediker et al.
U.S. Appl. No. 13/366,882, filed Feb. 6, 2012, McKay et al.
U.S. Appl. No. 13/403,132, filed Feb. 23, 2012, Zediker et al.
U.S. Appl. No. 13/403,287, filed Feb. 23, 2012, Grubb et al.
U.S. Appl. No. 13/403,509, filed Feb. 23, 2012, Fraze et al.
U.S. Appl. No. 13/403,615, filed Feb. 23, 2012, Grubb et al.
U.S. Appl. No. 13/403,692, filed Feb. 23, 2012, Zediker et al.
U.S. Appl. No. 13/403,723, filed Feb. 23, 2012, Rinzler et al.
U.S. Appl. No. 13/403,741, filed Feb. 23, 2012, Zediker et al.
U.S. Appl. No. 13/486,795, filed Jun. 1, 2012, Rinzler et al.
U.S. Appl. No. 13/565,345, filed Aug. 2, 2012, Zediker et al.
U.S. Appl. No. 13/768,149, filed Feb. 15, 2013, Zediker et al.
U.S. Appl. No. 13/777,650, filed Feb. 26, 2013, Zediker et al.
U.S. Appl. No. 13/782,869, filed Mar. 1, 2013, Schroit et al.
U.S. Appl. No. 13/782,942, filed Mar. 1, 2013, Norton et al.
U.S. Appl. No. 13/800,559, filed Mar. 13, 2013, Zediker et al.
U.S. Appl. No. 13/800,820, filed Mar. 13, 2013, Zediker et al.
U.S. Appl. No. 13/800,879, filed Mar. 13, 2013, Zediker et al.
U.S. Appl. No. 13/800,933, filed Mar. 13, 2013, Zediker et al.
U.S. Appl. No. 13/849,831, filed Mar. 25, 2013, Zediker et al.

(56) References Cited

OTHER PUBLICATIONS

Related utility U.S. Appl. No. 13/565,345, filed on Aug. 2, 2012, 112 pages.
Related utility U.S. Appl. No. 13/777,650, filed on Feb. 26, 2013, 73 pages.
Related utility U.S. Appl. No. 13/800,559, filed on Mar. 13, 2013, 73 pages.
Related utility U.S. Appl. No. 13/800,820, filed on Mar. 13, 2013, 73 pages.
Related utility U.S. Appl. No. 13/800,879, filed on Mar. 13, 2013, 73 pages.
Related utility U.S. Appl. No. 13/800,933, filed on Mar. 13, 2013, 73 pages.
Related utility U.S. Appl. No. 13/849,831, filed on Mar. 25, 2013, 77 pages.
International Search Report for PCT Application No. PCT/US2011/044548, dated Jan. 24, 2012, 17 pgs.
International Search Report for PCT Application No. PCT/US2011/047902, dated Jan. 17, 2012, 9 pgs.
International Search Report for PCT Application No. PCT/US2011/050044, dated Feb. 1, 2012, 26 pgs.
International Search Report for PCT Application No. PCT/US2012/026277, dated May 30, 2012, 11 pgs.
International Search Report for PCT Application No. PCT/US2012/026265, dated May 30, 2012, 14 pgs.
International Search Report for PCT Application No. PCT/US2012/026280, dated May 30, 2012, 12 pgs.
International Search Report for PCT Application No. PCT/US2012/026471, dated May 30, 2012, 13 pgs.
International Search Report for PCT Application No. PCT/US2012/026525, dated May 31, 2012, 8 pgs.
International Search Report for PCT Application No. PCT/US2012/026526, dated May 31, 2012, 10 pgs.
International Search Report for PCT Application No. PCT/US2012/026494, dated May 31, 2012, 12 pgs.
International Search Report for PCT Application No. PCT/US2012/026337, dated Jun. 7, 2012, 21 pgs.
International Search Report for PCT Application No. PCT/US2012/020789, dated Jun. 29, 2012, 9 pgs.
International Search Report for PCT Application No. PCT/US2012/040490, dated Oct. 22, 2012, 14 pgs.
International Search Report for related application case No. PCT/US2012/049338, dated Jan. 22, 2013, 14 pgs.
Abdulagatova, Z. et al., "Effect of Temperature and Pressure on the Thermal Conductivity of Sandstone", *International Journal of Rock Mechanics & Mining Sciences*, vol. 46, 2009, pp. 1055-1071.
Abousleiman, Y. et al., "Poroelastic Solution of an Inclined Borehole in a Transversely Isotropic Medium", *Rock Mechanics*, Daemen & Schultz (eds), 1995, pp. 313-318.
Ackay, H. et al., Paper titled "Orthonormal Basis Functions for Continuous-Time Systems and Lp Convergence", date unknown but prior to Aug. 19, 2009, pp. 1-12.
Acosta, A. et al., paper from X Brazilian MRS meeting titled "Drilling Granite With Laser Light", X Encontro da SBPMat Granado-RS, Sep. 2011, 4 pages including pp. 56 and 59.
Agrawal, Govind P., "Nonlinear Fiber Optics", Chap. 9, Fourth Edition, Academic Press copyright 2007, pp. 334-337.
Ahmadi, M. et al., "The Effect of Interaction Time and Saturation of Rock on Specific Energy in ND:YAG Laser Perforating", *Optics and Laser Technology*, vol. 43, 2011, pp. 226-231.
Akhatov, I. et al., "Collapse and Rebound of a Laser-Induced Cavitation Bubble", *Physics of Fluids*, vol. 13, No. 10, Oct. 2001, pp. 2805-2819.
Albertson, M. L. et al., "Diffusion of Submerged Jets", a paper for the *American Society of Civil Engineers*, Nov. 5, 1852, pp. 1571-1596.
Al-Harthi, A. A. et al., "The Porosity and Engineering Properties of Vesicular Basalt in Saudi Arabia", *Engineering Geology*, vol. 54, 1999, pp. 313-320.
Anand, U. et al., "Prevention of Nozzle Wear in Abrasive Water Suspension Jets (AWSJ) Using Porous Lubricated Nozzles", *Transactions of the ASME*, vol. 125, Jan. 2003, pp. 168-181.
Andersson, J. C. et al., "The Aspo Pillar Stability Experiment: Part II—Rock Mass Response to Coupled Excavation-Induced and Thermal-Induced Stresses", *International Journal of Rock Mechanics & Mining Sciences*, vol. 46, 2009, pp. 879-895.
Anovitz, L. M. et al., "A New Approach to Quantification of Metamorphism Using Ultra-Small and Small Angle Neutron Scattering", *Geochimica et Cosmochimica Acta*, vol. 73, 2009, pp. 7303-7324.
Antonucci, V. et al., "Numerical and Experimental Study of a Concentrated Indentation Force on Polymer Matrix Composites", an excerpt from the *Proceedings of the Comsol Conference*, 2009, 4 pages.
ASTM International, "Standard Test Method for Thermal Conductivity of Solids by Means of the Guarded-Comparative-Longitudinal Heat Flow Technique", Standard under the fixed Designation E1225-09, 2009, pp. 1-9.
Atkinson, B. K., "Introduction to Fracture Mechanics and Its Geophysical Applications", *Fracture Mechanics of Rock*, 1987, pp. 1-26.
Aubertin, M. et al., "A Multiaxial Stress Criterion for Short- and Long-Term Strength of Isotropic Rock Media", *International Journal of Rock Mechanics & Mining Sciences*, vol. 37, 2000, pp. 1169-1193.
Avar, B. B. et al., "Porosity Dependence of the Elastic Modulus of Lithophysae-rich Tuff: Numerical and Experimental Investigations", *International Journal of Rock Mechanics & Mining Sciences*, vol. 40, 2003, pp. 919-928.
Backers, T. et al., "Tensile Fracture Propagation and Acoustic Emission Activity in Sandstone: The Effect of Loading Rate", *International Journal of Rock Mechanics & Mining Sciences*, vol. 42, 2005, pp. 1094-1101.
Baek, S. Y. et al., "Simulation of the Coupled Thermal/Optical Effects for Liquid Immersion Micro-/Nanolithography", source unknown, believed to be publically available prior to 2012,13 pages.
Bagatur, T. et al., "Air-entrainment Characteristics in a Plunging Water Jet System Using Rectangular Nozzles with Rounded Ends", *Water SA*, vol. 29, No. 1, Jan. 2003, pp. 35-38.
Baird, J. A. et al., "Analyzing the Dynamic Behavior of Downhole Equipment During Drilling", US government Sandia Report, SAND-84-0758C, DE84 008840, 7 pages.
Batarseh, S. I. et al, "Innovation in Wellbore Perforation Using High-Power Laser", *International Petroleum Technology Conference*, IPTC No. 10981, Nov. 2005, 7 pages.
Batarseh, S. et al., "Well Perforation Using High-Power Lasers", a paper prepared for presentation at the SPE (Society of Petroleum Engineers) Annual Technical Conference and Exhibition, SPE No. 84418, Oct. 2003, 10 pages.
Baykasoglu, A. et al., "Prediction of Compressive and Tensile Strength of Limestone via Genetic Programming", *Expert Systems with Applications*, vol. 35, 2008, pp. 111-123.
Belushi, F. et al., "Demonstration of the Power of Inter-Disciplinary Integration to Beat Field Development Challenges in Complex Brown Field-South Oman", *Society of Petroleum Engineers*, a paper prepared for presentation at the Abu Dhabi International Petroleum Exhibition & Conference, SPE No. 137154, Nov. 2010, 18 pages.
Belyaev, V. V., "Spall Damage Modelling and Dynamic Fracture Specificities of Ceramics", *Journal of Materials Processing Technology*, vol. 32, 1992, pp. 135-144.
Benavente, D. et al., "The Combined Influence of Mineralogical, Hygric and Thermal Properties on the Durability of Porous Building Stones", *Eur. J. Mineral*, vol. 20, Aug. 2008, pp. 673-685.
Bieniawski, Z. T., "Mechanism of Brittle Fracture of Rock: Part I—Theory of the Fracture Process", *Int. J. Rock Mech. Min. Sci.*, vol. 4, 1967, pp. 395-406.
Bilotsky, Y. et al., "Modelling Multilayers Systems with Time-Depended Heaviside and New Transition Functions", excerpt from the Proceedings of the 2006 Nordic Comsol Conference, 2006, 4 pages.
Birkholzer, J. T. et al., "The Impact of Fracture—Matrix Interaction on Thermal—Hydrological Conditions in Heated Fractured Rock", an origial research paper published online http://vzy.scijournals.org/cgi/content/full/5/2/657, May 26, 2006, 27 pages.

(56) References Cited

OTHER PUBLICATIONS

Blackwell, D. D. et al., "Geothermal Resources in Sedimentary Basins", a presentation for the Geothermal Energy Generation in Oil and Gas Settings, Mar. 13, 2006, 28 pages.
Blair, S. C. et al., "Analysis of Compressive Fracture in Rock Using Statistical Techniques: Part I. A Non-linear Rule-based Model", *Int. J. Rock Mech. Min. Sci.*, vol. 35 No. 7, 1998, pp. 837-848.
Blomqvist, M. et al., "All-in-Quartz Optics for Low Focal Shifts", *SPIE Photonics West Conference in San Francisco*, Jan. 2011, 12 pages.
Boechat, A. A. P. et al., "Bend Loss in Large Core Multimode Optical Fiber Beam Delivery Systems", *Applied Optics*., vol. 30 No. 3, Jan. 20, 1991, pp. 321-327.
Bolme, C. A., "Ultrafast Dynamic Ellipsometry of Laser Driven Shock Waves", a dissertation for the degree of Doctor of Philosophy in Physical Chemistry at Massachusetts Institute of Technology, Sep. 2008, pp. 1-229.
Brown, G., "Development, Testing and Track Record of Fiber-Optic, Wet-Mate, Connectors", *IEEE*, 2003, pp. 83-88.
Brujan, E. A. et al., "Dynamics of Laser-Induced Cavitation Bubbles Near an Elastic Boundar", *J. Fluid Mech*., vol. 433, 2001, pp. 251-281.
Burdine, N. T., "Rock Failure Under Dynamic Loading Conditions", Society of Petroleum Engineers Journal, Mar. 1963, pp. 1-8.
Bybee, K., "Modeling Laser-Spallation Rock Drilling", *JPT*, an SPE available at www.spe.org/jpt, Feb. 2006, 2 pages 62-63.
Bybee, Karen, highlight of "Drilling a Hole in Granite Submerged in Water by Use of CO2 Laser", an SPE available at www.spe.org/jpt, *JPT*, Feb. 2010, pp. 48, 50 and 51.
Cai, W. et al., "Strength of Glass from Hertzian Line Contact", *Optomechanics 2011: Innovations and Solutions*, 2011, 5 pages.
Capetta, I. S. et al., "Fatigue Damage Evaluation on Mechanical Components Under Multiaxial Loadings", European Comsol Conference, University of Ferrara, Oct. 16, 2009, 25 pages.
Carstens, J. P. et al., "Rock Cutting by Laser", a paper of *Society of Petroleum Engineers of AIME*, 1971, 11 pages.
Caruso, C. et al., "Dynamic Crack Propagation in Fiber Reinforced Composites", Excerpt from the Proceedings of the Comsol Conference, 2009, 5 pages.
Chastain, T. et al., "Deepwater Drilling Riser System", *SPE Drilling Engineering*, Aug. 1986, pp. 325-328.
Chen, H. Y. et al., "Characterization of the Austin Chalk Producing Trend", *SPE*, a paper prepared for presentation at the 61st Annual Technical Conference and Exhibition of the Society of Petroleum Engineers, SPE No. 15533, Oct. 1986, pp. 1-12.
Chen, K., paper titled "Analysis of Oil Film Interferometry Implementation in Non-Ideal Conditions", source unknown, Jan. 7, 2010, pp. 1-18.
Chraplyvy, A. R., "Limitations on Lightwave Communications Imposed by Optical-Fiber Nonlinearities", *Journal of Lightwave Technology*, vol. 8 No. 10, Oct. 1990, pp. 1548-1557.
Churcher, P. L. et al., "Rock Properties of Berea Sandstone, Baker Dolomite, and Indiana Limestone", a paper prepared for presentation at the SPE International Symposium on Oilfield Chemistry), *SPE*, SPE No. 21044, Feb. 1991, pp. 431-446 and 3 additional pages.
Cimetiere, A. et al., "A Damage Model for Concrete Beams in Compression", *Mechanics Research Communications*, vol. 34, 2007, pp. 91-96.
Close, F. et al., "Successful Drilling of Basalt in a West of Shetland Deepwater Discovery", a paper prepared for presentation at Offshore Europe 2005 by SPE (Society of Petroleum Engineers) Program Committee, SPE No. 96575, Sep. 2005, pp. 1-10.
Cohen, J. H., "High-Power Slim-Hole Drilling System", a paper presented at the conference entitled Natural Gas RD&D Contractor's Review Meeting, Office of Scientific and Technical Information, Apr. 1995, 10 pages.
Cone, C., "Case History of the University Block 9 (Wolfcamp) Field—Gas-Water Injection Secondary Recovery Project", *Journal of Petroleum Technology*, Dec. 1970, pp. 1485-1491.
Contreras, E. et al., "Effects of Temperature and Stress on the Compressibilities, Thermal Expansivities, and Porosities of Cerro Prieto and Berea Sandstones to 9000 PSI and 208 degrees Celsius", Proceedings Eighth Workshop Geothermal Reservoir Engineering, Leland Stanford Junior University, Dec. 1982, pp. 197-203.
Cooper, R., "Coiled Tubing Deployed ESPs Utilizing Internally Installed Power Cable—A Project Update", a paper prepared by SPE (Society of Petroleum Engineers) Program Committee for presentation at the 2nd North American Coiled Tubing Roundtable, SPE 38406, Apr. 1997, pp. 1-6.
Coray, P. S. et al., "Measurements on 5:1 Scale Abrasive Water Jet Cutting Head Models", source unknown, available prior to 2012, 15 pages.
Cruden, D. M., "The Static Fatigue of Brittle Rock Under Uniaxial Compression", *Int. J. Rock Mech. Min. Sci. & Geomech. Abstr*., vol. 11, 1974, pp. 67-73.
da Silva, B. M. G., "Modeling of Crack Initiation, Propagation and Coalescence in Rocks", a thesis for the degree of Master of Science in Civil and Environmental Engineering at the Massachusetts Institute of Technology, Sep. 2009, pp. 1-356.
Dahl, F. et al., "Development of a New Direct Test Method for Estimating Cutter Life, Based on the Sievers' J Miniature Drill Test", *Tunnelling and Underground Space Technology*, vol. 22, 2007, pp. 106-116.
de Castro Lima, J. J. et al., "Linear Thermal Expansion of Granitic Rocks: Influence of Apparent Porosity, Grain Size and Quartz Content", *Bull Eng Geol Env*., 2004, vol. 63, pp. 215-220.
Damzen, M. J. et al., "Stimulated Brillion Scattering", Chapter 8—SBS in Optical Fibres, OP Publishing Ltd, Published by Institute of Physics, London, England, 2003, pp. 137-153.
Degallaix, J. et al., "Simulation of Bulk-Absorption Thermal Lensing in Transmissive Optics of Gravitational Waves Detector", *Appl. Phys*., B77, 2003, pp. 409-414.
Dey, T. N. et al., "Some Mechanisms of Microcrack Growth and Interaction in Compressive Rock Failure", *Int. J. Rock Mech. Min. Sci. & Geomech. Abstr*., vol. 18, 1981, pp. 199-209.
Dimotakis, P. E. et al., "Flow Structure and Optical Beam Propagation in High-Reynolds-Number Gas-Phase Shear Layers and Jets", *J. Fluid Mech*., vol. 433, 2001, pp. 105-134.
Dole, L. et al., "Cost-Effective Cementitious Material Compatible with Yucca Mountain Repository Geochemistry", a paper prepared by Oak Ridge National Laboratory for the US Department of Energy, No. ORNL/TM-2004/296, Dec. 2004, 128 pages.
Dumans, C. F. F. et al., "PDC Bit Selection Method Through the Analysis of Past Bit Performances", a paper prepared for presentation at the *SPE* (Society of Petroleum Engineers—Latin American Petroleum Engineering Conference), Oct. 1990, pp. 1-6.
Dutton, S. P. et al., "Evolution of Porosity and Permeability in the Lower Cretaceous Travis Peak Formation, East Texas", *The American Association of Petroleum Geologists Bulletin*, vol. 76, No. 2, Feb. 1992, pp. 252-269.
Dyskin, A. V. et al., "Asymptotic Analysis of Crack Interaction with Free Boundary", *International Journal of Solids and Structure*, vol. 37, 2000, pp. 857-886.
Eckel, J. R. et al., "Nozzle Design and its Effect on Drilling Rate and Pump Operation", a paper presented at the spring meeting of the Southwestern District, Division of Production, Beaumont, Texas, Mar. 1951, pp. 28-46.
Ehrenberg, S. N. et al., "Porosity-Permeability Relationship in Interlayered Limestone-Dolostone Reservoir", *The American Association of Petroleum Geologists Bulletin*, vol. 90, No. 1, Jan. 2006, pp. 91-114.
Eichler, H.J. et al., "Stimulated Brillouin Scattering in Multimode Fibers for Optical Phase Conjugation", *Optics Communications*, vol. 208, 2002, pp. 427-431.
Ersoy, A., "Wear Characteristics of PDC Pin and Hybrid Core Bits in Rock Drilling", *Wear*, vol. 188, 1995, pp. 150-165.
Falcao, J. L. et al., "PDC Bit Selection Through Cost Prediction Estimates Using Crossplots and Sonic Log Data", *SPE*, a paper prepared for presentation at the 1993 SPE/IADC Drilling Conference, Feb. 1993, pp. 525-535.

(56) References Cited

OTHER PUBLICATIONS

Falconer, I. G. et al., "Separating Bit and Lithology Effects from Drilling Mechanics Data", *SPE*, a paper prepared for presentation at the 1988 IADC/SPE Drilling Conference, Feb./Mar. 1988, pp. 123-136.
Farra, G., "Experimental Observations of Rock Failure Due to Laser Radiation", a thesis for the degree of Master of Science at Massachusetts Institute of Technology, Jan. 1969, 128 pages.
Farrow, R. L. et al., "Peak-Power Limits on Fiber Amplifiers Imposed by Self-Focusing", *Optics Letters*, vol. 31, No. 23, Dec. 1, 2006, pp. 3423-3425.
Fertl, W. H. et al., "Spectral Gamma-Ray Logging in the Texas Austin Chalk Trend", *SPE of AIME*, a paper for Journal of Petroleum Technology, Mar. 1980, pp. 481-488.
Field, F. A., "A Simple Crack-Extension Criterion for Time-Dependent Spallation", *J. Mech. Phys. Solids*, vol. 19, 1971, pp. 61-70.
Finger, J. T. et al., "PDC Bit Research at Sandia National Laboratories", Sandia Report No. SAND89-0079-UC-253, a report prepared for US Department of Energy, Jun. 1989, 88 pages.
Freeman, T. T. et al., "THM Modeling for Reservoir Geomechanical Applications", presented at the Comsol Conference, Oct. 2008, 22 pages.
Friant, J. E. et al., "Disc Cutter Technology Applied to Drill Bits", a paper prepared by Exacavation Engineering Associates, Inc. for the US Department of Energy's Natural Gas Conference, Mar. 1997, pp. 1-16.
Fuerschbach, P. W. et al., "Understanding Metal Vaporization from Laser Welding", Sandia Report No. SAND-2003-3490, a report prepared for DOE, Sep. 2003, pp. 1-70.
Gahan, B. C. et al., "Analysis of Efficient High-Power Fiber Lasers for Well Perforation", *SPE*, No. 90661, a paper prepared for presentation at the SPE Annual Technical Conference and Exhibition, Sep. 2004, 9 pages.
Gahan, B. C. et al., "Effect of Downhole Pressure Conditions on High-Power Laser Perforation", *SPE*, No. 97093, a paper prepared for the 2005 SPE (Society of Petroleum Engineers) Annual Technical Conference and Exhibition, Oct. 12, 2005, 7 pages.
Gahan, B. C., et al., "Laser Drilling—Drilling with the Power of Light: High Energy Laser Perforation and Completion Techniques", Annual Technical Progress Report by the *Gas Technology Institute*, to the Department of Energy, Nov. 2006, 94 pages.
Gahan, B. C. et al., "Laser Drilling: Drilling with the Power of Light, Phase 1: Feasibility Study", a Topical Report by the *Gas Technology Institute*, for the US Government under Cooperative Agreement No. DE-FC26-00NT40917, Sep. 30, 2001, 107 pages.
Gale, J. F. W. et al., "Natural Fractures in the Barnett Shale and Their Importance for Hydraulic Fracture Treatments", The American Assoction of Petroleum Geologists, *AAPG Bulletin*, vol. 91, No. 4, Apr. 2007, pp. 603-622.
Gardner, R. D. et al., "Flourescent Dye Penetrants Applied to Rock Fractures", *Int. J. Rock Mech. Min. Sci.*, vol. 5, 1968, pp. 155-158 with 2 additional pages.
Gelman, A., "Multi-level (hierarchical) modeling: what it can and can't do", source unknown, Jun. 1, 2005, pp. 1-6.
Gerbaud, L. et al., "PDC Bits: All Comes From the Cutter/Rock Interaction", SPE, No. IADC/SPE 98988, a paper presented at the IADC/SPE Drilling Conference, Feb. 2006, pp. 1-9.
Gonthier, F. "High-power All-Fiber® components: The missing link for high power fiber fasers", source unknown, 11 pages.
Graves, R. M. et al., "Comparison of Specific Energy Between Drilling With High Power Lasers and Other Drilling Methods", *SPE*, No. SPE 77627, a paper presented at the SPE (Society of Petroleum Engineers) Annual Technical Conference and Exhibiton, Sep. 2002, pp. 1-8.
Graves, R. M. et al., "Spectral signatures and optic coeffecients of surface and reservoir rocks at COIL, CO2 and ND:YAG laser wavelenghts", source unknown, 13 pages.
Graves, R. M. et al., "StarWars Laser Technology Applied to Drilling and Completing Gas Wells", *SPE*, No. 49259, a paper prepared for presentation at the 1998 SPE Annual Technical Conference and Exhibition, 1998, 761-770.
Green, D. J. et al., "Crack Arrest and Multiple Crackling in Glass Through the Use of Designed Residual Stress Profiles", *Science*, vol. 283, No. 1295, 1999, pp. 1295-1297.
Grigoryan, V., "Inhomogeneous Boundary Value Problems", a lecture for Math 124B, Jan. 26, 2010, pp. 1-5.
Grigoryan, V., "Separathion of variables: Neumann Condition", a lecture for Math 124A, Dec. 1, 2009, pp. 1-3.
Gunn, D. A. et al., "Laboratory Measurement and Correction of Thermal Properties for Application to the Rock Mass", *Geotechnical and Geological Engineering*, vol. 23, 2005, pp. 773-791.
Guo, B. et al., "Chebyshev Rational Spectral and Pseudospectral Methods on a Semi-infinite Interval", *Int. J. Numer. Meth. Engng*, vol. 53, 2002, pp. 65-84.
Gurarie, V. N., "Stress Resistance Parameters of Brittle Solids Under Laser/Plasma Pulse Heating", *Materials Science and Engineering*, vol. A288, 2000, pp. 168-172.
Hagan, P. C., "The Cuttability of Rock Using a High Pressure Water Jet", University of New South Wales, Sydney, Australia, obtained form the Internet on Sep. 7, 2010, at: http://www.mining.unsw.edu.au/Publications/publications_staff/Paper_Hagan_WASM.htm, 16 pages.
Hall, K. et al., "Rock Albedo and Monitoring of Thermal Conditions in Respect of Weathering: Some Expected and Some Unexpected Results", *Earth Surface Processes and Landforms*, vol. 30, 2005, pp. 801-811.
Hammer, D. X. et al., "Shielding Properties of Laser-Induced Breakdown in Water for Pulse Durations from 5 ns to 125 fs", *Applied Optics*, vol. 36, No. 22, Aug. 1, 1997, pp. 5630-5640.
Hancock, M. J., "The 1-D Heat Equation: 18.303 Linear Partial Differential Equations", source unknown, 2004, pp. 1-41.
Hareland, G., et al., "A Drilling Rate Model for Roller Cone Bits and Its Application", *SPE*, No. 129592, a paper prepared for presentation at the CPS/SPE International Oil and Gas Conference and Exhibition, Jun. 2010, pp. 1-7.
Hareland, G. et al., "Drag—Bit Model Including Wear", *SPE*, No. 26957, a paper prepared for presentation at the Latin American/Caribbean Petroleum Engineering Conference, Apr. 1994, pp. 657-667.
Harrison, C. W. III et al., "Reservoir Characterization of the Frontier Tight Gas Sand, Green River Basin, Wyoming", *SPE*, No. 21879, a paper prepared for presentation at the Rocky Mountain Regional Meeting and Low-Permeability Reservoirs Symposium, Apr. 1991, pp. 717-725.
Hashida, T. et al., "Numerical Simulation with Experimental Verification of the Fracture Behavior in Granite Under Confining Pressures based on the Tension-Softening Model", *International Journal of Fracture*, vol. 59, 1993, pp. 227-244.
Hasting, M. A. et al., "Evaluation of the Environmental Impacts of Induced Seismicity at the Naknek Geothermal Energy Project, Naknek, Alaska", a final report prepared for ASRC Energy Services Alaska Inc., May 2010, pp. 1-33.
Head, P. et al., "Electric Coiled Tubing Drilling (E-CTD) Project Update", *SPE*, No. 68441, a paper prepared for presentation at the SPE/CoTA Coiled Tubing Roundtable, Mar. 2001, pp. 1-9.
Hood, M., "Waterjet-Assisted Rock Cutting Systems—The Present State of the Art", *International Journal of Mining Engineering*, vol. 3, 1985, pp. 91-111.
Howard, A. D. et al., "VOLAN Interpretation and Application in the Bone Spring Formation (Leonard Series) in Southeastern New Mexico", *SPE*, No. 13397, a paper presented at the 1984 SPE Production Technology Symposium, Nov. 1984, 10 pages.
Howells, G., "Super-Water [R] Jetting Applications from 1974 to 1999", paper presented st the Proceedings of the $10^{th}$ American Waterjet Confeence in Houston, Texas, 1999, 25 pages.
Hu, H. et al., "Simultaneous Velocity and Concentration Measurements of a Turbulent Jet Mixing Flow", *Ann. N. Y. Acad. Sci.*, vol. 972, 2002, pp. 254-259.

(56) References Cited

OTHER PUBLICATIONS

Huang, C. et al., "A Dynamic Damage Growth Model for Uniaxial Compressive Response of Rock Aggregates", *Mechanics of Materials*, vol. 34, 2002, pp. 267-277.
Huang, H. et al., "Intrinsic Length Scales in Tool-Rock Interaction", *International Journal of Geomechanics*, Jan./Feb. 2008, pp. 39-44.
Huenges, E. et al., "The Stimulation of a Sedimentary Geothermal Reservoir in the North German Basin: Case Study Grob Schonebeck", *Proceedings, Twenty-Ninth Workshop on Geothermal Reservoir Engineering*, Stanford University, Stanford, California, Jan. 26-28, 2004, 4 pages.
Hutchinson, J. W., "Mixed Mode Cracking in Layered Materials", *Advances in Applied Mechanics*, vol. 29, 1992, pp. 63-191.
Imbt, W. C. et al., "Porosity in Limestone and Dolomite Petroleum Reservoirs", paper presented at the Mid Continent District, Division of Production, Oklahoma City, Oklahoma, Jun. 1946, pp. 364-372.
Jackson, M. K. et al., "Nozzle Design for Coherent Water Jet Production", source unknown, believed to be published prior to 2012, pp. 53-89.
Jadoun, R. S., "Study on Rock-Drilling Using PDC Bits for the Prediction of Torque and Rate of Penetration", *Int. J. Manufacturing Technology and Management*, vol. 17, No. 4, 2009, pp. 408-418.
Jain, R. K. et al., "Development of Underwater Laser Cutting Technique for Steel and Zircaloy for Nuclear Applications", *Journal of Physics for Indian Academy of Sciences*, vol. 75 No. 6, Dec. 2010, pp. 1253-1258.
Jen, C. K. et al., "Leaky Modes in Weakly Guiding Fiber Acoustic Waveguides", *IEEE Transactions on Ultrasonic Ferroelectrics and Frequency Control*, vol. UFFC-33 No. 6, Nov. 1986, pp. 634-643.
Judzis, A. et al., "Investigation of Smaller Footprint Drilling System; Ultra-High Rotary Speed Diamond Drilling Has Potential for Reduced Energy Requirements", IADC/SPE No. 99020, 33 pages.
Jurewicz, B. R., "Rock Excavation with Laser Assistance", *Int. J. Rock Mech. Min. Sci. & Geomech. Abstr.*, vol. 13, 1976, pp. 207-219.
Karakas, M., "Semianalytical Productivity Models for Perforated Completions", *SPE*, No. 18247, a paper for SPE (Society of Petroleum Engineers) Production Engineering, Feb. 1991, pp. 73-82.
Karasawa, H. et al., "Development of PDC Bits for Downhole Motors", *Proceedings 17th NZ Geothermal Workshop*, 1995, pp. 145-150.
Kemeny, J. M., "A Model for Non-linear Rock Deformation Under Compression Due to Sub-critical Crack Growth", *Int. J. Rock Mech. Min. Sci. & Geomech. Abstr.*, vol. 28 No. 6, 1991, pp. 459-467.
Khandelwal, M., "Prediction of Thermal Conductivity of Rocks by Soft Computing", *Int. J. Earth Sci.* (*Geol. Rundsch*), May 11, 2010, 7 pages.
Kim, C. B. et al., "Measurement of the Refractive Index of Liquids at 1.3 and 1.5 Micron Using a Fibre Optic Fresnel Ratio Meter", *Meas. Sci. Technol.*,vol. 5, 2004, pp. 1683-1686.
Kiwata, T. et al., "Flow Visualization and Characteristics of a Coaxial Jet with a Tabbed Annular Nozzle", *JSME International Journal Series B*, vol. 49, No. 4, 2006, pp. 906-913.
Kobayashi, T. et al., "Drilling a 2-inch in Diameter Hole in Granites Submerged in Water by CO2 Lasers", *SPE*, No. 119914, a paper prepared for presentation at the SPE/IADC Drilling Conference and Exhibition, Mar. 2009, 6 pages.
Kobyakov, A. et al., "Design Concept for Optical Fibers with Enhanced SBS Threshold", *Optics Express*, vol. 13, No. 14, Jul. 11, 2005, pp. 5338-5346.
Kolari, K., "Damage Mechanics Model for Brittle Failure of Transversely Isotropic Solids (Finite Element Implementation)", *VTT Publications 628*, 2007, 210 pages.
Kollé, J. J., "A Comparison of Water Jet, Abrasive Jet and Rotary Diamond Drilling in Hard Rock", *Tempress Technologies Inc.*, 1999, pp. 1-8.
Kolle, J. J., "HydroPulse Drilling", a Final Report for US Department of Energy under Cooperative Development Agreement No. DE-FC26-FT34367, Apr. 2004, 28 pages.
Kovalev, V. I. et al., "Observation of Hole Burning in Spectrum in SBS in Optical Fibres Under CW Monochromatic Laser Excitation", *IEEE*, Jun. 3, 2010, pp. 56-57.
Koyamada, Y. et al., "Simulating and Designing Brillouin Gain Spectrum in Single-Mode Fibers", *Journal of Lightwave Technology*, vol. 22, No. 2, Feb. 2004, pp. 631-639.
Krajcinovic, D. et al., "A Micromechanical Damage Model for Concrete", *Engineering Fracture Mechanics*, vol. 25, No. 5/6, 1986, pp. 585-596.
Kranz, R. L., "Microcracks in Rocks: A Review", *Tectonophysics*, vol. 100, 1983, pp. 449-480.
Kubacki, Emily et al., "Optics for Fiber Laser Applications", *CVI Laser, LLC*, Technical Reference Document #20050415, 2005, 5 pgs.
Office Action regarding corresponding Chinese Patent Application 200980141304.7 dated Mar. 5, 2013, 6 pages with English-language translation, 11 pages.
U.S. Appl. No. 12/706,576, filed Feb. 16, 2010, 28 pgs.
U.S. Appl. No. 12/840,978, filed Jul. 21, 2009, 61 pgs.
Agrawal Dinesh et al., Report on "Development of Advanced Drill Components for BHA Using Mircowave Technology Incorporating Carbide Diamond Composites and Functionally Graded Materials", Microwave Processing and Engineering Center, Material Research Institute, The Pennsylvania State University, 2003, 10 pgs.
Agrawal Dinesh et al., Report on "Graded Steele-Tungsten Cardide/Cobalt-Diamond Systems Using Microwave Heating", Material Research Institute, Penn State University, *Proceedings of the 2002 International Conference on Functionally Graded Materials*, 2002, pp. 50-58.
Agrawal Dinesh et al., "Microstructural by TEM of WC/Co composites Prepared by Conventional and Microwave Processes", Materials Research Lab, The Pennsylvania State University, *15th International Plansee Seminar*, vol. 2, , 2001, pp. 677-684.
Ai, H.A. et al., "Simulation of dynamic response of granite: A numerical approach of shock-induced damage beneath impact craters", *International Journal of Impact Engineering*, vol. 33, 2006, pp. 1-10.
Anton, Richard J. et al., "Dynamic Vickers indentation of brittle materials", *Wear*, vol. 239, 2000, pp. 27-35.
Ashby, M. F. et al., "The Failure of Brittle Solids Containing Small Cracks Under Compressive Stress States", *Acta Metall.*, vol. 34, No. 3,1986, pp. 497-510.
Aydin, A. et al., "The Schmidt hammer in rock material characterization", *Engineering Geology*, vol. 81, 2005, pp. 1-14.
Baflon, Jean-Paul et al., "On the Relationship Between the Parameters of Paris' Law for Fatigue Crack Growth in Aluminium Alloys", *Scripta Metallurgica*, vol. 11, No. 12, 1977, pp. 1101-1106.
Bailo, El Tahir et al., "Spectral signatures and optic coefficients of surface and reservoir shales and limestones at COIL, $CO_2$ and ND:YAG laser wavelengths", *Petroleum Engineering Department, Colorado School of Mines*, 2004, 13 pgs.
Baird, J. A. "GEODYN: A Geological Formation/Drillstring Dynamics Computer Program", *Society of Petroleum Engineers of AIME*, 1964, 9 pgs.
Baird, Jerold et al., Phase 1 Theoretical Description, A Geological Formation Drill String Dynamic Interaction Finite Element Program (GEODYN), *Sandia National Laboratories*, Report No. SAND-84-7101, 1984, 196 pgs.
Batarseh, S. et al. "Well Perforation Using High-Power Lasers", *Society of Petroleum Engineers*, SPE 84418, 2003, pp. 1-10.
BDM Corporation, Geothermal Completion Technology Life-Cycle Cost Model (GEOCOM), *Sandia National Laboratories*, for the U.S. Dept. of Energy, vols. 1 and 2, 1982, 222 pgs.
Beste, U. et al., "Micro-scratch evaluation of rock types—a means to comprehend rock drill wear", *Tribology International*, vol. 37, 2004, pp. 203-210.
Blackwell, B. F., "Temperature Profile in Semi-infinite Body With Exponential Source and Convective Boundary Condition", *Journal of Heat Transfer, Transactions of the ASME*, vol. 112, 1990, pp. 567-571.
Britz, Dieter, "Digital Simulation in Electrochemistry", *Lect. Notes Phys.*, vol. 666, 2005, pp. 103-117.

(56) References Cited

OTHER PUBLICATIONS

Browning, J. A. et al., "Recent Advances in Flame Jet Working of Minerals", *7th Symposium on Rock Mechanics*, Pennsylvania State Univ., 1965, pp. 281-313.
Cardenas, R., "Protected Polycrystalline Diamond Compact Bits for Hard Rock Drilling", Report No. DOE-99049-1381, *U.S. Department of Energy*, 2000, pp. 1-79.
Carstens, Jeffrey et al., "Heat-Assisted Tunnel Boring Machines", *Federal Railroad Administration and Urban Mass Transportation Administration*, U.S. Dept. of Transportation, Report No. FRA-RT-71-63, 1970, 340 pgs.
Clegg, John et al., "Improved Optimisation of Bit Selection Using Mathematically Modelled Bit-Performance Indices", *IADC/SPE International 102287*, 2006, pp. 1-10.
Close, F. et al., "Successful Drilling of Basalt in a West of Shetland Deepwater Discovery", *SPE International 96575*, Society of Petroleum Engineers, 2006, pp. 1-10.
Cobern, Martin E., "Downhole Vibration Monitoring & Control System Quarterly Technical Report #1", *APS Technology, Inc.*, Quarterly Technical Report #1, DCMCS, 2003, pp. 1-15.
Cogotsi, G. A. et al., "Use of Nondestructive Testing Methods in Evaluation of Thermal Damage for Ceramics Under Conditions of Nonstationary Thermal Effects", *Institute of Strength Problems, Academy of Sciences of the Ukrainian SSR*, 1985, pp. 52-56.
Cook, Troy, "Chapter 23, Calculation of Estimated Ultimate Recovery (EUR) for Wells in Continuous-Type Oil and Gas Accumulations", *U.S. Geological Survey Digital Data Series DDS-69-D*, Denver, Colorado: Version 1, 2005, pp. 1-9.
Dahl, Filip et al., "Development of a new direct test method for estimating cutter life, based on the Sievers J miniature drill test", *Tunnelling and Underground Space Technology*, vol. 22, 2007, pp. 106-116.
Das, A. C. et al., "Acousto-ultrasonic study of thermal shock damage in castable refractory", *Journal of Materials Science Letters*, vol. 10, 1991, pp. 173-175.
De Guire, Mark R., "Thermal Expansion Coefficient (start)", *EMSE 201—Introduction to Materials Science & Engineering*, 2003, pp. 15.1-15.15.
Dinçer, Ismail et al., "Correlation between Schmidt hardness, uniaxial compressive strength and Young's modulus for andesites, basalts and tuffs", *Bull Eng Geol Env*, vol. 63, 2004, pp. 141-148.
Dunn, James C., "Geothermal Technology Development at Sandia", *Geothermal Research Division, Sandia National Laboratories*, 1987, pp. 1-6.
Eighmy, T. T. et al., "Microfracture Surface Charaterizations: Implications for In Situ Remedial Methods in Fractured Rock", *Bedrock Bioremediation Center, Final Report, National Risk Management Research Laboratory, Office of Research and Development, U.S. Environmental Protection Agency*, EPA/600/R-05/121, 2006, pp. 1-99.
Elsayed, M.A. et al., "Measurement and analysis of Chatter in a Compliant Model of a Drillstring Equipped With a PDC Bit", *Mechanical Engineering Dept., University of Southwestern Louisiana* and *Sandia National Laboratories*, 2000, pp. 1-10.
Ferro, D. et al., "Vickers and Knoop hardness of electron beam deposited ZrC and HfC thin films on titanium", *Surface & Coatings Technology*, vol. 200, 2006, pp. 4701-4707.
Figueroa, H. et al., "Rock removal using high power lasers for petroleum exploitation purposes", *Gas Technology Institute, Colorado School of Mines, Halliburton Energy Services, Argonne National Laboratory*, 2002, pp. 1-13.
Finger, John T. et al., "PDC Bit Research at Sandia National Laboratories", Sandia Report, *Geothermal Research Division 6252, Sandia National Laboratories*, SAND89-0079-UC-253, 1989, pp. 1-88.
Gahan, Brian C. et al. "Analysis of Efficient High-Power Fiber Lasers for Well Perforation", *Society of Petroleum Engineers*, SPE 90661, 2004, pp. 1-9.
Gahan, Brian C. et al. "Efficient of Downhole Pressure Conditions on High-Power Laser Perforation", *Society of Petroleum Engineers*, SPE 97093, 2005, pp. 1-7.
Gahan, B. C. et al., "Laser Drilling: Determination of Energy Required to Remove Rock", *Society of Petroleum Engineers* International, SPE 71466, 2001, pp. 1-11.
Gahan, Brian C. et al., "Laser Drilling: Drilling with the Power of Light, Phase 1: Feasibility Study", *Topical Report*, Cooperative Agreement No. DE-FC26-00NT40917, 2000-2001, pp. 1-148.
Glowka, David A., "Design Considerations for a Hard-Rock PDC Drill Bit", *Geothermal Technology Development Division 6241, Sandia National Laboratories*, SAND-85-0666C, DE85 008313, 1985, pp. 1-23.
Glowka, David A., "Development of a Method for Predicting the Performance and Wear of PDC Drill Bits", *Sandia National Laboratories*, SAND86-1745-UC-66c, 1987, pp. 1-206.
Glowka, David A. et al., "Program Plan for the Development of Advanced Synthetic-Diamond Drill Bits for Hard-Rock Drilling", *Sandia National Laboratories*, SAND 93-1953, 1993, pp. 1-50.
Glowka, David A. et al., "Progress in the Advanced Synthetic-Diamond Drill Bit Program", *Sandia National Laboratories*, SAND95-2617C, 1994, pp. 1-9.
Glowka, David A., "The Use of Single—Cutter Data in the Analysis of PDC Bit Designs", *61st Annual Technical Conference and Exhibition of Society of Petroleum Engineers*, 1986, pp. 1-37.
Graves, Ramona M. et al., "Application of High Power Laser Technology to Laser/Rock Destruction: Where Have We Been? Where Are We Now?", *SW AAPG Convention*, 2002, pp. 213-224.
Graves, Ramona M. et al., "Laser Parameters That Effect Laser-Rock Interaction: Determining the Benefits of Applying Star Wars Laser Technology for Drilling and Completing Oil and Natural Gas Wells", Topical Report, *Petroleum Engineering Department, Colorado School of Mines*, 2001, pp. 1-157.
Habib, P. et al., "The Influence of Residual Stresses on Rock Hardness", *Rock Mechanics*, vol. 6, 1974, pp. 15-24.
Hall, Kevin, "The role of thermal stress fatigue in the breakdown of rock in cold regions", *Geomorphology*, vol. 31, 1999, pp. 47-63.
Han, Wei, "Computational and experimental investigations of laser drilling and welding for microelectronic packaging", *Dorchester Polytechnic Institute*, A Dissertation submitted in May 2004, 242 pgs.
Hareland, G. et al., "Cutting Efficiency of a Single PDC Cutter on Hard Rock", *Journal of Canadian Petroleum Technology*, vol. 48, No. 6, 2009, pp. 1-6.
Healy, Thomas E., "Fatigue Crack Growth in Lithium Hydride", *Lawrence Livermore National Laboratory*, 1993, pp. 1-32.
Hettema, M. H. H. et al., "The Influence of Steam Pressure on Thermal Spalling of Sedimentary Rock: Theory and Experiments", *Int. J. Rock Mech. Min. Sci.*, vol. 35, No. 1, 1998, pp. 3-15.
Hibbs, Louis E. et al., "Wear Machanisms for Polycrystalline-Diamond Compacts as Utilized fro Drilling in Geothermal Environments", *Sandia National Laboratories*, for the United States Government, Report No. SAND-82-7213, 1983, 287 pgs.
Hoek, E., "Fracture of Anisotropic Rock", *Journal of the South African Institute of Mining and Metallurgy*, vol. 64, No. 10, 1964, pp. 501-523.
Hoover, Ed R. et al., "Failure Mechanisms of Polycrystalline-Diamond Compact Drill Bits in Geothermal Environments", Sandia Report, *Sandia National Laboratories*, SAND81-1404, 1981, pp. 1-35.
Huff, C. F. et al., "Recent Developments in Polycrystalline Diamond-Drill-Bit Design", *Drilling Technology Division—4741, Sandia National Laboratories*, 1980, pp. 1-29.
Jimeno, Carlos Lopez et al., Drilling and Blasting of Rocks, *a. a. Balkema* Publishers, 1995, 30 pgs.
Kahraman, S. et al., "Dominant rock properties affecting the penetration rate of percussive drills", *International Journal of Rock Mechanics and Mining Sciences*, 2003, vol. 40, pp. 711-723.
Kelsey, James R., "Drilling Technology/GDO", *Sandia National Laboratories*, SAND-85-1866c, DE85 017231, 1985, pp. 1-7.
Kerr, Callin Joe, "PDC Drill Bit Design and Field Application Evolution", *Journal of Petroleum Technology*, 1988, pp. 327-332.
Ketata, C. et al., "Knowledge Selection for Laser Drilling in the Oil and Gas Industry", *Computer Society*, 2005, pp. 1-6.

(56) References Cited

OTHER PUBLICATIONS

Khan, Ovais U. et al., "Laser heating of sheet metal and thermal stress development", *Journal of Materials Processing Technology*, vol. 155-156, 2004, pp. 2045-2050.
Kim, K. R. et al., "$CO_2$ laser-plume interaction in materials processing", *Journal of Applied Physics*, vol. 89, No. 1, 2001, pp. 681-688.
Klotz, K. et al., "Coatings with intrinsic stress profile: Refined creep analysis of (Ti,A1)N and cracking due to cyclic laser heating", *Thin Solid Films*, vol. 496, 2006, pp. 469-474.
Kobayashi, Toshio et al., "Drilling a 2-inch in Diameter Hole in Granites Submerged in Water by $CO_2$ Lasers", *SPE International, IADC 119914 Drilling Conference and Exhibition*, 2009, pp. 1-11.
Kujawski, Daniel, "A fatigue crack driving force parameter with load ratio effects", *International Journal of Fatigue*, vol. 23, 2001, pp. S239-S246.
Labuz, J. F. et al., "Microrack-dependent fracture of damaged rock", *International Journal of Fracture*, vol. 51, 1991, pp. 231-240.
Lacy, Lewis L., "Dynamic Rock Mechanics Testing for Optimized Fracture Designs", *Society of Petroleum Engineers International, Annual Technical Conference and Exhibition*, 1997, pp. 23-36.
Lau, John H., "Thermal Fatigue Life Prediction of Flip Chip Solder Joints by Fracture Mechanics Method", *Engineering Fracture Mechanics*, vol. 45, No. 5, 1993, pp. 643-654.
Leong, K. H. et al., "Lasers and Beam Delivery for Rock Drilling", *Argonne National Laboratory*, ANL/TD/TM03-01, 2003, pp. 1-35.
Leung, M. et al., "Theoretical study of heat transfer with moving phase-change interface in thawing of frozen food", *Journal of Physics D: Applied Physics*, vol. 38, 2005, pp. 477-482.
Lima, R. S. et al., "Elastic Modulus Measurements via Laser-Ultrasonic and Knoop Indentation Techniques in Thermally Sprayed Coatings", *Journal of Thermal Spray Technology*, vol. 14(1), 2005, pp. 52-60.
Lin, Y. T., "The Impact of Bit Performance on Geothermal-Well Cost", *Sandia National Laboratories*, SAND-81-1470C, 1981, pp. 1-6.
Lomov, I. N. et al., "Explosion in the Granite Field: Hardening and Softening Behavior in Rocks", *U.S. Department of Energy, Lawrence Livermore National Laboratory*, 2001, pp. 1-7.
Long, S. G. et al., "Thermal fatigue of particle reinforced metal-matrix composite induced by laser heating and mechanical load", *Composites Science and Technology*, vol. 65, 2005, pp. 1391-1400.
Lyons, K. David et al., "NETL Extreme Drilling Laboratory Studies High Pressure High Temperature Drilling Phenomena", *U.S. Department of Energy, National Energy Technology Laboratory*, 2007, pp. 1-6.
Marshall, David B. et al., "Indentation of Brittle Materials", *Microindentation Techniques in Materials Science and Engineering, ASTM STP 889; American Society for Testing and Materials*, 1986, pp. 26-46.
Maurer, William C., "Advanced Drilling Techniques", published by Petroleum Publishing Co., copyright 1980, 26 pgs.
Maurer, William C., "Novel Drilling Techniques", published by Pergamon Press, UK, copyright 1968, pp. 1-64.
Mazerov, Katie, "Bigger coil sizes, hybrid rigs, rotary steerable advances push coiled tubing drilling to next level", *Drilling Contractor*, 2008, pp. 54-60.
Medvedev, I. F. et al., "Optimum Force Characteristics of Rotary-Percussive Machines for Drilling Blast Holes", Moscow, Translated from *Fiziko-Tekhnicheskie Problemy Razrabotki Poleznykh Iskopaemykh*, No. 1, 1967, pp. 77-80.
Mensa-Wilmot, Graham et al., "Advanced Cutting Structure Improves PDC Bit Performance in Hard and Abrasive Drilling Environments", *Society of Petroleum Engineers International*, 2003, pp. 1-13.
Messaoud, Louafi, "Influence of Fluids on the Essential Parameters of Rotary Percussive Drilling", *Laboratoire d'Environnement (Tébessa)*, vol. 14, 2009, pp. 1-8.
Moradian, Z. A. et al., "Predicting the Uniaxial Compressive Strength and Static Young's Modulus of Intact Sedimentary Rocks Using the Ultrasonic Test", *International Journal of Geomechanics*, vol. 9, No. 1, 2009, pp. 14-19.
Muto, Shigeki et al., "Laser cutting for thick concrete by multi-pass technique", *Chinese Optics Letters*, vol. 5 Supplement, 2007, pp. S39-S41.
Naqavi, I. Z. et al., "Laser heating of multilayer assembly and stress levels: elasto-plastic consideration", *Heat and Mass Transfer*, vol. 40, 2003, pp. 25-32.
Nara, Y. et al., "Sub-critical crack growth in anisotropic rock", *International Journal of Rock Mechanics and Mining Sciences*, vol. 43, 2006, pp. 437-453.
Nemat-Nasser, S. et al., "Compression-Induced Nonplanar Crack Extension With Application to Splitting, Exfoliation, and Rockburst", *Journal of Geophysical Research*, vol. 87, No. B8, 1982, pp. 6805-6821.
O'Hare, Jim et al., "Design Index: A Systematic Method of PDC Drill-Bit Selection", *Society of Petroleum Engineers International*, IADC/SPE Drilling Conference, 2000, pp. 1-15.
Okon, P. et al., "Laser Welding of Aluminium Alloy 5083", *21st International Congress on Applications of Lasers and Electro-Optics*, 2002, pp. 1-9.
Ortega, Alfonso et al., "Frictional Heating and Convective Cooling of Polycrystalline Diamond Drag Tools During Rock Cutting", Report No. SAND 82-0675c, *Sandia National Laboratories*, 1982, 23 pgs.
Ortega, Alfonso et al., "Studies of the Frictional Heating of Polycrystalline Diamond Compact Drag Tools During Rock Cutting", *Sandia National Laboratories*, SAND-80-2677, 1982, pp. 1-151.
Ortiz, Blas et al., Improved Bit Stability Reduces Downhole Harmonics (Vibrations), *International Association of Drilling Contractors/ Society of Petroleum Engineers Inc.*, 1996, pp. 379-389.
Palashchenko, Yuri A., "Pure Rolling of Bit Cones Doubles Performance",*I & Gas Journal*, vol. 106, 2008, 8 pgs.
Pardoen, T. et al., "An extended model for void growth and Coalescence", *Journal of the Mechanics and Physics of Solids*, vol. 48, 2000, pp. 2467-2512.
Park, Un-Chul et al., "Thermal Analysis of Laser Drilling Processes", *IEEE Journal of Quantum Electronics*, 1972, vol. QK-8, No. 2, 1972, pp. 112-119.
Parker, Richard A. et al., "Laser Drilling Effects of Beam Application Methods on Improving Rock Removal", *Society of Petroleum Engineers*, SPE 84353, 2003, pp. 1-7.
Pavlina, E. J. et al., "Correlation of Yield Strength and Tensile Strength with Hardness for Steels", *Journals of Materials Engineering and Performance*, vol. 17, No. 6, 2008, pp. 888-893.
Ping, Cao et al., "Testing study of subcritical crack growth rate and fracture toughness in different rocks", *Transactions of Nonferrous Metals Society of China*, vol. 16, 2006, pp. 709-714.
Plinninger, Ralf J. et al., "Predicting Tool Wear in Drill and Blast", *Tunnels & Tunneling International Magazine*, 2002, pp. 1-5.
Plinninger, Dr. Ralf J. et al., "Wear Prediction in Hardrock Excavation Using the CERCHAR Abrasiveness Index (CAI)", *EUROCK 2004 & 53rd Geomechanics Colloquium. Schubert (ed.)*, VGE, 2004, pp. 1-6.
Polsky, Yarom et al., "Enhanced Geothermal Systems (EGS) Well Construction Technology Evaluation Report", *Sandia National Laboratories*, Sandia Report, SAND2008-7866, 2008, pp. 1-108.
Pooniwala, Shahvir, "Lasers: The Next Bit", *Society of Petroleum Engineers*, No. SPE 104223, 2006, 10 pgs.
Potyondy, D. O. et al., "A Bonded-particle model for rock", *International Journal of Rock Mechanics and Mining Sciences*, vol. 41, 2004, pp. 1329-1364.
Qixian, Luo et al., "Using compression wave ultrasonic transducers to measure the velocity of surface waves and hence determine dynamic modulus of elasticity for concrete", *Construction and Building Materials*, vol. 10, No. 4, 1996, pp. 237-242.
Radkte, Robert, "New High Strength and faster Drilling TSP Diamond Cutters", Report by *Technology International, Inc.*, DOE Award No. DE-FC26-97FT34368, 2006, 97 pgs.

(56) References Cited

OTHER PUBLICATIONS

Rauenzahn, R. M., "Analysis of Rock Mechanics and Gas Dynamics of Flame-Jet Thermal Spallation Drilling", *Massachusetts Institute of Technology*, submitted in partial fulfillment of doctorate degree, 1986 583 pgs.
Rauenzahn, R. M. et al., "Rock Failure Mechanisms of Flame-Jet Thermal Spallation Drilling—Theory and Experimental Testing", *Int. J. Rock Merch. Min. Sci. & Geomech. Abstr.*, vol. 26, No. 5, 1989, pp. 381-399.
Raymond, David W., "PDC Bit Testing at Sandia Reveals Influence of Chatter in Hard-Rock Drilling", *Geothermal Resources Council Monthly Bulletin*, SAND99-2655J, 1999, 7 pgs.
Rossmanith, H. P. et al., "Wave Propagation, Damage Evolution, and Dynamic Fracture Extension. Part I. Percussion Drilling", *Materials Science*, vol. 32, No. 3, 1996, pp. 350-358.
Sachpazis, C. I, M. Sc., Ph. D., "Correlating Schmidt Hardness With Compressive Strength and Young's Modulus of Carbonate Rocks", *International Association of Engineering Geology*, Bulletin, No. 42, 1990, pp. 75-83.
Sano, Osam et al., "Acoustic Emission During Slow Crack Growth", *Department Mining and Mineral Engineering, NII-Electronic Library Service*, 1980, pp. 381-388.
Schormair, Nik et al., "The influence of anisotropy on hard rock drilling and cutting", *The Geological Society of London, IAEG*, Paper No. 491, 2006, pp. 1-11.
Shuja, S. Z. et al., "Laser heating of semi-infinite solid with consecutive pulses: Influence of materaial properties on temperature field", *Optics & Laser Technology*, vol. 40, 2008, pp. 472-480.
Smith, E., "Crack Propagation at a Constant Crack Tip Stress Intensity Factor", *Int. Journal of Fracture*, vol. 16, 1980, pp. R215-R218.
Solomon, A. D. et al., "Moving Boundary Problems in Phase Change Models Current Research Questions", *Engineering Physics and Mathematics Division*, ACM Signum Newsletter, vol. 20, Issue 2, 1985, pp. 8-12.
Sousa, Luis M. O. et al., "Influence of microfractures and porosity on the physico-mechanical properties and weathering of ornamental granites", *Engineering Geology*, vol. 77, 2005, pp. 153-168.
Stone, Charles M. et al., "Qualification of a Computer Program for Drill String Dynamics", *Sandia National Laboratories*, SAND-85-0633C, 1985, pp. 1-20.
Takarli, Mokhfi et al., "Damage in granite under heating/cooling cycles and water freeze-thaw condition", *International Journal of Rock Mechanics and Mining Sciences*, vol. 45, 2008, pp. 1164-1175.
Tanaka, K. et al., "The Generalized Relationship Between the Parameters C and *m* of Paris' Law for Fatigue Crack Growth", *Scripta Metallurgica*, vol. 15, No. 3, 1981, pp. 259-264.
Tang, C. A. et al., "Coupled analysis of flow, stress and damage (FSD) in rock failure", *International Journal of Rock Mechanics and Mining Sciences*, vol. 39, 2002, pp. 477-489.
Thorsteinsson, Hildigunnur et al., "The Impacts of Drilling and Reservoir Technology Advances on EGS Exploitation", *Proceedings, Thirty-Third Workshop on Geothermal Reservoir Engineering, Institute for Sustainable Energy, Environment, and Economy* (*ISEEE*), 2008, pp. 1-14.
U.S. Dept of Energy, "Chapter 6—Drilling Technology and Costs", from Report for the Future of Geothermal Energy, 2005, 53 pgs.
Varnado, S. G. et al., "The Design and Use of Polycrystalline Diamond Compact Drag Bits in the Geothermal Environment", *Society of Petroleum Engineers of AIME*, SPE 8378, 1979, pp. 1-11.
Wen-gui, Cao et al., "Damage constituitive model for strain-softening rock based on normal distribution and its parameter determination", *J. Cent. South Univ. Technol.*, vol. 14, No. 5, 2007, pp. 719-724.
Wiercigroch, M., "Dynamics of ultrasonic percussive drilling of hard rocks", *Journal of Sound and Vibration*, vol. 280, 2005, pp. 739-757.
Williams, R. E. et al., "Experiments in Thermal Spallation of Various Rocks", *Transactions of the ASME*, vol. 118, 1996, pp. 2-8.
Willis, David A. et al., "Heat transfer and phase change during picosecond laser ablation of nickel", *International Journal of Heat and Mass Transfer*, vol. 45, 2002, pp. 3911-3918.
Wong, Teng-fong et al., "Microcrack statistics, Weibull distribution and micromechanical modeling of compressive failure in rock", *Mechanics of Materials*, vol. 38, 2006, pp. 664-681.
Wood, Tom, "Dual Purpose COTD™ Rigs Establish New Operational Records", *Treme Coil Drilling Corp., Drilling Technology Without Borders*, 2009, pp. 1-18.
Xia, K. et al., "Effects of microstructures on dynamic compression of Barre granite", *International Journal of Rock Mechanics and Mining Sciences*, vol. 45, 2008. pp. 879-887, available at: www.sciencedirect.com.
Xu, Zhiyue et al., "Laser Spallation of Rocks for Oil Well Drilling", *Proceedings of the 23rd International Congress on Applications of Lasers and Electro-Optics*, 2004, pp. 1-6.
Xu, Z et al. "Modeling of Laser Spallation Drilling of Rocks fro gas- and Oilwell Drilling", *Society of Petroleum Engineers*, SPE 95746, 2005, pp. 1-6.
Xu, Z. et al., "Specific Energy for Laser Removal of Rocks", *Proceedings of the 20th International Congress on Applications of Lasers & Electro-Optics*, 2001, pp. 1-8.
Xu, Z. et al., "Specific energy for pulsed laser rock drilling", *Journal of Laser Applications*, vol. 15, No. 1, 2003, pp. 25-30.
Yamshchikov, V. S. et al., "An Evaluation of the Microcrack Density of Rocks by Ultrasonic Velocimetric Method", *Moscow Mining Institute*. (*Translated from Fiziko-Tekhnicheskie Problemy Razrabotki Poleznykh Iskopaemykh*), 1985, pp. 363-366.
Yilbas, B. S. et al., "Laser short pulse heating: Influence of pulse intensity on temperature and stress fields", *Applied Surface Science*, vol. 252, 2006, pp. 8428-8437.
Yilbas, B. S. et al., "Laser treatment of aluminum surface: Analysis of thermal stress field in the irradiated región", *Journal of Materials Processing Technology*, vol. 209, 2009, pp. 77-88.
Yilbas, B. S. et al., "Nano-second laser pulse heating and assisting gas jet considerations", *International Journal of Machine Tools & Manufacture*, vol. 40, 2000, pp. 1023-1038.
Yilbas, B. S. et al., "Repetitive laser pulse heating with a convective boundary condition at the surface", *Journal of Physics D: Applied Physics*, vol. 34, 2001, pp. 222-231.
Yun, Yingwei et al., "Thermal Stress Distribution in Thick Wall Cylinder Under Thermal Shock", *Journal of Pressure Vessel Technology, Transactions of the ASME*, 2009, vol. 131, pp. 1-6.
Zeuch, D.H. et al., "Rock Breakage Mechanism Wirt a PDC Cutter", *Society of Petroleum Engineers, 60th Annual Technical Conference*, Las Vegas, Sep. 22-25, 1985, 11 pgs.
Zhai, Yue et al., "Dynamic failure analysis on granite under uniaxial impact compressive load", *Front. Archit. Civ. Eng. China*, vol. 2, No. 3, 2008, pp. 253-260.
Zhou, X.P., "Microcrack Interaction Brittle Rock Subjected to Uniaxial Tensile Loads", *Theoretical and Applied Fracture Mechanics*, vol. 47, 2007, pp. 68-76.
Zhou, Zehua et al., "A New Thermal-Shock-Resistance Model for Ceramics: Establishment and validation", *Materials Science and Engineering*, A 405, 2005, pp. 272-276.
Zhu, Dongming et al., "Influence of High Cycle Thermal Loads on Thermal Fatigue Behavior of Thick Thermal Barrier Coatings", *National Aeronautics and Space Administration, Army Research Laboratory*, Technical Report ARL-TR-1341, NASA TP-3676, 1997, pp. 1-50.
Zhu, Dongming et al., "Investigation of thermal fatigue behavior of thermal barrier coating systems", *Surface and Coatings Technology*, vol. 94-95, 1997, pp. 94-101.
Zhu, Dongming et al., "Investigation of Thermal High Cycle and Low Cycle Fatigue Mechanisms of Thick Thermal Barrier Coatings", *National Aeronautics and Space Administration, Lewis Research Center*, NASA/TM-1998-206633, 1998, pp. 1-31.
Zhu, Dongming et al., "Thermophysical and Thermomechanical Properties of Thermal Barrier Coating Systems", *National Aeronautics and Space Administration, Glenn Research Center*, NASA/TM-2000-210237, 2000, pp. 1-22.
International Search Report for PCT Application No. PCT/US09/54295, dated Apr. 26, 2010, 16 pgs. Brochures.
A Built-for-Purpose Coiled Tubing Rig, by Schulumberger Wells,No. DE-PS26-03NT15474, 2006, 1 pg.

(56) References Cited

OTHER PUBLICATIONS

Diamond-Cutter Drill Bits, by Geothermal Energy Program, Office of Geothermal and Wind Technologies, 2000, 2 pgs.
Extreme Coil Drilling, by Extreme Drilling Corporation, 2009, 10 pgs.
IADC Dull Grading System for Fixed Cutter Bits, by Hughes Christensen, 1996, 14 pgs.
Percussion Drilling Manual, by Smith Tools, 2002, 67 pgs.
Simple Drilling Methods, WEDC Loughborough University, United Kingdom, 1995, 4 pgs.
International Search Report and Written Opinion for PCT App. No. PCT/US10/24368, dated Nov. 2, 2010, 16 pgs.
Lally, Evan M., "A Narrow-Linewidth Laser at 1550 nm Using the Pound-Drever-Hall Stabilization Technique", *Thesis*, submitted to Virginia Polytechnic Institute and State University, Blacksburg, Virginia, 2006, 92 pgs.
McElhenny, John E. et al., "Unique Characteristic Features of Stimulated Brillouin Scattering in Small-Core Photonic Crystal Fibers", *J. Opt. Soc. Am. B*, vol. 25, No. 4, 2008, pp. 582-593.
Mocofanescu, A. et al., "SBS threshold for single mode and multimode GRIN fibers in an all fiber configuration", *Optics Express*, vol. 13, No. 6, 2005, pp. 2019-2024.
Shannon, G. J. et al., "High power laser welding in hyperbaric gas and water environments", *Journal of Laser Applications*, vol. 9, 1997, pp. 129-136.
Labuz, J. F. et al., "Experiments with Rock: Remarks on Strength and Stability Issues", *International Journal of Rock Mechanics & Mining Science*, vol. 44, 2007, pp. 525-537.
Labuz, J. F. et al., "Size Effects in Fracture of Rock", *Rock Mechanics for Industry*, Amadei, Kranz, Scott & Smeallie (eds), 1999, pp. 1137-1143.
Langeveld, C. J., "PDC Bit Dynamics", a paper prepared for presentation at the 1992 IADC/SPE Drilling Conference, Feb. 1992, pp. 227-241.
Lee, S. H. et al., "Themo-Poroelastic Analysis of Injection-Induced Rock Deformation and Damage Evolution", *Proceedings Thirty-Fifth Workshop on Geothermal Reservoir Engineering*, Feb. 2010, 9 pages.
Lee, Y. W. et al., "High-Power Yb3+ Doped Phosphate Fiber Amplifier", *IEEE Journal of Selected Topics in Quantum Electronics*, vol. 15, No. 1, Jan./Feb. 2009, pp. 93-102.
Legarth, B. et al., "Hydraulic Fracturing in a Sedimentary Geothermal Reservoir: Results and Implications", *International Journal of Rock Mechanics & Mining Sciences*, vol. 42 , 2005, pp. 1028-1041.
Lehnhoff, T. F. et al., "The Influence of Temperature Dependent Properties on Thermal Rock Fragmentation", *Int. J. Rock Mech. Min. Sci. & Geomech. Abstr.*, vol. 12, 1975, pp. 255-260.
Leong, K. H., "Modeling Laser Beam-Rock Interaction", a report prepared for US Department of Energy (http://www.doe.gov/bridge), while publication date is unknown, it is believed to be prior to Jul. 21, 2010, 8 pages including pp. 1-6.
Li, Q. et al., "Experimental Research on Crack Propagation and Failure in Rock-type Materials under Compression", *EJGE*, vol. 13, Bund. D, 2008, p. 1-13.
Li, X. B. et al., "Experimental Investigation in the Breakage of Hard Rock by the PDC Cutters with Combined Action Modes", *Tunnelling and Underground Space Technology*, vol. 16, 2001, pp. 107-114.
Liddle, D. et al., "Cross Sector Decommissioning Workshop", presentation, Mar. 23, 2011, 14 pages.
Lindholm, U. S. et al., "The Dynamic Strength and Fracture Properties of Dresser Basalt", *Int. J. Rock Mech. Min. Sci. & Geomech. Abstr.*, vol. 11, 1974, pp. 181-191.
Loland, K. E., "Continuous Damage Model for Load-Response Estimation of Concrete", *Cement and Concrete Research*, vol. 10, 1980, pp. 395-402.
Lorenzana, H. E. et al., "Metastability of Molecular Phases of Nitrogen: Implications to the Phase Diagram", a manuscript submitted to the European Hight Pressure Research Group 39 Conference, *Advances on High Pressure*, Sep. 21, 2001, 18 pages.
Lubarda, V. A. et al., "Damage Model for Brittle Elastic Solids with Unequal Tensile and Compressive Strengths", *Engineering Fracture Mechanics*, vol. 29, No. 5, 1994, pp. 681-692.
Lucia, F. J. et al., "Characterization of Diagenetically Altered Carbonate Reservoirs, South Cowden Grayburg Reservoir, West Texas", a paper prepared for presentation at the 1996 SPE Annual Technical Conference and Exhibition, Oct. 1996, pp. 883-893.
Luffel, D. L. et al., "Travis Peak Core Permeability and Porosity Relationships at Reservoir Stress", *SPE Formation Evaluation*, Sep. 1991, pp. 310-318.
Luft, H. B. et al., "Development and Operation of a New Insulated Concentric Coiled Tubing String for Continuous Steam Injection in Heavy Oil Production", Conference Paper published by Society of Petroleum Engineers on the Internet at: (http://www.onepetro.org/mslib/servlet/onepetropreview?id=00030322), on Aug. 8, 2012, 1 page.
Lund, M. et al., "Specific Ion Binding to Macromolecules: Effect of Hydrophobicity and Ion Pairing", *Langmuir*, 2008 vol. 24, 2008, pp. 3387-3391.
Manrique, E. J. et al., "EOR Field Experiences in Carbonate Reservoirs in the United States", *SPE Reservoir Evaluation & Engineering*, Dec. 2007, pp. 667-686.
Maqsood, A. et al., "Thermophysical Properties of Porous Sandstones: Measurement and Comparative Study of Some Representative Thermal Conductivity Models", *International Journal of Thermophysics*, vol. 26, No. 5, Sep. 2005, pp. 1617-1632.
Marcuse, D., "Curvature Loss Formula for Optical Fibers", *J. Opt. Soc. Am.*, vol. 66, No. 3, 1976, pp. 216-220.
Martin, C. D., "Seventeenth Canadian Geotechnical Colloquium: The Effect of Cohesion Loss and Stress Path on Brittle Rock Strength", *Canadian Geotechnical Journal*, vol. 34, 1997, pp. 698-725.
Martins, A. et al., "Modeling of Bend Losses in Single-Mode Optical Fibers", Institutu de Telecomunicacoes, Portugal, while the date of publication is unknown, it is believed to be prior to Aug. 19, 2009, 3 pages.
Maurer, W. C. et al., "Laboratory Testing of High-Pressure, High-Speed PDC Bits", a paper prepared for presentation at the 61st Annual Technical Conference and Exhibition of the Society of Petroleum Engineers, Oct. 1986, pp. 1-8.
McKenna, T. E. et al., "Thermal Conductivity of Wilcox and Frio Sandstones in South Texas (Gulf of Mexico Basin)", *AAPG Bulletin*, vol. 80, No. 8, Aug. 1996, pp. 1203-1215.
Meister, S. et al., "Glass Fibers for Stimulated Brillouin Scattering and Phase Conjugation", *Laser and Particle Beams*, vol. 25, 2007, pp. 15-21.
Mejia-Rodriguez, G. et al., "Multi-Scale Material Modeling of Fracture and Crack Propagation", Final Project Report in Multi-Scale Methods in Applied Mathematics, while the date of the publication is unknown, it is believed to be prior to Aug. 19, 2009, pp. 1-9.
Mensa-Wilmot, G. et al., "New PDC Bit Technology, Improved Drillability Analysis, and Operational Practices Improve Drilling Performance in Hard and Highly Heterogeneous Applications", a paper prepared for the 2004 SPE (Society of Petroleum Engineers) Eastern Regional Meeting, Sep. 2004, pp. 1-14.
Messica, A. et al., "Theory of Fiber-Optic Evanescent-Wave Spectroscopy and Sensor", *Applied Optics*, vol. 35, No. 13, May 1, 1996, pp. 2274-2284.
Mills, W. R. et al., "Pulsed Neutron Porosity Logging", SPWLA Twenty-Ninth Annual Logging Symposium, Jun. 1988, pp. 1-21.
Mirkovich, V. V., "Experimental Study Relating Thermal Conductivity to Thermal Piercing of Rocks", *Int. J. Rock Mech. Min. Sci.*, vol. 5, 1968, pp. 205-218.
Mittelstaedt, E. et al., "A Noninvasive Method for Measuring the Velocity of Diffuse Hydrothermal Flow by Tracking Moving Refractive Index Anomalies", *Geochemistry Geophysics Geosystems*, vol. 11, No. 10, Oct. 8, 2010, pp. 1-18.
Moavenzadeh, F. et al., "Thin Disk Technique for Analyzing Fock Fractures Induced by Laser Irradiation", a report prepared for the US Department of Transportation under Contract C-85-65, May 1968, 91 pages.

(56) References Cited

OTHER PUBLICATIONS

Montross, C. S. et al., "Laser-Induced Shock Wave Generation and Shock Wave Enhancement in Basalt", *International Journal of Rock Mechanics and Mining Sciences*, 1999, pp. 849-855.
Morozumi, Y. et al., "Growth and Structures of Surface Disturbances of a Round Liquid Jet in a Coaxial Airflow", *Fluid Dynamics Research*, vol. 34, 2004, pp. 217-231.
Morse, J. W. et al., "Experimental and Analytic Studies to Model Reaction Kinetics and Mass Transport of Carbon Dioxide Sequestration in Depleted Carbonate Reservoirs", a Final Scientific/Technical Report for DOE, while the date of the publication is unknown, it is believed to be prior to Aug. 19, 2009, 158 pages.
Moshier, S. O., "Microporosity in Micritic Limestones: A Review", *Sedimentary Geology*, vol. 63, 1989, pp. 191-213.
Mostafa, M. S. et al., "Investigation of Thermal Properties of Some Basalt Samples in Egypt", *Journal of Thermal Analysis and Calorimetry*, vol. 75, 2004, pp. 178-188.
Mukhin, I. B. et al., "Experimental Study of Kilowatt-Average-Power Faraday Isolators", OSA/ASSP, 2007, 3 pages.
Multari, R. A. et al., "Effect of Sampling Geometry on Elemental Emissions in Laser-Induced Breakdown Spectroscopy", *Applied Spectroscopy*, vol. 50, No. 12, 1996, pp. 1483-1499.
Munro, R. G., "Effective Medium Theory of the Porosity Dependence of Bulk Moduli", *Communications of American Ceramic Society*, vol. 84, No. 5, 2001, pp. 1190-1192.
Murphy, H. D., "Thermal Stress Cracking and Enhancement of Heat Extraction from Fractured Geothermal Reservoirs", a paper submitted to the Geothermal Resource Council for its 1978 Annual Meeting, Jul. 1978, 7 pages.
Murrell, S. A. F. et al., "The Effect of Temperature on the Strength at High Confining Pressure of Granodiorite Containing Free and Chemically-Bound Water", *Mineralogy and Petrology*, vol. 55, 1976, pp. 317-330.
Myung, I. J., "Tutorial on Maximum Likelihood Estimation", *Journal of Mathematical Psychology*, vol. 47, 2003, pp. 90-100.
Nakano, A. et al., "Visualization for Heat and Mass Transport Phenomena in Supercritical Artificial Air", *Cryogenics*, vol. 45, 2005, pp. 557-565.
Nara, Y. et al., "Study of Subcritical Crack Growth in Andesite Using the Double Torsion Test", *International Journal of Rock Mechanics & Mining Sciences*, vol. 42, 2005, pp. 521-530.
Nicklaus, K. et al., "Optical Isolator for Unpolarized Laser Radiation at Multi-Kilowatt Average Power", *Optical Society of America*, 2005, 3 pages.
Nikles, M. et al., "Brillouin Gain Spectrum Characterization in Single-Mode Optical Fibers", *Journal of Lightwave Technology*, vol. 15, No. 10, Oct. 1997, pp. 1842-1851.
Nilsen, B. et al., "Recent Developments in Site Investigation and Testing for Hard Rock TBM Projects", *1999 RETC Proceedings*, 1999, pp. 715-731.
Nimick, F. B., "Empirical Relationships Between Porosity and the Mechanical Properties of Tuff", *Key Questions in Rock Mechanics*, Cundall et al. (eds), 1988, pp. 741-742.
Nolen-Hoeksema, R., "Fracture Development and Mechnical Stratigraphy of Austin Chalk, Texas: Discussion", a discussion for the American Association of Petroleum Geologists Bulletin, vol. 73, No. 6, Jun. 1989, pp. 792-793.
Oglesby, K. et al., "Advanced Ultra High Speed Motor for Drilling", a project update by Impact Technologies LLC for the US Department of Energy, Sep. 12, 2005, 36 pages.
Olsen, F. O., "Fundamental Mechanisms of Cutting Front Formation in Laser Cutting", *SPIE*, vol. 2207, while publication date is unknown, it is believed to be prior to Jul. 21, 2010, pp. 402-413.
Ouyang, L. B. et al., "General Single Phase Wellbore Flow Model", a report prepared for the US COE/PETC, May 2, 1997, 51 pages.
Palchaev, D. K. et al., "Thermal Expansion of Silicon Carbide Materials", *Journal of Engineering Physics and Thermophysics*, vol. 66, No. 6, 1994, 3 pages.
Parker, R. et al., "Drilling Large Diameter Holes in Rocks Using Multiple Laser Beams (504)", while the date of the publication is unknown, it is believed to be prior to Aug. 19, 2009, 6 pages.
Patricio, M. et al., "Crack Propagation Analysis", while the date of the publication is unknown, it is believed to be prior to Aug. 19, 2009, 24 pages.
Peebler, R. P. et al., "Formation Evaluation with Logs in the Deep Anadarko Basin", *SPE of AIME*, 1972, 15 pages.
Pepper, D. W. et al., "Benchmarking Comsol Multiphysics 3.5a—CFD Problems", a presentation, Oct. 10, 2009, 54 pages.
Pettitt, R. et al., "Evolution of a Hybrid Roller Cone/PDC Core Bit", a paper prepared for Geothermal Resources Council 1980 Annual Meeting, Sep. 1980, 7 pages.
Phani, K. K. et al., "Porosity Dependence of Ultrasonic Velocity and Elastic Modulus in Sintered Uranium Dioxide—a discussion", *Journal of Materials Science Letters*, vol. 5, 1986, pp. 427-430.
Plinninger, R. J. et al., "Wear Prediction in Hardrock Excavation Using the CERCHAR Abrasiveness Index (CAI)", EUROCK 2004 & 53rd Geomechanics Colloquium, 2004, 6 pages.
Plumb, R. A. et al., "Influence of Composition and Texture on Compressive Strength Variations in the Travis Peak Formation", a paper prepared for presentation at the 67th Annual Technical Conference and Exhibition of the Society of Petroleum Engineers, Oct. 1992, pp. 985-998.
Pooniwala, S. et al., "Lasers: The Next Bit", a paper prepared for the presentation at the 2006 SPE (Society of Petroleum Engineers) Eastern Regional Meeting, Oct. 2006, pp. 1-10.
Porter, J. A. et al., "Cutting Thin Sheet Metal with a Water Jet Guided Laser Using Various Cutting Distances, Feed Speeds and Angles of Incidence", *Int. J. Adv. Manuf. Technol.*, vol. 33, 2007, pp. 961-967.
Potyondy, D., "Internal Technical Memorandum—Molecular Dynamics with PFC", a Technical Memorandum to PFC Development Files and Itasca Website, *Molecular Dynamics with PFC*, Jan. 6, 2010, 35 pages.
Potyondy, D. O., "Simulating Stress Corrosion with a Bonded-Particle Model for Rock", *International Journal of Rock Mechanics & Mining Sciences*, vol. 44, 2007, pp. 677-691.
Powell, M. et al., "Optimization of UHP Waterjet Cutting Head, The Orifice", Flow International, while the date of the publication is unknown, it is believed to be prior to Aug. 19, 2009, 19 pages.
Price, R. H. et al., "Analysis of the Elastic and Strength Properties of Yuccs Mountain tuff, Nevada", 26th US Symposium on Rock Mechanics, Jun. 1985, pp. 89-96.
Quinn, R. D. et al., "A Method for Calculating Transient Surface Temperatures and Surface Heating Rates for High-Speed Aircraft", NASA, Dec. 2000, 35 pages.
Ramadan, K. et al., "On the Analysis of Short-Pulse Laser Heating of Metals Using the Dual Phase Lag Heat Conduction Model", *Journal of Heat Transfer*, vol. 131, Nov. 2009, pp. 111301-1 to 111301-7.
Rao, M. V. M. S. et al., "A Study of Progressive Failure of Rock Under Cyclic Loading by Ultrasonic and AE Monitoring Techniques", *Rock Mechanics and Rock Engineering*, vol. 25, No. 4, 1992, pp. 237-251.
Rauenzahn, R. M., "Analysis of Rock Mechanics and Gas Dynamics of Flame-Jet Thermal Spallation Drilling", a dissertation for the degree of Doctor of Philosophy at Massachusettes Institute of Technology, Sep. 1986, pp. 1-524.
Rauenzahn, R. M. et al., "Rock Failure Mechanisms of Flame-Jet Thermal Spallation Drilling—Theory and Experimental Testing", *Int. J. Rock Mech. Min. Sci. & Geomech. Abstr.*, vol. 26, No. 5, 1989, pp. 381-399.
Ravishankar, M. K., "Some Results on Search Complexity vs Accuracy", DARPA Spoken Systems Technology Workshop, Feb. 1997, 4 pages.
Ream, S. et al., "Zinc Sulfide Optics for High Power Laser Applications", Paper 1609, while the date of the publication is unknown, it is believed to be prior to Aug. 19, 2009, 7 pages.
Rice, J. R., "On the Stability of Dilatant Hardening for Saturated Rock Masses", *Journal of Geophysical Research*, vol. 80, No. 11, Apr. 10, 1975, pp. 1531-1536.
Richter, D. et al., "Thermal Expansion Behavior of Igneous Rocks", *Int. J. Rock Mech. Min. Sci. & Geomech. Abstr.*, vol. 11, 1974, pp. 403-411.

(56) References Cited

OTHER PUBLICATIONS

Rietman, N. D. et al., "Comparative Economics of Deep Drilling in Anadarka Basin", a paper presented at the 1979 Society of Petroleum Engineers of AIME Deep Drilling and Production Symposium, Apr. 1979, 5 pages.
Rijken, P. et al., "Predicting Fracture Attributes in the Travis Peak Formation Using Quantitative Mechanical Modeling and Stractural Diagenesis", Gulf Coast Association of Geological Societies Transactions vol. 52, 2002, pp. 837-847.
Rijken, P. et al., "Role of Shale Thickness on Vertical Connectivity of Fractures: Application of Crack-Bridging Theory to the Austin Chalk, Texas", *Tectonophysics*, vol. 337, 2001, pp. 117-133.
Author unknown, by RIO Technical Services, "Sub-Task 1: Current Capabilities of Hydraulic Motors, Air/Nitrogen Motors, and Electric Downhole Motors", a final report for Department of Energy National Petroleum Technology Office for the Contract Task 03NT30429, Jan. 30, 2004, 26 pages.
Rosler, M., "Generalized Hermite Polynomials and the Heat Equation for Dunkl Operators", a paper, while the date of the publication is unknown, it is believed to be prior to Aug. 19, 2009, pp. 1-24.
Rossmanith, H. P. et al., "Fracture Mechanics Applications to Drilling and Blasting", *Fatigue & Fracture Engineering Materials & Structures*, vol. 20, No. 11, 1997, pp. 1617-1636.
Rubin, A. M. et al., "Dynamic Tensile-Failure-Induced Velocity Deficits in Rock", *Geophysical Research Letters*, vol. 18, No. 2, Feb. 1991, pp. 219-222.
Salehi, I. A. et al., "Laser Drilling—Drilling with the Power Light", a final report a contract with DOE with award No. DE-FC26-00NT40917, May 2007, in parts 1-4 totaling 318 pages.
Sandler, I. S. et al., "An Algorithm and a Modular Subroutine for the Cap Model", *International Journal for Numerical and Analytical Methods in Geomechanics*, vol. 3, 1979, pp. 173-186.
Santarelli, F. J. et al., "Formation Evaluation From Logging on Cuttings", *SPE Reservoir Evaluation & Engineering*, Jun. 1998, pp. 238-244.
Sattler, A. R., "Core Analysis in a Low Permeability Sandstone Reservoir: Results from the Multiwell Experiment", a report by Sandia National Laboratories for the US Department of Energy, Apr. 1989, 69 pages.
Scaggs, M. et al., "Thermal Lensing Compensation Objective for High Power Lasers", published by Haas Lasers Technologies, Inc., while the date of the publication is unknown, it is believed to be prior to Aug. 19, 2009, 7 pages.
Schaff, D. P. et al., "Waveform Cross-Correlation-Based Differential Travel-Time Measurements at the Northern California Seismic Network", *Bulletin of the Seismological Society of America*, vol. 95, No. 6, Dec. 2005, pp. 2446-2461.
Schaffer, C. B. et al., "Dynamics of Femtosecond Laser-Induced Breakdown in Water from Femtoseconds to Microseconds", *Optics Express*, vol. 10, No. 3, Feb. 11, 2002, pp. 196-203.
Scholz, C. H., "Microfracturing of Rock in Compression", a dissertation for the degree of Doctor of Philosophy at Massachusettes Instutute of Trechnology, Sep. 1967, 177 pages.
Schroeder, R. J. et al., "High Pressure and Temperature Sensing for the Oil Industry Using Fiber Bragg Gratings Written onto Side Hole Single Mode Fiber", publisher unknown, while the date of the publication is unknown, it is believed to be prior to Aug. 19, 2009, 4 pages.
Shiraki, K. et al., "SBS Threshold of a Fiber with a Brillouin Frequency Shift Distribution", *Journal of Lightwave Technology*, vol. 14, No. 1, Jan. 1996, pp. 50-57.
Singh, T. N. et al., "Prediction of Thermal Conductivity of Rock Through Physico-Mechanical Properties", *Building and Environment*, vol. 42, 2007, pp. 146-155.
Sinha, D., "Cantilever Drilling—Ushering a New Genre of Drilling", a paper prepared for presentation at the SPE/IADC Middle East Drilling Technology Conference and Exhibition, Oct. 2003, 6 pages.
Sinor, A. et al., "Drag Bit Wear Model", *SPE Drilling Engineering*, Jun. 1989, pp. 128-136.
Smith, D., "Using Coupling Variables to Solve Compressible Flow, Multiphase Flow and Plasma Processing Problems", Comsol Users Conference 2006, Nov. 1, 2006, 38 pages.
Sneider, RM et al., "Rock Types, Depositional History, and Diangenetic Effects, Ivishak reservoir Prudhoe Bay Field", *SPE Reservoir Engineering*, Feb. 1997, pp. 23-30.
Soeder, D. J. et al., "Pore Geometry in High- and Low-Permeability Sandstones, Travis Peak Formation, East Texas", *SPE Formation Evaluation*, Dec. 1990, pp. 421-430.
Somerton, W. H. et al., "Thermal Expansion of Fluid Saturated Rocks Under Stress", SPWLA Twenty-Second Annual Logging Symposium, Jun. 1981, pp. 1-8.
Sousa, L. M. O. et al., "Influence of Microfractures and Porosity on the Physico-Mechanical Properties and Weathering of Ornamental Granites", *Engineering Geology*, vol. 77, 2005, pp. 153-168.
Stowell, J. F. W., "Characterization of Opening-Mode Fracture Systems in the Austin Chalk", *Gulf Coast Association of Geological Societies Transactions*, vol. L1, 2001, pp. 313-320.
Straka, W. A. et al., "Cavitation Inception in Quiescent and Co-Flow Nozzle Jets", 9th International Conference on Hydrodynamics, Oct. 2010, pp. 813-819.
Suarez, M. C. et al., "Comsol in a New Tensorial Formulation of Non-Isothermal Poroelasticity", publisher unknown, while the date of the publication is unknown, it is believed to be prior to Aug. 19, 2009,2 pages.
Summers, D. A., "Water Jet Cutting Related to Jet & Rock Properties", publisher unknown, while the date of the publication is unknown, it is believed to be prior to Aug. 19, 2009, 13 pages.
Suwarno, et al., "Dielectric Properties of Mixtures Between Mineral Oil and Natural Ester from Palm Oil", *WSEAS Transactions on Power Systems*, vol. 3, Issue 2, Feb. 2008, pp. 37-46.
Tang, C. A. et al., "Numerical Studies of the Influence of Microstructure on Rock Failure in Uniaxial Compression—Park I: Effect of Heterogeneity", *International Journal of Rock Mechanics and Mining Sciences*, vol. 37, 2000, pp. 555-569.
Tao, Q. et al., "A Chemo-Poro-Thermoelastic Model for Stress/Pore Pressure Analysis around a Wellbore in Shale", a paper prepared for presentation at the US Symposium on Rock Mechanics (USRMS): *Rock Mechanics for Energy*, Mineral and Infrastracture Development in the Northern Regions, Jun. 2005, 7 pages.
Terra, O. et al., "Brillouin Amplification in Phase Coherent Transfer of Optical Frequencies over 480 km Fiber", publisher unknown, while the date of the publication is unknown, it is believed to be prior to Aug. 19, 2009, 9 pages.
Terzopoulos, D. et al., "Modeling Inelastic Deformation: Viscoelasticity, Plasticity, Fracture", *SIGGRAPH '88*, Aug. 1988, pp. 269-278.
Thomas, R. P., "Heat Flow Mapping at the Geysers Geothermal Field", published by the California Department of Conservation Division of Oil and Gas, 1986, 56 pages.
Thompson, G. D., "Effects of Formation Compressive Strength on Perforator Performance", a paper presented of the Southern District API Division of Production, Mar. 1962, pp. 191-197.
Tovo, R. et al., "Fatigue Damage Evaluation on Mechanical Components Under Multiaxial Loadings", excerpt from the Proceedings of the Comsol Conference, 2009, 8 pages.
Tuler, F. R. et al., "A Criterion for the Time Dependence of Dynamic Fracture", *The International Journal of Fracture Mechanics*, vol. 4, No. 4, Dec. 1968, pp. 431-437.
Turner, D. et al., "New DC Motor for Downhole Drilling and Pumping Applications", a paper prepared for presentation at the SPE/ICoTA Coiled Tubing Roundtable, Mar. 2001, pp. 1-7.
Turner, D. R. et al., "The All Electric BHA: Recent Developments Toward an Intelligent Coiled-Tubing Drilling System", a paper prepared for presentation at the 1999 SPE/ICoTA Coiled Tubing Roundtable, May 1999, pp. 1-10.
Tutuncu, A. N. et al., "An Experimental Investigation of Factors Influencing Compressional- and Shear-Wave Velocities and Attenuations in Tight Gas Sandstones", *Geophysics*, vol. 59, No. 1, Jan. 1994, pp. 77-86.

(56) References Cited

OTHER PUBLICATIONS

Udd, E. et al., "Fiber Optic Distributed Sensing Systems for Harsh Aerospace Environments", publisher unknown, while the date of the publication is unknown, it is believed to be prior to Aug. 19, 2009, 12 pages.
Valsangkar, A. J. et al., Stress-Strain Relationship for Empirical Equations of Creep in Rocks, *Engineering Geology*, Mar. 29, 1971, 5 pages.
Wagh, A. S. et al., "Dependence of Ceramic Fracture Properties on Porosity", *Journal of Material Sience*, vol. 28, 1993, pp. 3589-3593.
Wagner, F. et al., "The Laser Microjet Technology—10 Years of Development (M401)", publisher unknown, while the date of the publication is unknown, it is believed to be prior to Aug. 19, 2009, 9 pages.
Waldron, K. et al., "The Microstructures of Perthitic Alkali Feldspars Revealed by Hydroflouric Acid Etching", *Contributions to Mineralogy and Petrology*, vol. 116, 1994, pp. 360-364.
Walker, B. H. et al., "Roller-Bit Penetration Rate Response as a Function of Rock Properties and Well Depth", a paper prepared for presentation at the 61st Annual Technical Conference and Exhibition of the Society of Petroleum Engineers, Oct. 1986, 12 pages.
Wandera, C. et al., "Characterization of the Melt Removal Rate in Laser Cutting of Thick-Section Stainless Steel", *Journal of Laser Applications*, vol. 22, No. 2, May 2010, pp. 62-70.
Wandera, C. et al., "Inert Gas Cutting of Thick-Section Stainless Steel and Medium Section Aluminun Using a High Power Fiber Laser", *Journal of Chemical Physics*, vol. 116, No. 4, Jan. 22, 2002, pp. 154-161.
Wandera, C. et al., "Laser Power Requirement for Cutting of Thick-Section Steel and Effects of Processing Parameters on Mild Steel Cut Quality", a paper accepted for publication in the Proceedings IMechE Part B, *Journal of Engineering Manufacture*, vol. 225, 2011, 23 pages.
Wandera, C. et al., "Optimization of Parameters for Fiber Laser Cutting of 10mm Stainless Steel Plate", a paper for publication in the Proceeding IMechE Part B, *Journal of Engineering Manufacture*, vol. 225, 2011, 22 pages.
Wandera, C., "Performance of High Power Fibre Laser Cutting of Thick-Section Steel and Medium-Section Aluminium", a thesis for the degree of Doctor of Science (Technology) at , Lappeenranta University of Technology, Oct. 2010, 74 pages.
Wang, C. H., "Introduction to Fractures Mechanics", published by DSTO Aeronautical and Maritime Research Laboratory, Jul. 1996, 82 pages.
Wang, G. et al., "Particle Modeling Simulation of Thermal Effects on Ore Breakage", *Computational Materials Science*, vol. 43, 2008, pp. 892-901.
Waples, D. W. et al., "A Review and Evaluation of Specific Heat Capacities of Rocks, Minerals, and Subsurface Fluids. Part 1: Minerals and Nonporous Rocks", *Natural Resources Research*, vol. 13, No. 2, Jun. 2004, pp. 97-122.
Waples, D. W. et al., "A Review and Evaluation of Specific Heat Capacities of Rocks, Minerals, and Subsurface Fluids. Part 2: Fluids and Porous Rocks", *Natural Resources Research*, vol. 13 No. 2, Jun. 2004, pp. 123-130.
Warren, T. M. et al., "Laboratory Drilling Performance of PDC Bits", *SPE Drilling Engineering*, Jun. 1988, pp. 125-135.
White, E. J. et al., "Reservoir Rock Characteristics of the Madison Limestone in the Williston Basin", *The Log Analyst*, Sep.-Oct. 1970, pp. 17-25.
White, E. J. et al., "Rock Matrix Properties of the Ratcliffe Interval (Madison Limestone) Flat Lake Field, Montana", *SPE of AIME*, Jun. 1968, 16 pages.
Wilkinson, M. A. et al., "Experimental Measurement of Surface Temperatures During Flame-Jet Induced Thermal Spallation", *Rock Mechanics and Rock Engineering*, 1993, pp. 29-62.
Winters, W. J. et al., "Roller Bit Model with Rock Ductility and Cone Offset", a paper prepared for presentation at 62nd Annual Technical Conference and Exhibition of the Society of Petroleum Engineers, Sep. 1987, 12 pages.
Wippich, M. et al., "Tunable Lasers and Fiber-Bragg-Grating Sensors", Obatined from the at: from the Internet website of the Industrial Physicist at: http://www.aip.org/tip/INPHFA/vol-9/iss-3/p24.html, on May 18, 2010, pp. 1-5.
Wu, X. Y. et al., "The Effects of Thermal Softening and Heat Conductin on the Dynamic Growth of Voids", *International Journal of Solids and Structures*, vol. 40, 2003, pp. 4461-4478.
Xiao, J. Q. et al., "Inverted S-Shaped Model for Nonlinear Fatigue Damage of Rock", *International Journal of Rock Mechanics & Mining Sciences*, vol. 46, 2009, pp. 643-648.
Xu, Z. et al., "Application of High Powered Lasers to Perforated Completions", *International Congress on Applications of Laser & Electro-Optics*, Oct. 2003, 6 pages.
Xu, Z. et al., "Laser Rock Drilling by a Super-Pulsed CO2 Laser Beam", a manuscript created for the US Department of Energy, while the date of the publication is unknown, it is believed to be prior to Aug. 19, 2009, 9 pages.
Xu, Z. et al., "Laser Spallation of Rocks for Oil Well Drilling", Proceedings of the 23rd International Congress on Applications of Lasers and Electro-Optics, 2004, pp. 1-6.
Xu, Z. et al., "Modeling of Laser Spallation Drilling of Rocks for Gas-and Oilwell Drilling", a paper prepared for the presentation at the 2005 SPE (Society of Petroleum Engineers) Annual Technical Conference and Exhibition, Oct. 2005, 6 pages.
Xu, Z. et al., "Rock Perforation by Pulsed Nd: YAG Laser", Proceedings of the 23rd International Congress on Applications of Lasers and Electro-Optics 2004, 5 pages.
Xu, Z. et al., "Specific Energy for Pulsed Laser Rock Drilling", *Journal of Laser Applications*, vol. 15, No. 1, Feb. 2003, pp. 25-30.
Yabe, T. et al., "The Constrained Interpolation Profile Method for Multiphase Analysis", *Journal of Computational Physics*, vol. 169, 2001, pp. 556-593.
Yamamoto, K. Y. et al., "Detection of Metals in the Environment Using a Portable Laser-Induced Breakdown Spectroscopy Instrument", *Applied Spectroscopy*, vol. 50, No. 2, 1996, pp. 222-233.
Yamashita, Y. et al., "Underwater Laser Welding by 4kW CW YAG Laser", *Journal of Nuclear Science and Technology*, vol. 38, No. 10, Oct. 2001, pp. 891-895.
Yasar, E. et al., "Determination of the Thermal Conductivity from Physico-Mechanical Properties", *Bull Eng. Geol. Environ.*, vol. 67, 2008, pp. 219-225.
York, J. L. et al., "The Influence of Flashing and Cavitation on Spray Formation", a progress report for UMRI Project 2815 with Delavan Manufacturing Company, Oct. 1959, 27 pages.
Zamora, M. et al., "An Empirical Relationship Between Thermal Conductivity and Elastic Wave Velocities in Sandstone", *Geophysical Research Letters*, vol. 20, No. 16, Aug. 20, 1993, pp. 1679-1682.
Zeng, Z. W. et al., "Experimental Determination of Geomechanical and Petrophysical Properties of Jackfork Sandstone—A Tight Gas Formation", a paper prepared for the presentation at the 6th North American Rock Mechanics Symposium (NARMS): *Rock Mechanics Across Borders and Disciplines*, Jun. 2004, 9 pages.
Zehnder, A. T., "Lecture Notes on Fracture Mechanics", 2007, 227 pages.
Zeuch, D. H. et al., "Rock Breakage Mechanisms With a PDC Cutter", a paper prepared for presentation at the 60th Annual Technical Conference and Exhibition of the Society of Petroleum Engineers, Sep. 1985, 12 pages.
Zhang, L. et al., "Energy from Abandoned Oil and Gas Reservoirs", a paper prepared for presentation at the 2008 SPE (Society of Petroleum Engineers) Asia Pacific Oil & Gas Conference and Exhibition, 2008, pp. 1-10.
Zheleznov, D. S. et al., "Faraday Rotators With Short Magneto-Optical Elements for 50-kW Laser Power", *IEEE Journal of Quantum Electronics*, vol. 43, No. 6, Jun. 2007, pp. 451-457.
Zhou, T. et al., "Analysis of Stimulated Brillouin Scattering in Multi-Mode Fiber by Numerical Solution", *Journal of Zhejiang University of Science*, vol. 4 No. 3, May-Jun. 2003, pp. 254-257.
Zhu, X. et al., "High-Power ZBLAN Glass Fiber Lasers: Review and Prospect", *Advances in OptoElectronics*, vol. 2010, pp. 1-23.
Zietz, J. et al., "Determinants of House Prices: A Quantile Regression Approach", *Department of Economics and Finance Working Paper Series*, May 2007, 27 pages.

(56) References Cited

OTHER PUBLICATIONS

Zuckerman, N. et al., "Jet Impingement Heat Transfer: Physics, Correlations, and Numerical Modeling", *Advances in Heat Transfer*, vol. 39, 2006, pp. 565-631.
Aptukov, V. N., "Two Stages of Spallation", publisher unknown, while the date of the publication is unknown, it is believed to be prior to Aug. 19, 2009, 6 pages.
Author known, "Heat Capacity Analysis", published by Bechtel SAIC Company LLC, a report prepared for US Department of Energy, Nov. 2004, 100 pages.
Author unknown, "Chapter 7: Energy Conversion Systems—Options and Issues", publisher ubknown, while the date of the publication is unknown, it is believed to be prior to Aug. 19, 2009, pp. 7-1 to 7-32 and table of contents page.
Author unknown, "Chapter I—Laser-Assisted Rock-Cutting Tests", publisher unknown, while the date of the publication is unknown, it is believed to be prior to Aug. 19, 2009, 64 pages.
Author unknown, "Cross Process Innovations", Obtained from the Internat at: http://www.mrl.columbia.edu/ntm/CrossProcess/CrossProcessSect5.htm, on Feb. 2, 2010, 11 pages.
Author unknown, "Fourier Series, Generalized Functions, Laplace Transform", publisher unknown, while the date of the publication is unknown, it is believed to be prior to Aug. 19, 2009, 6 pages.
Author unknown, "Silicone Fluids: Stable, Inert Media", published by Gelest, Inc., while the date of the publication is unknown, it is believed to be prior to Aug. 19, 2009, 27 pages.
Author unknown, "Introduction to Optical Liquids", Cargille-Sacher Laboratories Inc., Obtained from the Internet at: http://www.cargille.com/opticalintro.shtml, on Dec. 23, 2008, 5 pages.
Author unknown, "Laser Drilling", Oil & Natural Gas Projects (Exploration & Production Technologies) Technical Paper, Dept. of Energy, Jul. 2007, 3 pages.
Author unknown, "Leaders in Industry Luncheon", IPAA & TIPRO, Jul. 8, 2009, 19 pages.
Author unknown, "Measurement and Control of Abrasive Water-Jet Velocity", publisher unknown, while the date of the publication is unknown, it is believed to be prior to Aug. 19, 2009, 8 pages.
Author unknown, "Nonhomogeneous PDE—Heat Equation with a Forcing Term", a lecture, 2010, 6 pages.
Author unknown, "Performance Indicators for Geothermal Power Plants", prepared by International Geothermal Association for World Energy Council Working Group on Performance of Renewable Energy Plants, author unknown, Mar. 2011, 7 pages.
Author unknown, "Rock Mechanics and Rock Engineering", publisher unknown, while the date of the publication is unknown, it is believed to be prior to Aug. 19, 2009, 69 pages.
Author unknown, "Shock Tube Solved With Cosmol Multiphysics 3.5a", published by Cosmol Multiphysics, 2008, 5 pages.
Author unknown, "Stimulated Brillouin Scattering (SBS) in Optical Fibers", published by Centro de Pesquisa em Optica e Fotonica, Obtained from the Internet at: http://cepof.ifi.unicamp.br/index.php . . . ), on Jun. 25, 2012, 2 pages.
Author unknown, "Underwater Laser Cutting", published by TWI Ltd, May/Jun. 2011, 2 pages.
Office Action from JP Application No. 2011-523959 dated Aug. 27, 2013.
Office Action from JP Application No. 2011-551172 dated Sep. 17, 2013.

* cited by examiner

METHOD AND SYSTEM FOR ADVANCEMENT OF A BOREHOLE USING A HIGH POWER LASER

This application claims the benefit of priority of provisional applications: Ser. No. 61/090,384 filed Aug. 20, 2008, titled System and Methods for Borehole Drilling: Ser. No. 61/102,730 filed Oct. 3, 2008, titled Systems and Methods to Optically Pattern Rock to Chip Rock Formations; Ser. No. 61/106,472 filed Oct. 17, 2008, titled Transmission of High Optical Power Levels via Optical Fibers for Applications such as Rock Drilling and Power Transmission; and, Ser. No. 61/153,271 filed Feb. 17, 2009, title Method and Apparatus for an Armored High Power Optical Fiber for Providing Boreholes in the Earth, the disclosures of which are incorporated herein by reference.

This invention was made with Government support under Award DE-AR0000044awarded by the Office of ARPA-E U.S. Department of Energy. The Government has certain rights in this invention.

BACKGROUND OF THE INVENTION

The present invention relates to methods, apparatus and systems for delivering advancing boreholes using high power laser energy that is delivered over long distances, while maintaining the power of the laser energy to perform desired tasks. In a particular, the present invention relates to providing high power laser energy to create and advance a borehole in the earth and to perform other tasks in the borehole.

The present invention is useful with and may be employed in conjunction with the systems, apparatus and methods that are disclosed in greater detail in co-pending U.S. patent application Ser. No. 12/544,136 , titled Method and Apparatus for Delivering High Power Laser Energy Over Long Distances, U.S. patent application Ser. No. 12/544,038 , titled Apparatus for Advancing a Wellbore using High Power Laser Energy, U.S. patent application Ser. No. 12/544,094 , titled Methods and Apparatus for Delivering High Power Laser Energy to a Surface, and U.S. patent application Ser. No. 12/543,968, titled Methods and Apparatus for Removal and Control of Material in Laser Drilling of a Borehole, filed contemporaneously herewith, the disclosures of which are incorporate herein by reference in their entirety.

In general, boreholes have been formed in the earth's surface and the earth, i.e., the ground, to access resources that are located at and below the surface. Such resources would include hydrocarbons, such as oil and natural gas, water, and geothermal energy sources, including hydrothermal wells. Boreholes have also been formed in the ground to study, sample and explore materials and formations that are located below the surface. They have also been formed in the ground to create passageways for the placement of cables and other such items below the surface of the earth.

The term borehole includes any opening that is created in the ground that is substantially longer than it is wide, such as a well, a well bore, a well hole, and other terms commonly used or known in the art to define these types of narrow long passages in the earth. Although boreholes are generally oriented substantially vertically, they may also be oriented on an angle from vertical, to and including horizontal. Thus, using a level line as representing the horizontal orientation, a borehole can range in orientation from 0° i.e., a vertical borehole, to 90°, i.e., a horizontal borehole and greater than 90° e.g., such as a heel and toe. Boreholes may further have segments or sections that have different orientations, they may be arcuate, and they may be of the shapes commonly found when directional drilling is employed. Thus, as used herein unless expressly provided otherwise, the "bottom" of the borehole, the "bottom" surface of the borehole and similar terms refer to the end of the borehole, i.e., that portion of the borehole farthest along the path of the borehole from the borehole's opening, the surface of the earth, or the borehole's beginning.

Advancing a borehole means to increase the length of the borehole. Thus, by advancing a borehole, other than a horizontal one, the depth of the borehole is also increased. Boreholes are generally formed and advanced by using mechanical drilling equipment having a rotating drilling bit. The drilling bit is extending to and into the earth and rotated to create a hole in the earth. In general, to perform the drilling operation a diamond tip tool is used. That tool must be forced against the rock or earth to be cut with a sufficient force to exceed the shear strength of that material. Thus, in conventional drilling activity mechanical forces exceeding the shear strength of the rock or earth must be applied to that material. The material that is cut from the earth is generally known as cuttings, i.e., waste, which may be chips of rock, dust, rock fibers and other types of materials and structures that may be created by the thermal or mechanical interactions with the earth. These cuttings are typically removed from the borehole by the use of fluids, which fluids can be liquids, foams or gases.

In addition to advancing the borehole, other types of activities are performed in or related to forming a borehole, such as, work over and completion activities. These types of activities would include for example the cutting and perforating of casing and the removal of a well plug. Well casing, or casing, refers to the tubulars or other material that are used to line a wellbore. A well plug is a structure, or material that is placed in a borehole to fill and block the borehole. A well plug is intended to prevent or restrict materials from flowing in the borehole.

Typically, perforating, i.e., the perforation activity, involves the use of a perforating tool to create openings, e.g. windows, or a porosity in the casing and borehole to permit the sought after resource to flow into the borehole. Thus, perforating tools may use an explosive charge to create, or drive projectiles into the casing and the sides of the borehole to create such openings or porosities.

The above mentioned conventional ways to form and advance a borehole are referred to as mechanical techniques, or mechanical drilling techniques, because they require a mechanical interaction between the drilling equipment, e.g., the drill bit or perforation tool, and the earth or casing to transmit the force needed to cut the earth or casing.

It has been theorized that lasers could be adapted for use to form and advance a borehole. Thus, it has been theorized that laser energy from a laser source could be used to cut rock and earth through spalling, thermal dissociation, melting, vaporization and combinations of these phenomena. Melting involves the transition of rock and earth from a solid to a liquid state. Vaporization involves the transition of rock and earth from either a solid or liquid state to a gaseous state. Spalling involves the fragmentation of rock from localized heat induced stress effects. Thermal dissociation involves the breaking of chemical bonds at the molecular level.

To date it is believed that no one has succeeded in developing and implementing these laser drilling theories to provide an apparatus, method or system that can advance a borehole through the earth using a laser, or perform perforations in a well using a laser. Moreover, to date it is believed that no one has developed the parameters, and the equipment needed to meet those parameters, for the effective cutting and removal of rock and earth from the bottom of a borehole using a laser, nor has anyone developed the parameters and equipment need to meet those parameters for the effective perforation of a well using a laser. Further is it believed that no one has developed the parameters, equipment or methods need to advance a borehole deep into the earth, to depths exceeding about 300 ft (0.09 km), 500 ft (0.15 km), 1000 ft, (0.30 km), 3,280 ft (1 km), 9,840 ft (3 km) and 16,400 ft (5 km), using a laser. In particular, it is believed that no one has developed parameters, equipments, or methods nor implemented the delivery of high power laser energy, i.e., in excess of 1 kW or more to advance a borehole within the earth.

While mechanical drilling has advanced and is efficient in many types of geological formations, it is believed that a highly efficient means to create boreholes through harder geologic formations, such as basalt and granite has yet to be developed. Thus, the present invention provides solutions to this need by providing parameters, equipment and techniques for using a laser for advancing a borehole in a highly efficient manner through harder rock formations, such as basalt and granite.

The environment and great distances that are present inside of a borehole in the earth can be very harsh and demanding upon optical fibers, optics, and packaging. Thus, there is a need for methods and an apparatus for the deployment of optical fibers, optics, and packaging into a borehole, and in particular very deep boreholes, that will enable these and all associated components to withstand and resist the dirt, pressure and temperature present in the borehole and overcome or mitigate the power losses that occur when transmitting high power laser beams over long distances. The present inventions address these needs by providing a long distance high powered laser beam transmission means.

It has been desirable, but prior to the present invention believed to have never been obtained, to deliver a high power laser beam over a distance within a borehole greater than about 300 ft (0.09 km), about 500 ft (0.15 km), about 1000 ft, (0.30 km), about 3,280 ft (1 km), about 9,8430 ft (3 km) and about 16,400 ft (5 km) down an optical fiber in a borehole, to minimize the optical power losses due to non-linear phenomenon, and to enable the efficient delivery of high power at the end of the optical fiber. Thus, the efficient transmission of high power from point A to point B where the distance between point A and point B within a borehole is greater than about 1,640 ft (0.5 km) has long been desirable, but prior to the present invention is believed to have never been obtainable and specifically believed to have never been obtained in a borehole drilling activity.

A conventional drilling rig, which delivers power from the surface by mechanical means, must create a force on the rock that exceeds the shear strength of the rock being drilled. Although a laser has been shown to effectively spall and chip such hard rocks in the laboratory under laboratory conditions, and it has been theorized that a laser could cut such hard rocks at superior net rates than mechanical drilling, to date it is believed that no one has developed the apparatus systems or methods that would enable the delivery of the laser beam to the bottom of a borehole that is greater than about 1,640 ft (0.5 km) in depth with sufficient power to cut such hard rocks, let alone cut such hard rocks at rates that were equivalent to and faster than conventional mechanical drilling. It is believed that this failure of the art was a fundamental and long standing problem for which the present invention provides a solution.

Thus, the present invention addresses and provides solutions to these and other needs in the drilling arts by providing, among other things: spoiling the coherence of the Stimulated Brillioun Scattering (SBS) phenomenon, e.g. a bandwidth broadened laser source, such as an FM modulated laser or spectral beam combined laser sources, to suppress the SBS, which enables the transmission of high power down a long >1000 ft (0.30 km) optical fiber; the use of a fiber laser, disk laser, or high brightness semiconductor laser for drilling rock with the bandwidth broadened to enable the efficient delivery of the optical power via a >1000 ft (0.30 km) long optical fiber; the use of phased array laser sources with its bandwidth broadened to suppress the Stimulated Brillioun Gain (SBG) for power transmission down fibers that are >1000 ft (0.30 km) in length; a fiber spooling technique that enables the fiber to be powered from the central axis of the spool by a laser beam while the spool is turning; a method for spooling out the fiber without having to use a mechanically moving component; a method for combining multiple fibers into a single jacket capable of withstanding down hole pressures; the use of active and passive fiber sections to overcome the losses along the length of the fiber; the use of a buoyant fiber to support the weight of the fiber, laser head and encasement down a drilling hole; the use of micro lenses, aspherical optics, axicons or diffractive optics to create a predetermined pattern on the rock to achieve higher drilling efficiencies; and the use of a heat engine or tuned photovoltaic cell to reconvert optical power to electrical power after transmitting the power >1000 ft (0.30 km) via an optical fiber.

SUMMARY

It is desirable to develop systems and methods that provide for the delivery of high power laser energy to the bottom of a deep borehole to advance that borehole at a cost effective rate, and in particular, to be able to deliver such high power laser energy to drill through rock layer formations including granite, basalt, sandstone, dolomite, sand, salt, limestone, rhyolite, quartzite and shale rock at a cost effective rate. More particularly, it is desirable to develop systems and methods that provide for the ability to deliver such high power laser energy to drill through hard rock layer formations, such as granite and basalt, at a rate that is superior to prior conventional mechanical drilling operations. The present invention, among other things, solves these needs by providing the system, apparatus and methods taught herein.

Thus, there is provided a high power laser drilling system for use in association with a drilling rig, drilling platform, drilling derrick, a snubbing platform, or coiled tubing drilling rig for advancing a borehole, in hard rock, the system comprising: a source of high power laser energy, the laser source capable of providing a laser beam having at least 10 kW of power, at least about 20 kW of power or more; a bottom hole assembly, the bottom hole assembly having an optical assembly, the optical assembly configured to provide a predetermined energy deposition profile to a borehole surface and the optical assembly configured to provide a predetermined laser shot pattern; a means for advancing the bottom hole assembly into and down the borehole; a downhole high power laser transmission cable, the transmission cable having a length of at least about 500 feet, at least about 1000 feet, at least about 3000 feet, at least about 4000 feet or more; the downhole cable in optical communication with the laser source; and, the downhole cable in optical communication with the bottom hole assembly.

There is further provided a high power laser drilling system for use in association with a drilling rig, drilling platform, snubbing platform, drilling derrick, or coiled tubing drilling rig for advancing a borehole, the system comprising: a source of high power laser energy; the laser source capable of providing a laser beam having at least 5 kW, at least about 10 kW, at least about 15 kW and at least about 20 kW or more of power; the laser source comprising at least one laser; a bottom hole assembly; configured to provide a predetermined energy deposition profile of laser energy to a borehole surface; configured to provide a predetermined laser shot pattern; comprising an optical assembly; and, comprising a means to mechanically remove borehole material; a means for advancing the bottom hole assembly into and down the borehole; a source of fluid for use in advancing a borehole; a downhole high power laser transmission cable, the transmission cable having a length of at least about 1000 feet; the downhole cable in optical communication with the laser source; the downhole cable in optical communication with the optical assembly; and, the bottom hole assembly in fluid communication with the fluid source; whereby high power laser energy may be provided to a surface of a borehole at locates within the borehole at least 1000 feet from the borehole opening.

Yet further there is provided a high power laser drilling system for use in association with a drilling rig, drilling platform, drilling derrick, a snubbing platform, or coiled tubing drilling rig for advancing a borehole, the system comprising: a source of high power laser energy; a bottom hole assembly; the bottom hole assembly having an optical assembly; the optical assembly configured to provide an energy deposition profile to a borehole surface; and, the optical assembly configured to provide a laser shot pattern; comprising a means for directing a fluid; a means for advancing the bottom hole assembly into and down the borehole; a source of fluid for use in advancing a borehole; a downhole high power laser transmission cable; the downhole cable in optical communication with the laser source; the downhole cable in optical communication with the bottom hole assembly; and, the means for directing in fluid communications with the fluid source; wherein the system is capable of cutting, spalling, or chipping rock by illuminating a surface of the borehole with laser energy and remove waste material created from said cutting, spalling or chipping, from the borehole and the area of laser illumination by the action of the directing means. Wherein the means for directing may be, one or more of and combinations thereof a fluid amplifier, an outlet port, a gas directing means, a fluid directing means, and an air knife.

Additionally, there is provided a laser bottom hole assembly comprising: a first rotating housing; a second fixed housing; the first housing being rotationally associated with the second housing; a fiber optic cable for transmitting a laser beam, the cable having a proximal end and a distal end, the proximal end adapted to receive a laser beam from a laser source, the distal end optically associated with an optical assembly; at least a portion of the optical assembly fixed to the first rotating housing, whereby the fixed portion rotates with the first housing; a mechanical assembly fixed to the first rotating housing, whereby the assembly rotates with the first housing and is capable of applying mechanical forces to a surface of a borehole upon rotation; and, a fluid path associated with first and second housings, the fluid path having a distal and proximal opening, the distal opening adapted to discharge the fluid toward the surface of the borehole, whereby fluid for removal of waste material is transmitted by the fluid path and discharged from the distal opening toward the borehole surface to remove waste material from the borehole.

There is further provided a laser bottom hole assembly comprising: a first rotating housing; a second fixed housing; the first housing being rotationally associated with the second housing; an optical assembly, the assembly having a first portion and a second portion; a fiber optic cable for transmitting a laser beam, the cable having a proximal end and a distal end, the proximal end adapted to receive a laser beam from a laser source, the distal end optically associated with the optical assembly; the fiber proximal and distal ends fixed to the second housing; the first portion of the optical assembly fixed to the first rotating housing; the second portion of the optical assembly fixed to the second fixed housing, whereby the first portion of the optical assembly rotates with the first housing; a mechanical assembly fixed to the first rotating housing, whereby the assembly rotates with the first housing and is capable of apply mechanical forces to a surface of a borehole upon rotation; and, a fluid path associated with first and second housings, the fluid path having a distal and proximal opening, the distal opening adapted to discharge the fluid toward the surface of the borehole, the distal opening fixed to the first rotating housing, whereby fluid for removal of waste material is transmitted by the fluid path and discharged from the distal opening toward the borehole surface to remove waste material from the borehole; wherein upon rotation of the first housing the optical assembly first portion, the mechanical assembly and proximal fluid opening rotate substantially concurrently.

Additionally there is provided a laser bottom hole assembly comprising: a housing; a means for providing a high power laser beam; an optical assembly, the optical assembly providing an optical path upon which the laser beam travels; and, a an air flow and chamber for creating an area of high pressure along the optical path; and, a an air flow through a housing of the bottom hole assembly with ports that function as an aspiration pumping for the removal of waste material from the area of high pressure.

Furthermore, these systems and assemblies may further have rotating laser optics, a rotating mechanical interaction device, a rotating fluid delivery means, one or all three of these devices rotating together, beam shaping optic, housings, a means for directing a fluid for removal of waste material, a means for keeping a laser path free of debris, a means for reducing the interference of waste material with the laser beam, optics comprising a scanner; a stand-off mechanical device, a conical stand-off device, a mechanical assembly comprises a drill bit, a mechanical assembly comprising a three-cone drill bit, a mechanical assembly comprises a PDC bit, a PDC tool or a PDC cutting tool.

Still further, there is provided a system for creating a borehole in the earth having a high power laser source, a bottom hole assembly and, a fiber optically connecting the laser source with the bottom hole assembly, such that a laser beam from the laser source is transmitted to the bottom hole assembly the bottom hole assembly comprising: a means for providing the laser beam to a bottom surface of the borehole; the providing means comprising beam power deposition optics; wherein, the laser beam as delivered from the bottom hole assembly illuminates the bottom surface of the borehole with a substantially even energy deposition profile.

There is yet further provided a method of advancing a borehole using a laser, the method comprising: advancing a high power laser beam transmission means into a borehole; the borehole having a bottom surface, a top opening, and a length extending between the bottom surface and the top opening of at least about 1000 feet; the transmission means comprising a distal end, a proximal end, and a length extending between the distal and proximal ends, the distal end being advanced down the borehole; the transmission means comprising a means for transmitting high power laser energy; providing a high power laser beam to the proximal end of the transmission means; transmitting substantially all of the power of the laser beam down the length of the transmission means so that the beam exits the distal end; transmitting the laser beam from the distal end to an optical assembly in a laser bottom hole assembly, the laser bottom hole assembly directing the laser beam to the bottom surface of the borehole; and, providing a predetermined energy deposition profile to the bottom of the borehole; whereby the length of the borehole is increased, in part, based upon the interaction of the laser beam with the bottom of the borehole.

Additionally, there is provided a method of removing debris from a borehole during laser drilling of the borehole the method comprising: directing a laser beam comprising a wavelength, and having a power of at least about 10 kW, down a borehole and towards a surface of a borehole; the surface being at least 1000 feet within the borehole; the laser beam illuminating an area of the surface; the laser beam displacing material from the surface in the area of illumination; directing a fluid into the borehole and to the borehole surface; the fluid being substantially transmissive to the laser wavelength; the directed fluid having a first and a second flow path; the fluid flowing in the first flow path removing the displaced material from the area of illumination at a rate sufficient to prevent the displaced material from interfering with the laser illumination of the area of illumination; and, the fluid flowing in the second flow path removing displaced material form borehole. Additionally, the forging method may also have the illumination area rotated, the fluid in the first fluid flow path directed in the direction of the rotation, the fluid in the first fluid flow path directed in a direction opposite of the rotation, a third fluid flow path, the third fluid low path and the first fluid flow path in the direction of rotation, the third fluid low path and the first fluid flow path in a direction opposite to the direction of rotation, the fluid directed directly at the area of illumination, the fluid in the first flow path directed near the area of illumination, and the fluid in the first fluid flow path directed near the area of illumination, which area is ahead of the rotation.

There is yet further provided a method of removing debris from a borehole during laser drilling of the borehole the method comprising: directing a laser beam having at least about 10 kW of power towards a borehole surface; illuminating an area of the borehole surface; displacing material from the area of illumination; providing a fluid; directing the fluid toward a first area within the borehole; directing the fluid toward a second area; the directed fluid removing the displaced material from the area of illumination at a rate sufficient to prevent the displaced material from interfering with the laser illumination; and, the fluid removing displaced material form borehole. This further method may additionally have the first area as the area of illumination, the second area on a sidewall of a bottom hole assembly, the second area near the first area and the second area located on a bottom surface of the borehole, the second area near the first area when the second area is located on a bottom surface of the borehole, a first fluid directed to the area of illumination and a second fluid directed to the second area, the first fluid as nitrogen, the first fluid as a gas, the second fluid as a liquid, and the second fluid as an aqueous liquid.

Yet, further there is provided a method of removing debris from a borehole during laser drilling of the borehole the method comprising: directing a laser beam towards a borehole surface; illuminating an area of the borehole surface; displacing material from the area of illumination; providing a fluid; directing the fluid in a first path toward a first area within the borehole; directing the fluid in a second path toward a second area; amplifying the flow of the fluid in the second path; the directed fluid removing the displaced material from the area of illumination at a rate sufficient to prevent the displaced material from interfering with the laser illumination; and, the amplified fluid removing displaced material form borehole.

Moreover, there is provided a laser bottom hole assembly for drilling a borehole in the earth comprising: a housing; optics for shaping a laser beam; an opening for delivering a laser beam to illuminate the surface of a borehole; a first fluid opening in the housing; a second fluid opening in the housing; and, the second fluid opening comprising a fluid amplifier.

Still further, a high power laser drilling system for advancing a borehole is provided that comprises: a source of high power laser energy, the laser source capable of providing a laser beam; a tubing assembly, the tubing assembly having at least 500 feet of tubing, having a distal end and a proximal; a source of fluid for use in advancing a borehole; the proximal end of the tubing being in fluid communication with the source of fluid, whereby fluid is transported in association with the tubing from the proximal end of the tubing to the distal end of the tubing; the proximal end of the tubing being in optical communication with the laser source, whereby the laser beam can be transported in association with the tubing; the tubing comprising a high power laser transmission cable, the transmission cable having a distal end and a proximal end, the proximal end being in optical communication with the laser source, whereby the laser beam is transmitted by the cable from the proximal end to the distal end of the cable; and, a laser bottom hole assembly in optical and fluid communication with the distal end of the tubing; and, the laser bottom hole assembly comprising; a housing; an optical assembly; and, a fluid directing opening. This system may be supplemented by also having the fluid directing opening as an air knife, the fluid directing opening as a fluid amplifier, the fluid directing opening is an air amplifier, a plurality of fluid directing apparatus, the bottom hole assembly comprising a plurality of fluid directing openings, the housing comprising a first housing and a second housing; the fluid directing opening located in the first housing, and a means for rotating the first housing, such as a motor, There is yet further provided a high power laser drilling system for advancing a borehole comprising: a source of high power laser energy, the laser source capable of providing a laser beam; a tubing assembly, the tubing assembly having at least 500 feet of tubing, having a distal end and a proximal; a source of fluid for use in advancing a borehole; the proximal end of the tubing being in fluid communication with the source of fluid, whereby fluid is transported in association with the tubing from the proximal end of the tubing to the distal end of the tubing; the proximal end of the tubing being in optical communication with the laser source, whereby the laser beam can be transported in association with the tubing; the tubing comprising a high power laser transmission cable, the transmission cable having a distal end and a proximal end, the proximal end being in optical communication with the laser source, whereby the laser beam is transmitted by the cable from the proximal end to the distal end of the cable; and, a laser bottom hole assembly in optical and fluid communication with the distal end of the tubing; and, a fluid directing means for removal of waste material.

Further such systems may additionally have the fluid directing means located in the laser bottom hole assembly, the laser bottom hole assembly having a means for reducing the interference of waste material with the laser beam, the laser bottom hole assembly with rotating laser optics, and the laser bottom hole assembly with rotating laser optics and rotating fluid directing means.

One of ordinary skill in the art will recognize, based on the teachings set forth in these specifications and drawings, that there are various embodiments and implementations of these teachings to practice the present invention. Accordingly, the embodiments in this summary are not meant to limit these teachings in any way.

DESCRIPTION OF THE DRAWINGS AND THE PREFERRED EMBODIMENTS

In general, the present inventions relate to methods, apparatus and systems for use in laser drilling of a borehole in the earth, and further, relate to equipment, methods and systems for the laser advancing of such boreholes deep into the earth and at highly efficient advancement rates. These highly efficient advancement rates are obtainable because the present invention provides for a means to get high power laser energy to the bottom of the borehole, even when the bottom is at great depths.

Figures 1, 1A:
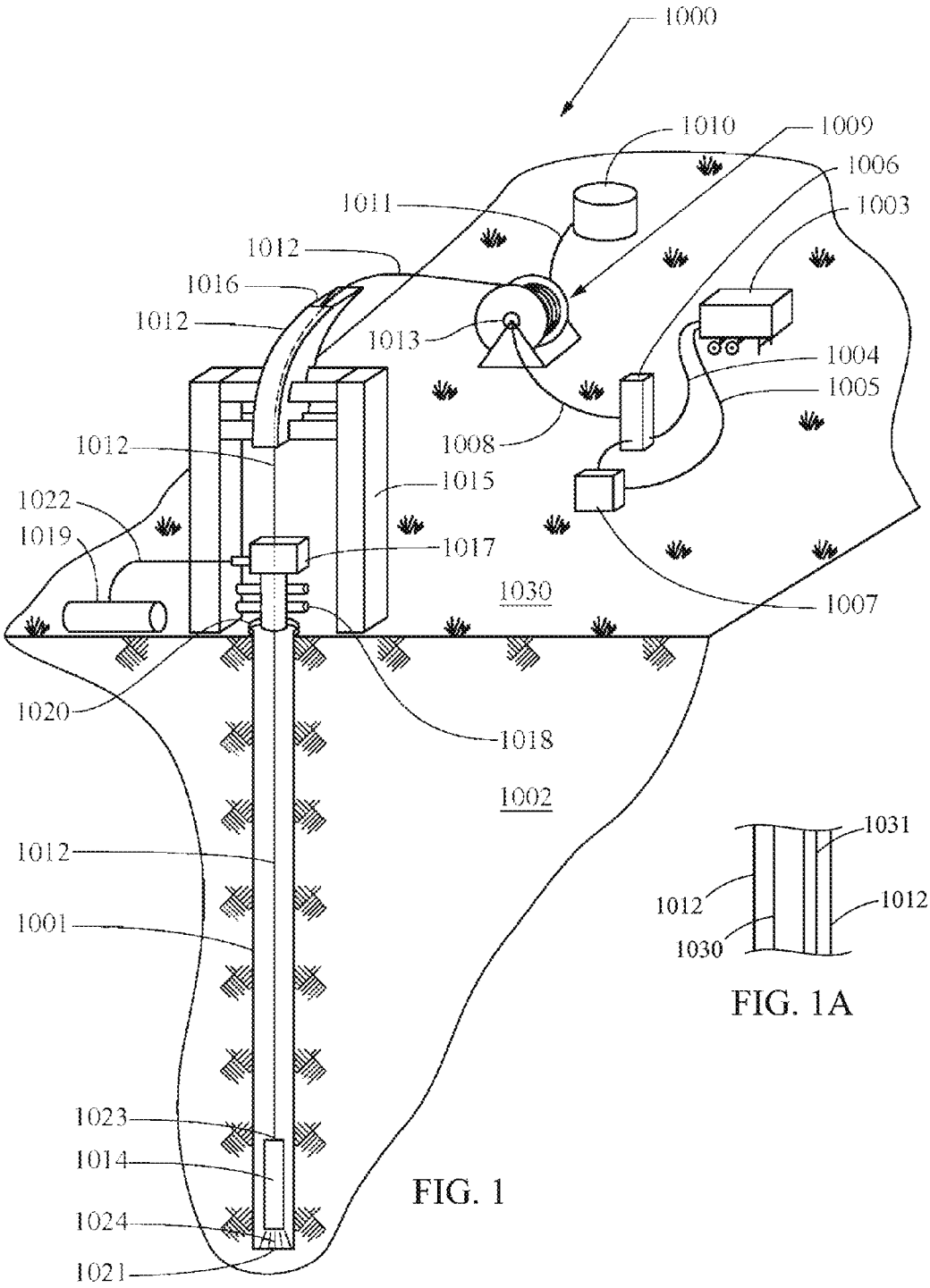
FIG. 1 is a. cross sectional view of the earth, a borehole and an example of a system of the present invention for advancing a borehole.
FIG. 1A is an enlarged cross sectional view of a section of the coiled tubing of the embodiment of FIG. 1.

Thus, in general, and by way of example, there is provided in FIG. 1 a high efficiency laser drilling system 1000 for creating a borehole 1001 in the earth 1002. As used herein the term "earth" should be given its broadest possible meaning (unless expressly stated otherwise) and would include, without limitation, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

FIG. 1 provides a cut away perspective view showing the surface of the earth 1030 and a cut away of the earth below the surface 1002. In general and by way of example, there is provided a source of electrical power 1003, which provides electrical power by cables 1004 and 1005 to a laser 1006 and a chiller 1007 for the laser 1006. The laser provides a laser beam, i.e., laser energy, that can be conveyed by a laser beam transmission means 1008 to a spool of coiled tubing 1009. A source of fluid 1010 is provided. The fluid is conveyed by fluid conveyance means 1011 to the spool of coiled tubing 1009.

Turning to FIGS. 1 and 1A, the spool of coiled tubing 1009 is rotated to advance and retract the coiled tubing 1012. Thus, the laser beam transmission means 1008 and the fluid conveyance means 1011 are attached to the spool of coiled tubing 1009 by means of rotating coupling means 1013. The coiled tubing 1012 contains a means to transmit the laser beam 1030 along the entire length of the coiled tubing, i.e.,"long distance high power laser beam transmission means," to the bottom hole assembly, 1014. The coiled tubing 1012 also contains a means to convey the fluid 1031 along the entire length of the coiled tubing 1012 to the bottom hole assembly 1014.

Additionally, there is provided a support structure 1015, which holds an injector 1016, to facilitate movement of the coiled tubing 1012 in the borehole 1001. Further other support structures may be employed for example such structures could be derrick, crane, mast, tripod, or other similar type of structure or hybrid and combinations of these. As the borehole is advance to greater depths from the surface 1030, the use of a diverter 1017, a blow out preventer (BOP) 1018, and a fluid and/or cutting handling system 1019 may become necessary. The coiled tubing 1012 is passed from the injector 1016 through the diverter 1017, the BOP 1018, a wellhead 1020 and into the borehole 1001.

The fluid is conveyed to the bottom 1021 of the borehole 1001. At that point the fluid exits at or near the bottom hole assembly 1014 and is used, among other things, to carry the cuttings, which are created from advancing a borehole, back up and out of the borehole. Thus, the diverter 1017 directs the fluid as it returns carrying the cuttings to the fluid and/or cuttings handling system 1019 through connector 1022. This handling system 1019 is intended to prevent waste products from escaping into the environment and separates and cleans waste products and either vents the cleaned fluid to the air, if permissible environmentally and economically, as would be the case if the fluid was nitrogen, or returns the cleaned fluid to the source of fluid 1010, or otherwise contains the used fluid for later treatment and/or disposal.

The BOP 1018 serves to provide multiple levels of emergency shut off and/or containment of the borehole should a high-pressure event occur in the borehole, such as a potential blow-out of the well. The BOP is affixed to the wellhead 1020. The wellhead in turn may be attached to casing. For the purposes of simplification the structural components of a borehole such as casing, hangers, and cement are not shown. It is understood that these components may be used and will vary based upon the depth, type, and geology of the borehole, as well as, other factors.

The downhole end 1023 of the coiled tubing 1012 is connected to the bottom hole assembly 1014. The bottom hole assembly 1014 contains optics for delivering the laser beam 1024 to its intended target, in the case of FIG. 1, the bottom 1021 of the borehole 1001. The bottom hole assembly 1014, for example, also contains means for delivering the fluid.

Thus, in general this system operates to create and/or advance a borehole by having the laser create laser energy in the form of a laser beam. The laser beam is then transmitted from the laser through the spool and into the coiled tubing. At which point, the laser beam is then transmitted to the bottom hole assembly where it is directed toward the surfaces of the earth and/or borehole. Upon contacting the surface of the earth and/or borehole the laser beam has sufficient power to cut, or otherwise effect, the rock and earth creating and/or advancing the borehole. The laser beam at the point of contact has sufficient power and is directed to the rock and earth in such a manner that it is capable of borehole creation that is comparable to or superior to a conventional mechanical drilling operation. Depending upon the type of earth and rock and the properties of the laser beam this cutting occurs through spalling, thermal dissociation, melting, vaporization and combinations of these phenomena.

Although not being bound by the present theory, it is presently believed that the laser material interaction entails the interaction of the laser and a fluid or media to clear the area of laser illumination. Thus the laser illumination creates a surface event and the fluid impinging on the surface rapidly transports the debris, i.e. cuttings and waste, out of the illumination region. The fluid is further believed to remove heat either on the macro or micro scale from the area of illumination, the area of post-illumination, as well as the borehole, or other media being cut, such as in the case of perforation.

The fluid then carries the cuttings up and out of the borehole. As the borehole is advanced the coiled tubing is unspooled and lowered further into the borehole. In this way the appropriate distance between the bottom hole assembly and the bottom of the borehole can be maintained. If the bottom hole assembly needs to be removed from the borehole, for example to case the well, the spool is wound up, resulting in the coiled tubing being pulled from the borehole. Additionally, the laser beam may be directed by the bottom hole assembly or other laser directing tool that is placed down the borehole to perform operations such as perforating, controlled perforating, cutting of casing, and removal of plugs. This system may be mounted on readily mobile trailers or trucks, because its size and weight are substantially less than conventional mechanical rigs.

For systems of the general type illustrated in FIG. 1, having the laser located outside of the borehole, the laser may be any high powered laser that is capable of providing sufficient energy to perform the desired functions, such advancing the borehole into and through the earth and rock believed to be present in the geology corresponding to the borehole. The laser source of choice is a single mode laser or low order multi-mode laser with a low $M^2$ to facilitate launching into a small core optical fiber, i.e. about 50 microns. However, larger core fibers are preferred. Examples of a laser source include fiber lasers, chemical lasers, disk lasers, thin slab lasers, high brightness diode lasers, as well as, the spectral beam combination of these laser sources or a coherent phased array laser of these sources to increase the brightness of the individual laser source.

Figure 4:
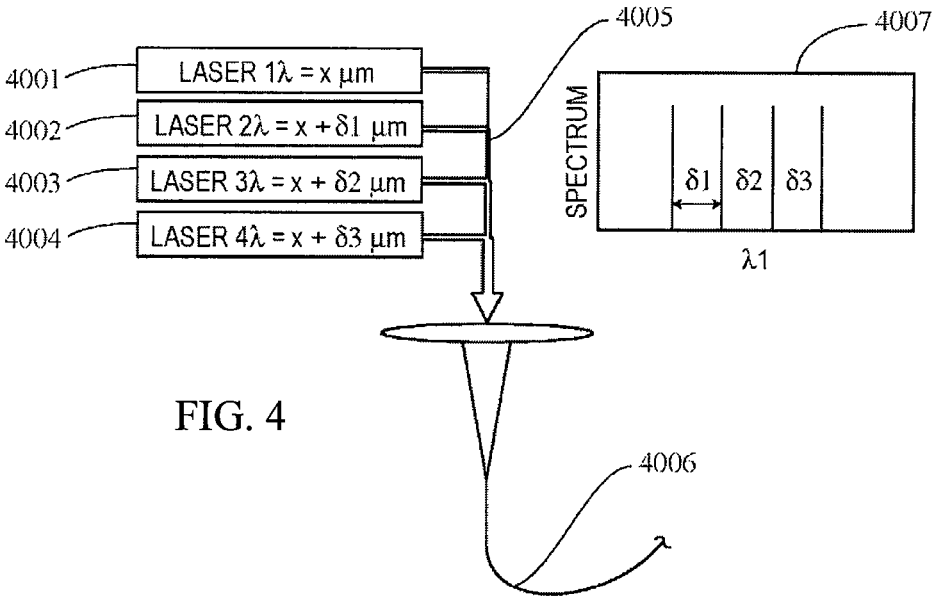
FIG. 4 is schematic diagram for a configuration of lasers.

For example, FIG. 4 Illustrates a spectral beam combination of lasers sources to enable high power transmission down a fiber by allocating a predetermined amount of power per color as limited by the Stimulated Brillioun Scattering (SBS) phenomena. Thus, there is provided in FIG. 4 a first laser source 4001 having a first wavelength of "x", where x is less than 1 micron. There is provided a second laser 4002 having a second wavelength of x+δ1 microns, where δ1 is a predetermined shift in wavelength, which shift could be positive or negative. There is provided a third laser 4003 having a third wavelength of x+δ1+δ2 microns and a fourth laser 4004 having a wavelength of x+δ1+δ2+δ3 microns. The laser beams are combined by a beam combiner 4005 and transmitted by an optical fiber 4006. The combined beam having a spectrum show in 4007.

Figure 5:
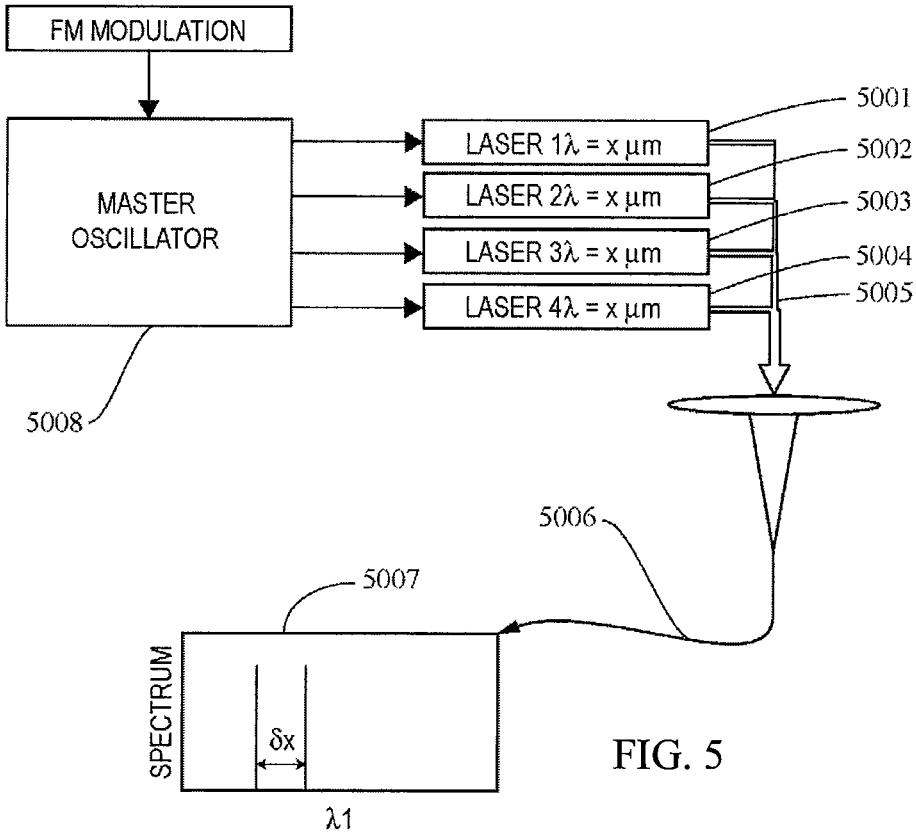
FIG. 5 is a schematic diagram for a configuration of lasers.

For example, FIG. 5. Illustrates a frequency modulated phased array of lasers. Thus, there is provided a master oscillator than can be frequency modulated, directly or indirectly, that is then used to injection-lock lasers or amplifiers to create a higher power composite beam than can be achieved by any individual laser. Thus, there are provided lasers 5001, 5002, 5003, and 5004, which have the same wavelength. The laser beams are combined by a beam combiner 5005 and transmitted by an optical fiber 5006. The lasers 5001, 5002, 5003 and 5004 are associated with a master oscillator 5008 that is FM modulated. The combined beam having a spectrum show in 5007, where δ is the frequency excursion of the FM modulation. Such lasers are disclosed in U.S. Pat. No. 5,694,408, the disclosure of which is incorporated here in reference in its entirety.

The laser source may be a low order mode source ($M^2$<2)so it can be focused into an optical fiber with a mode diameter of <100 microns. Optical fibers with small mode field diameters ranging from 50 microns to 6 microns have the lowest transmission losses. However, this should be balanced by the onset of non-linear phenomenon and the physical damage of the face of the optical fiber requiring that the fiber diameter be as large as possible while the transmission losses have to be as small as possible.

Thus, the laser source should have total power of at least about 1 kW, from about 1 kW to about 20 kW, from about 10 kW to about 20 kW, at least about 10 kW, and preferably about 20 or more kW. Moreover, combinations of various lasers may be used to provide the above total power ranges. Further, the laser source should have beam parameters in mm millirad as large as is feasible with respect to bendability and manufacturing substantial lengths of the fiber, thus the beam parameters may be less than about 100 mm millirad, from single mode to about 50 mm millirad, less than about 50 mm millirad, less than about 15 mm millirad, and most preferably about 12 mm millirad. Further, the laser source should have at least a 10% electrical optical efficiency, at least about 50% optical efficiency, at least about 70% optical efficiency, whereby it is understood that greater optical efficiency, all other factors being equal, is preferred, and preferably at least about 25%. The laser source can be run in either pulsed or continuous wave (CW) mode. The laser source is preferably capable of being fiber coupled.

For advancing boreholes in geologies containing hard rock formations such as granite and basalt it is preferred to use the IPG 20000YB having the following specifications set forth in Table 1 herein.

TABLE 1

| Optical Characteristics | | | | | | |
|---|---|---|---|---|---|---|
| Characteristics | Test conditions | Symbol | Min. | Typ. | Max | Unit |
| Operation Mode | | | | CW, QCW | | |
| Polarization | | | | Random | | |
| Nominal Output Power | | $P_{NOM}$ | 20000* | | | W |
| Output Power Tuning Range | | | 10 | | 100 | % |
| Emission Wavelength | $P_{OUT}$ = 20 kW | | 1070 | | 1080 | nm |
| Emission Linewidth | $P_{OUT}$ = 20 kW | | | 3 | 6 | nm |
| Switching ON/OFF Time | $P_{OUT}$ = 20 kW | | | 80 | 100 | μsec |
| Output Power Modulation Rate | $P_{OUT}$ = 20 kW | | | | 5.0 | kHz |
| Output Power Stability | Over 8 hrs, $T_{WATER}$ = Const | | | 1.0 | 2.0 | % |
| Feeding Fiber Core Diameter | | | | 200 | | μm |
| Beam Parameter Product | 200 μm | BPP | | 12 | 14 | mm * mrad |
| Feeding Fiber | | | | | | |
| Fiber Length | | L | | 10 | | m |
| Fiber Cable Bend Radius: | | | | | | |
| unstressed | | R | 100 | | | mm |
| stressed | | | 200 | | | |
| Output Termination | | | IPG HLC-8 Connector (QBH compatible) | | | |
| Aiming Laser Wavelength | | | 640 | | 680 | nm |
| Aiming Laser Output Power | | | 0.5 | | 1 | mW |

| Parameters | Test conditions | Min. | Typ. | Max | Unit |
|---|---|---|---|---|---|
| Operation Voltage (3 phases) | | 440 V | 480 | 520 | VAC |
| Frequency | | | 50/60 | | Hz |
| Power Consumption | $P_{OUT}$ = 20 kW | | 75 | 80 | kW |
| Operating Temperature Range | | +15 | | +40 | ° C. |
| Humidity: | | | | | |
| without conditioner | T < 25° C. | | | 90 | % |
| with built-in conditioner | T < 40° C. | | | 95 | |
| Storage Temperature | Without water | −40 | | +75 | ° C. |
| Dimensions, H × W × D | NEMA-12; IP-55 | | 1490 × 1480 × 810 | | mm |
| Weight | | | 1200 | | kg |
| Plumbing | | | NPT Threaded Stainless Steel and/or Plastic Tubing | | |

*Output power tested at connector at distance not greater than 50 meters from laser.

For cutting casing, removal of plugs and perforation operations the laser may be any of the above referenced lasers, and it may further be any smaller lasers that would be only used for workover and completion downhole activities.

In addition to the configuration of FIG. 1, and the above preferred examples of lasers for use with the present invention other configurations of lasers for use in a high efficiency laser drilling systems are contemplated. Thus, Laser selection may generally be based on the intended application or desired operating parameters. Average power, specific power, irradiance, operation wavelength, pump source, beam spot size, exposure time, and associated specific energy may be considerations in selecting a laser. The material to be drilled, such as rock formation type, may also influence laser selection. For example, the type of rock may be related to the type of resource being pursued. Hard rocks such as limestone and granite may generally be associated with hydrothermal sources, whereas sandstone and shale may generally be associated with gas or oil sources. Thus by way of example, the laser may be a solid-state laser, it may be a gas, chemical, dye or metal-vapor laser, or it may be a semiconductor laser. Further, the laser may produce a kilowatt level laser beam, and it may be a pulsed laser. The laser further may be a Nd:YAG laser, a $CO_2$ laser, a diode laser, such as an infrared diode laser, or a fiber laser, such as a ytterbium-doped multi-clad fiber laser. The infrared fiber laser emits light in the wavelengths ranges from 800 nm to 1600 nm. The fiber laser is doped with an active gain medium comprising rare earth elements, such as holmium, erbium, ytterbium, neodymium, dysprosium, praseodymium, thulium or combinations thereof. Combinations of one or more types of lasers may be implemented.

Fiber lasers of the type useful in the present invention are generally built around dual-core fibers. The inner core may be composed of rare-earth elements; ytterbium, erbium, thulium, holmium or a combination. The optical gain medium emits wavelengths of 1064 nm, 1360 nm, 1455 nm, and 1550 nm, and can be diffraction limited. An optical diode may be coupled into the outer core (generally referred to as the inner cladding) to pump the rare earth ion in the inner core. The outer core can be a multi-mode waveguide. The inner core serves two purposes: to guide the high power laser; and, to provide gain to the high power laser via the excited rare earth ions. The outer cladding of the outer core may be a low index polymer to reduce losses and protect the fiber. Typical pumped laser diodes emit in the range of about 915-980 nm (generally—940 nm). Fiber lasers are manufactured from IPG Photonics or Southhampton Photonics. High power fibers were demonstrated to produce 50 kW by IPG Photonics when multiplexed.

In use, one or more laser beams generated or illuminated by the one or more lasers may spall, vaporize or melt material, such as rock. The laser beam may be pulsed by one or a plurality of waveforms or it may be continuous. The laser beam may generally induce thermal stress in a rock formation due to characteristics of the material, such as rock including, for example, the thermal conductivity. The laser beam may also induce mechanical stress via superheated steam explosions of moisture in the subsurface of the rock formation. Mechanical stress may also be induced by thermal decompositions and sublimation of part of the in situ mineral of the material. Thermal and/or mechanical stress at or below a laser-material interface may promote spallation of the material, such as rock. Likewise, the laser may be used to effect well casings, cement or other bodies of material as desired. A laser beam may generally act on a surface at a location where the laser beam contacts the surface, which may be referred to as a region of laser illumination. The region of laser illumination may have any preselected shape and intensity distribution that is required to accomplish the desired outcome, the laser illumination region may also be referred to as a laser beam spot. Boreholes of any depth and/or diameter may be formed, such as by spalling multiple points or layers. Thus, by way of example, consecutive points may be targeted or a strategic pattern of points may be targeted to enhance laser/rock interaction. The position or orientation of the laser or laser beam may be moved or directed so as to intelligently act across a desired area such that the laser/material interactions are most efficient at causing rock removal.

One or more lasers may further be positioned downhole, i.e., down the borehole. Thus, depending upon the specific requirements and operation parameters, the laser may be located at any depth within the borehole. For example, the laser may be maintained relatively close to the surface, it may be positioned deep within the borehole, it may be maintained at a constant depth within the borehole or it may be positioned incrementally deeper as the borehole deepens. Thus, by way of further example, the laser may be maintained at a certain distance from the material, such as rock to be acted upon. When the laser is deployed downhole, the laser may generally be shaped and/or sized to fit in the borehole. Some lasers may be better suited than others for use downhole. For example, the size of some lasers may deem them unsuitable for use downhole, however, such lasers may be engineered or modified for use downhole. Similarly, the power or cooling of a laser may be modified for use downhole.

Systems and methods may generally include one or more features to protect the laser. This become important because of the harsh environments, both for surface units and downhole units. Thus, In accordance with one or more embodiments, a borehole drilling system may include a cooling system. The cooling system may generally function to cool the laser. For example, the cooling system may cool a downhole laser, for example to a temperature below the ambient temperature or to an operating temperature of the laser. Further, the laser may be cooled using sorption cooling to the operating temperature of the infrared diode laser, for example, about 20° C. to about 100° C. For a fiber laser its operating temperature may be between about 20° C. to about 50° C. A liquid at a lower temperature may be used for cooling when a temperature higher than the operating diode laser temperature is reached to cool the laser.

Heat may also be sent uphole, i.e., out of the borehole and to the surface, by a liquid heat transfer agent. The liquid transfer agent may then be cooled by mixing with a lower temperature liquid uphole. One or multiple heat spreading fans may be attached to the laser diode to spread heat away from the infrared diode laser. Fluids may also be used as a coolant, while an external coolant may also be used.

In downhole applications the laser may be protected from downhole pressure and environment by being encased in an appropriate material. Such materials may include steel, titanium, diamond, tungsten carbide and the like. The fiber head for an infrared diode laser or fiber laser may have an infrared transmissive window. Such transmissive windows may be made of a material that can withstand the downhole environment, while retaining transmissive qualities. One such material may be sapphire or other material with similar qualities. One or more infrared diode lasers or fiber lasers may be entirely encased by sapphire. By way of example, an infrared diode laser or fiber laser may be made of diamond, tungsten carbide, steel, and titanium other than the part where the laser beam is emitted.

In the downhole environment it is further provided by way of example that the infrared diode laser or fiber laser is not in contact with the borehole while drilling. For example, a downhole laser may be spaced from a wall of the borehole.

The chiller, which is used to cool the laser, in the systems of the general type illustrated in FIG. 1 is chosen to have a cooling capacity dependent on the size of the laser, the efficiency of the laser, the operating temperature, and environmental location, and preferably the chiller will be selected to operate over the entirety of these parameters. Preferably, an example of a chiller that is useful for a 20 kW laser will have the following specifications set forth in Table 2 herein.

TABLE 2

| | |
|---|---|
| Chiller | PC400.01-NZ-DIS |
| Technical Data for 60 Hz operation: | |
| IPG-Laser type | |
| Cooling capacity net | YLR-15000, YLR-20000 |
| Refrigerant | 60.0 kW |
| Necessary air flow | R407C |
| Installation | 26100 $m^3$/h |
| Number of compressors | Outdoor installation |
| Number of fans | 2 |
| Number of pumps | 3 |
| | 2 |
| Operation Limits | |
| Designed Operating Temperature | 33° C. (92 F.) |
| Operating Temperature min. | (−) 20° C. (−4 F.) |
| Operating Temperature max. | 39° C. (102 F.) |
| Storage Temperature min. (with empty water tank) | (−) 40° C. (−40 F.) |
| Storage Temperature max. | 70° C. (158 F.) |
| Tank volume regular water | 240 Liter (63.50 Gallon) |
| Tank volume DI water | 25 Liter (6.61 Gallon) |
| Electrical Data for 60 Hz operation: | |
| Designed power consumption without heater | 29.0 kW |
| Designed power consumption with heater | 33.5 kW |
| Power consumption max. | 41.0 kW |
| Current max. | 60.5 A |
| Fuse max. | 80.0 A |
| Starting current | 141.0 A |
| Connecting voltage | 460 V/3 Ph/PE |
| Frequency | 60 Hz |
| Tolerance connecting voltage | +/−10% |
| Dimensions, weights and sound level | |
| Weight with empty tank | 900 KG (1984 lbs) |
| Sound level at distance of 5 m | 68 dB(A) |
| Width | 2120 mm (83½ inches) |
| Depth | 860 mm (33⅞ inches) |
| Height | 1977 mm (77⅞ inches) |
| Tap water circuit | 0 |
| Cooling capacity | 56.0 kW |
| Water outlet temperature | 21° C. (70 F.) |
| Water inlet temperature | 26° C. (79 F.) |
| Temperature stability | +/−1.0 K |
| Water flow vs. water pressure free available | 135 l/min at 3.0 bar (35.71 GPM at 44 PSI) |

TABLE 2-continued

| | |
|---|---|
| Water flow vs. water pressure free available | 90 l/min at 1.5 bar (23.81 GPM at 21 PSI) |
| De-ionized water circuit | |
| Cooling capacity | 4.0 kW |
| Water outlet temperature | 26° C. (79 F.) |
| Water inlet temperature | 31° C. (88 F.) |
| Temperature stability | +/−1.0 K |
| Water flow vs. water pressure free available | 20 l/min at 1.5 bar (5.28 GPM at 21 PSI) |
| Water flow vs. water pressure free available | 15 l/min at 4.0 bar (3.96 GPM at 58 PSI) |
| Options (included) | |
| Bifrequent version: | |
| 400 V/3 Ph/50 Hz | |
| 460 V/3 Ph 60 Hz | |

For systems of the general type illustrated in FIG. 1, the laser beam is transmitted to the spool of coiled tubing by a laser beam transmission means. Such a transmittance means may be by a commercially available industrial hardened fiber optic cabling with QBH connectors at each end.

There are two basic spool approaches, the first is to use a spool which is simply a wheel with conduit coiled around the outside of the wheel. For example, this coiled conduit may be a hollow tube, it may be an optical fiber, it may be a bundle of optical fibers, it may be an armored optical fiber, it may be other types of optically transmitting cables or it may be a hollow tube that contains the aforementioned optically transmitting cables.

The spool in this configuration has a hollow central axis where the optical power is transmitted to the input end of the optical fiber. The beam will be launched down the center of the spool, the spool rides on precision bearings, e.g., FIG. 6, non-load bearing bearing 6008, in either a horizontal or vertical orientation to prevent any tilt of the spool as the fiber is spooled out. It is optimal for the axis of the spool to maintain an angular tolerance of about +/−10 micro-radians, which is preferably obtained by having the optical axis isolated and/or independent from the spool axis of rotation. The beam when launched into the fiber is launched by a lens which is rotating with the fiber at the Fourier Transform plane of the launch lens, which is insensitive to movement in the position of the lens with respect the laser beam, but sensitive to the tilt of the incoming laser beam. The beam, which is launched in the fiber, is launched by a lens that is stationary with respect to the fiber at the Fourier Transform plane of the launch lens, which is insensitive to movement of the fiber with respect to the launch lens.

A second approach is to use a stationary spool similar to a creel and rotate the laser head as the fiber spools out to keep the fiber from twisting as it is extracted from the spool. If the fiber can be designed to accept a reasonable amount of twist along its length, then this would be the preferred method. Using the second approach if the fiber could be pre-twisted around the spool then as the fiber is extracted from the spool, the fiber straightens out and there is no need for the fiber and the drill head to be rotated as the fiber is played out. There will be a series of tensioners that will suspend the fiber down the hole, or if the hole is filled with water to extract the debris from the bottom of the hole, then the fiber can be encased in a buoyant casing that will support the weight of the fiber and its casing the entire length of the hole. In the situation where the bottom hole assembly does not rotate and the fiber is twisted and placed under twisting strain, there will be the further benefit of reducing SBS as taught herein.

For systems of the general type illustrated in FIG. 1, the spool of coiled tubing can contain the following exemplary lengths of coiled tubing: from 1 km (3,280 ft) to 9 km (29,528 ft); from 2 km (6,561 ft) to 5 km (16,404 ft); at least about 5 km (16,404 ft); and from about 5 km (16,404 ft) to at least about 9 km (29,528 ft). The spool may be any standard type spool using 2.875 steel pipe. For example commercial spools typically include 4-6 km of steel 2⅞" tubing, Tubing is available in commercial sizes ranging from 1" to 2⅞".

Preferably, the Spool will have a standard type 2⅞" hollow steel pipe, i.e., the coiled tubing. As discussed in further herein, the coiled tubing will have in it at least one optical fiber for transmitting the laser beam to the bottom hole assembly. In addition to the optical fiber the coiled tubing may also carry other cables for other downhole purposes or to transmit material or information back up the borehole to the surface. The coiled tubing may also carry the fluid or a conduit for carrying the fluid. To protect and support the optical fibers and other cables that are carried in the coiled tubing stabilizers may be employed.

The spool may have QBH fibers and a collimator. Vibration isolation means are desirable in the construction of the spool, and in particular for the fiber slip ring, thus for example the spool's outer plate mounts to the spool support using a Delrin plate, while the inner plate floats on the spool and pins rotate the assembly. The fiber slip ring is the stationary fiber, which communicates power across the rotating spool hub to the rotating fiber.

When using a spool the mechanical axis of the spool is used to transmit optical power from the input end of the optical fiber to the distal end. This calls for a precision optical bearing system (the fiber slip ring) to maintain a stable alignment between the external fiber providing the optical power and the optical fiber mounted on the spool. The laser can be mounted inside of the spool, or as shown in FIG. 1 it can be mounted external to the spool or if multiple lasers are employed both internal and external locations may be used. The internally mounted laser may be a probe laser, used for analysis and monitoring of the system and methods performed by the system. Further, sensing and monitoring equipment may be located inside of or otherwise affixed to the rotating elements of the spool.

There is further provided rotating coupling means to connect the coiled tubing, which is rotating, to the laser beam transmission means 1008, and the fluid conveyance means 1011, which are not rotating. As illustrated by way of example in FIG. 2, a spool of coiled tubing 2009 has two rotating coupling means 2013. One of said coupling means has an optical rotating coupling means 2002 and the other has a fluid rotating coupling means 2003. The optical rotating coupling means 2002 can be in the same structure as the fluid rotating coupling means 2003 or they can be separate. Thus, preferably, two separate coupling means are employed. Additional rotating coupling means may also be added to handle other cables, such as for example cables for downhole probes.

The optical rotating coupling means 2002 is connected to a hollow precision ground axle 2004 with bearing surfaces 2005, 2006. The laser transmission means 2008 is optically coupled to the hollow axle 2004 by optical rotating coupling means 2002, which permits the laser beam to be transmitted from the laser transmission means 2008 into the hollow axle 2004. The optical rotating coupling means for example may be made up of a QBH connector, a precision collimator, and a rotation stage, for example a Precitec collimator through a Newport rotation stage to another Precitec collimator and to a QBH collimator. To the extent that excessive heat builds up in the optical rotating coupling cooling should be applied to maintain the temperature at a desired level.

The hollow axle 2004 then transmits the laser beam to an opening 2007 in the hollow axle 2004, which opening contains an optical coupler 2010 that optically connects the hollow axle 2004 to the long distance high power laser beam transmission means 2025 that is located inside of the coiled tubing 2012. Thus, in this way the laser transmission means 2008, the hollow axle 2004 and the long distance high power laser beam transmission means 2025 are rotatably optically connected, so that the laser beam can be transmitted from the laser to the long distance high power laser beam transmission means 2025.

Figure 6:
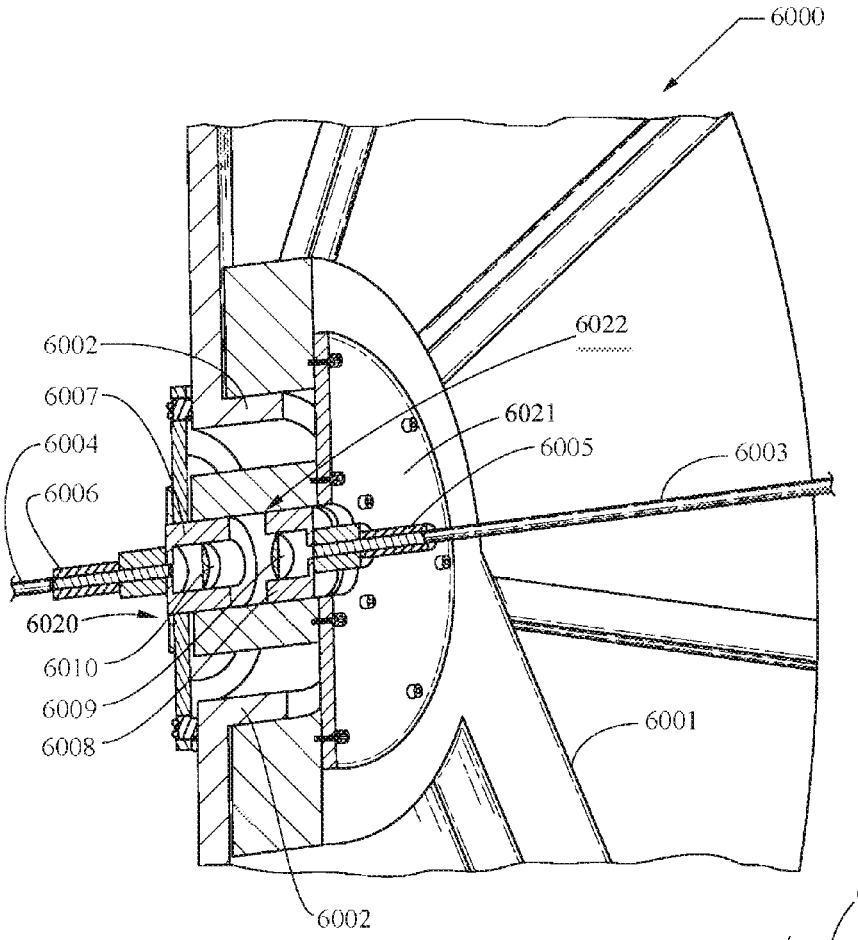
FIG. 6 is a perspective cutaway of a spool and optical rotatable coupler.
Figure 6A:
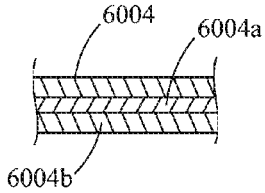
FIG. 6A is an enlarged cross sectional view of a section of the optical cable of FIG. 6.

A further illustration of an optical connection for a rotation spool is provided in FIG. 6, wherein there is illustrated a spool 6000 and a support 6001 for the spool 6000. The spool 6000 is rotatably mounted to the support 6001 by load bearing bearings 6002. An input optical cable 6003, which transmits a laser beam from a laser source (not shown in this figure) to an optical coupler 6005. The laser beam exits the connector 6005 and passes through optics 6009 and 6010 into optical coupler 6006, which is optically connected to an output optical cable 6004. Then, as discussed above, and shown in FIG. 6A the fiber 6004*a* can be encased in a buoyant casing 6004*b*. The optical coupler 6005 is mounted to the spool by a preferably non-load bearing bearing 6008, while coupler 6006 is mounted to the spool by device 6007 in a manner that provides for its rotation with the spool. The load bearing bearing 6002, front plate 6021, and the non-load bearing bearing 6008 provide a vibrational isolation assembly 6020. In this way as the spool is rotated, the weight of the spool and coiled tubing is supported by the load bearing bearings 6002, while the rotatable optical coupling assembly 6022 allows the laser beam to be transmitted from cable 6003 which does not rotate to cable 6004 which rotates with the spool.

Figure 2:
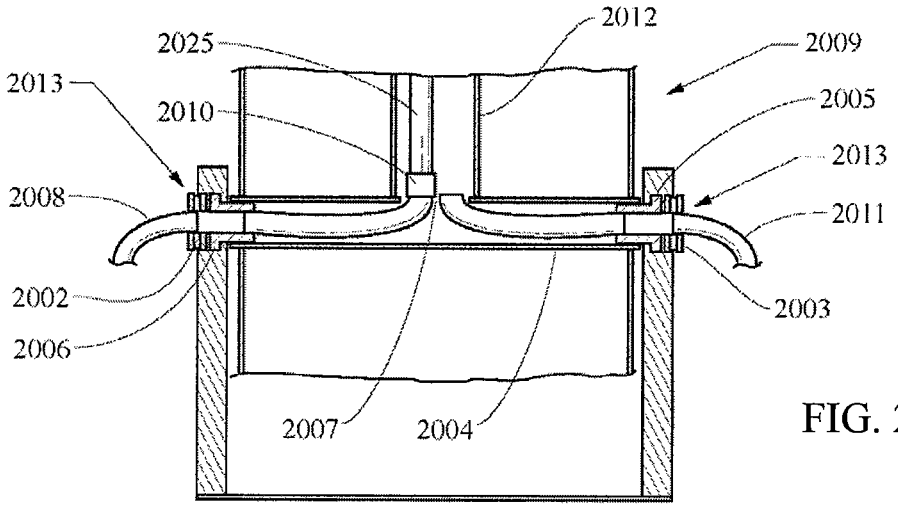
FIG. 2 is a view of a spool.
Figure 3A:
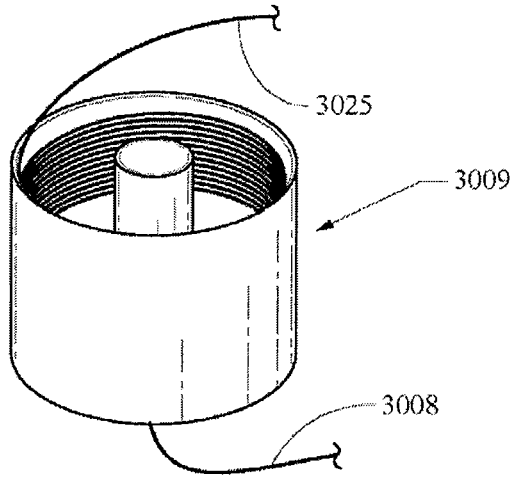
FIGS. 3A and 3B are views of a creel.
Figure 3B:
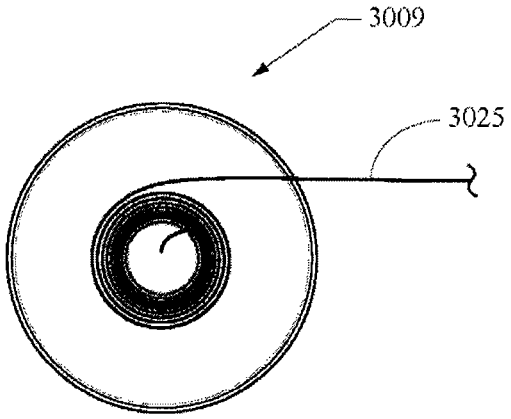

In addition to using a rotating spool of coiled tubing, as illustrated in FIGS. 1 and 2, another means for extending and retrieving the long distance high powered laser beam transmission means is a stationary spool or creel. As illustrated, by way of example, in FIGS. 3A and 3B there is provided a creel 3009 that is stationary and which contains coiled within the long distance high power laser beam transmission means 3025. That means is connected to the laser beam transmission means 3008, which is connected to the laser (not shown in this figure). In this way the laser beam may be transmitted into the long distance high power laser beam transmission means and that means may be deployed down a borehole. Similarly, the long distance high power laser beam transmission means may be contained within coiled tubing on the creel. Thus, the long distance means would be an armored optical cable of the type provided herein. In using the creel consideration should be given to the fact that the optical cable will be twisted when it is deployed. To address this consideration the bottom hole assembly, or just the laser drill head, may be slowly rotated to keep the optical cable untwisted, the optical cable may be pre-twisted, and the optical cable may be designed to tolerate the twisting.

The source of fluid may be either a gas, a liquid, a foam, or system having multiple capabilities. The fluid may serve many purposes in the advancement of the borehole. Thus, the fluid is primarily used for the removal of cuttings from the bottom of the borehole, for example as is commonly referred to as drilling fluid or drilling mud, and to keep the area between the end of the laser optics in the bottom hole assembly and the bottom of the borehole sufficiently clear of cuttings so as to not interfere with the path and power of the laser beam. It also may function to cool the laser optics and the bottom hole assembly, as well as, in the case of an incompressible fluid, or a compressible fluid under pressure. The fluid further provides a means to create hydrostatic pressure in the well bore to prevent influx of gases and fluids.

Thus, in selecting the type of fluid, as well as the fluid delivery system, consideration should be given to, among other things, the laser wavelength, the optics assembly, the geological conditions of the borehole, the depth of the borehole, and the rate of cuttings removal that is needed to remove the cuttings created by the laser's advancement of the borehole. It is highly desirable that the rate of removal of cuttings by the fluid not be a limiting factor to the systems rate of advancing a borehole. For example fluids that may be employed with the present invention include conventional drilling muds, water (provided they are not in the optical path of the laser), and fluids that are transmissive to the laser, such as halocarbons, (halocarbon are low molecular weight polymers of chlorotrifluoroethylene (PCTFE)), oils and $N_2$. Preferably these fluids can be employed and preferred and should be delivered at rates from a couple to several hundred CFM at a pressure ranging from atmospheric to several hundred psi. If combinations of these fluids are used flow rates should be employed to balance the objects of maintaining the trasmissiveness of the optical path and removal of debris.

Preferably the long distance high powered laser beam transmission means is an optical fiber or plurality of optical fibers in an armored casing to conduct optical power from about 1 kW to about 20 kW, from about 10 kW to about 20 kW, at least about 10 kW, and preferably about 20 or more kW average power down into a borehole for the purpose of sensing the lithology, testing the lithology, boring through the lithology and other similar applications relating in general to the creation, advancement and testing of boreholes in the earth. Preferably the armored optical fiber comprises a 0.64 cm (¼") stainless steel tube that has 1, 2, 1 to 10, at least 2, more than 2, at least about 50, at least about 100, and most preferably between 2 to 15 optical fibers in it. Preferably these will be about 500 micron core diameter baseline step index fibers At present it is believed that Industrial lasers use high power optical fibers armored with steel coiled around the fiber and a polymer jacket surrounding the steel jacket to prevent unwanted dust and dirt from entering the optical fiber environment. The optical fibers are coated with a thin coating of metal or a thin wire is run along with the fiber to detect a fiber break. A fiber break can be dangerous because it can result in the rupture of the armor jacket and would pose a danger to an operator. However, this type of fiber protection is designed for ambient conditions and will not withstand the harsh environment of the borehole.

Fiber optic sensors for the oil and gas industry are deployed both unarmored and armored. At present it is believed that the currently available unarmored approaches are unacceptable for the high power applications contemplated by this application. The current manifestations of the armored approach are similarly inadequate, as they do not take into consideration the method for conducting high optical power and the method for detecting a break in the optical fiber, both of which are important for a reliable and safe system. The current method for armoring an optical fiber is to encase it in a stainless steel tube, coat the fiber with carbon to prevent hydrogen migration, and finally fill the tube with a gelatin that both cushions the fiber and absorbs hydrogen from the environment. However this packaging has been performed with only small diameter core optical fibers (50 microns) and with very low power levels <1 Watt optical power.

Thus, to provide for a high power optical fiber that is useful in the harsh environment of a borehole, there is provided a novel armored fiber and method. Thus, it is provided to encase a large core optical fiber having a diameter equal to or greater than 50 microns, equal to or greater than 75 microns and most preferably equal to or greater than 100 microns, or a plurality of optical fibers into a metal tube, where each fiber may have a carbon coating, as well as a polymer, and may include Teflon coating to cushion the fibers when rubbing against each other during deployment. Thus the fiber, or bundle of fibers, can have a diameter of from about greater than or equal to 150 microns to about 700 microns, 700 microns to about 1.5 mm, or greater than 1.5 mm.

The carbon coating can range in thicknesses from 10 microns to >600 microns. The polymer or Teflon coating can range in thickness from 10 microns to >600 microns and preferred types of such coating are acrylate, silicone, polyimide, PFA and others. The carbon coating can be adjacent the fiber, with the polymer or Teflon coating being applied to it. Polymer or Teflon coatings are applied last to reduce binding of the fibers during deployment.

In some non-limiting embodiments, fiber optics may send up to 10 kW per a fiber, up to 20 kW per a fiber, up to and greater than 50 kw per fiber. The fibers may transmit any desired wavelength or combination of wavelengths. In some embodiments, the range of wavelengths the fiber can transmit may preferably be between about 800 nm and 2100 nm. The fiber can be connected by a connector to another fiber to maintain the proper fixed distance between one fiber and neighboring fibers. For example, fibers can be connected such that the beam spot from neighboring optical fibers when irradiating the material, such as a rock surface are under 2" and non-overlapping to the particular optical fiber. The fiber may have any desired core size. In some embodiments, the core size may range from about 50 microns to 1 mm or greater. The fiber can be single mode or multimode. If multimode, the numerical aperture of some embodiments may range from 0.1 to 0.6. A lower numerical aperture may be preferred for beam quality, and a higher numerical aperture may be easier to transmit higher powers with lower interface losses. In some embodiments, a fiber laser emitted light at wavelengths comprised of 1060 nm to 1080 nm, 1530 nm to 1600 nm, 1800 nm to 2100 nm, diode lasers from 800 nm to 2100 nm, $CO_2$ Laser at 10,600 nm, or Nd:YAG Laser emitting at 1064 nm can couple to the optical fibers. In some embodiments, the fiber can have a low water content. The fiber can be jacketed, such as with polyimide, acrylate, carbon polyamide, and carbon/dual acrylate or other material. If requiring high temperatures, a polyimide or a derivative material may be used to operate at temperatures over 300 degrees Celsius. The fibers can be a hollow core photonic crystal or solid core photonic crystal. In some embodiments, using hollow core photonic crystal fibers at wavelengths of 1500 nm or higher may minimize absorption losses.

The use of the plurality of optical fibers can be bundled into a number of configurations to improve power density. The optical fibers forming a bundle may range from two at hundreds of watts to kilowatt powers in each fiber to millions at milliwatts or microwatts of power. In some embodiments, the plurality of optical fibers may be bundled and spliced at powers below 2.5 kW to step down the power. Power can be spliced to increase the power densities through a bundle, such as preferably up to 10 kW, more preferably up to 20 kW, and even more preferably up to or greater than 50 kW. The step down and increase of power allows the beam spot to increase or decrease power density and beam spot sizes through the fiber optics. In most examples, splicing the power to increase total power output may be beneficial so that power delivered through fibers does not reach past the critical power thresholds for fiber optics.

Thus, by way of example there is provided the following configurations set forth in Table 3 herein.

TABLE 3

| Diameter of bundle | Number of fibers in bundle |
|---|---|
| 100 microns | 1 |
| 200 microns-1 mm | 2 to 100 |
| 100 microns-1 mm | 1 |

A thin wire may also be packaged, for example in the ¼" stainless tubing, along with the optical fibers to test the fiber for continuity. Alternatively a metal coating of sufficient thickness is applied to allow the fiber continuity to be monitored. These approaches, however, become problematic as the fiber exceeds 1 km in length, and do not provide a practical method for testing and monitoring.

The configurations in Table 3 can be of lengths equal to or greater than 1 m, equal to or greater than 1 km, equal to or greater than 2 km, equal to or greater than 3 km, equal to or greater than 4 km and equal to or greater than 5 km. These configuration can be used to transmit there through power levels from about 0.5 kW to about 10 kW, from greater than or equal to 1 kW, greater than or equal to 2 kW, greater than or equal to 5 kW, greater than or equal to 8 kW, greater than or equal to 10 kW and preferable at least about 20 kW.

In transmitting power over long distances, such as down a borehole or through a cable that is at least 1 km, there are three sources of power losses in an optical fiber, Raleigh Scattering, Raman Scattering and Brillioun Scattering. The first, Raleigh Scattering is the intrinsic losses of the fiber due to the impurities in the fiber. The second, Raman Scattering can result in Stimulated Raman Scattering in a Stokes or Anti-Stokes wave off of the vibrating molecules of the fiber. Raman Scattering occurs preferentially in the forward direction and results in a wavelength shift of up to +25 nm from the original wavelength of the source. The third mechanism, Brillioun Scattering, is the scattering of the forward propagating pump off of the acoustic waves in the fiber created by the high electric fields of the original source light (pump). This third mechanism is highly problematic and may create great difficulties in transmitting high powers over long distances. The Brillioun Scattering can give rise to Stimulated Brillioun Scattering (SBS) where the pump light is preferentially scattered backwards in the fiber with a frequency shift of approximately 1 to about 20 GHz from the original source frequency. This Stimulated Brillioun effect can be sufficiently strong to backscafter substantially all of the incident pump light if given the right conditions. Therefore it is desirable to suppress this nonlinear phenomenon. There are essentially four primary variables that determine the threshold for SBS: the length of the gain medium (the fiber); the linewidth of the source laser; the natural Brillioun linewidth of the fiber the pump light is propagating in; and, the mode field diameter of the fiber. Under typical conditions and for typical fibers, the length of the fiber is inversely proportional to the power threshold, so the longer the fiber, the lower the threshold. The power threshold is defined as the power at which a high percentage of incident pump radiation will be scattered such that a positive feedback takes place whereby acoustic waves are generated by the scattering process. These acoustic waves then act as a grating to incite further SBS. Once the power threshold is passed, exponential growth of scattered light occurs and the ability to transmit higher power is greatly reduced. This exponential growth continues with an exponential reduction in power until such point whereby any additional power input will not be transmitted forward which point is defined herein as the maximum transmission power. Thus, the maximum transmission power is dependent upon the SBS threshold, but once reached, the maximum transmission power will not increase with increasing power input.

Thus, as provided herein, novel and unique means for suppressing nonlinear scattering phenomena, such as the SBS and Stimulated Raman Scattering phenomena, means for increasing power threshold, and means for increasing the maximum transmission power are set forth for use in transmitting high power laser energy over great distances for, among other things, the advancement of boreholes.

The mode field diameter needs to be as large as practical without causing undue attenuation of the propagating source laser. Large core single mode fibers are currently available with mode diameters up to 30 microns, however bending losses are typically high and propagation losses are higher than desired. Small core step index fibers, with mode field diameters of 50 microns are of interest because of the low intrinsic losses, the significantly reduced launch fluence and the decreased SBS gain because the fiber is not polarization preserving, it also has a multi-mode propagation constant and a large mode field diameter. All of these factors effectively increase the SBS power threshold. Consequently, a larger core fiber with low Raleigh Scattering losses is a potential solution for transmitting high powers over great distances, preferably where the mode field diameter is 50 microns or greater in diameter.

The next consideration is the natural Brillioun linewidth of the fiber. As the Brillioun linewidth increases, the scattering gain factor decreases. The Brillioun linewidth can be broadened by varying the temperature along the length of the fiber, modulating the strain on the fiber and inducing acoustic vibrations in the fiber. Varying the temperature along the fiber results in a change in the index of refraction of the fiber and the background (kT) vibration of the atoms in the fiber effectively broadening the Brillioun spectrum. In down borehole application the temperature along the fiber will vary naturally as a result of the geothermal energy that the fiber will be exposed to as the depths ranges expressed herein. The net result will be a suppression of the SBS gain. Applying a thermal gradient along the length of the fiber could be a means to suppress SBS by increasing the Brillioun linewidth of the fiber. For example, such means could include using a thin film heating element or variable insulation along the length of the fiber to control the actual temperature at each point along the fiber. Applied thermal gradients and temperature distributions can be, but are not limited to, linear, step-graded, and periodic functions along the length of the fiber.

Modulating the strain for the suppression of nonlinear scattering phenomena, on the fiber can be achieved, but those means are not limited to anchoring the fiber in its jacket in such a way that the fiber is strained. By stretching each segment between support elements selectively, then the Brillioun spectrum will either red shift or blue shift from the natural center frequency effectively broadening the spectrum and decreasing the gain. If the fiber is allowed to hang freely from a tensioner, then the strain will vary from the top of the hole to the bottom of the hole, effectively broadening the Brillioun gain spectrum and suppressing SBS. Means for applying strain to the fiber include, but are not limited to, twisting the fiber, stretching the fiber, applying external pressure to the fiber, and bending the fiber. Thus, for example, as discussed above, twisting the fiber can occur through the use of a creel. Moreover, twisting of the fiber may occur through use of downhole stabilizers designed to provide rotational movement. Stretching the fiber can be achieved, for example as described above, by using support elements along the length of the fiber. Downhole pressures may provide a pressure gradient along the length of the fiber thus inducing strain.

Acoustic modulation of the fiber can alter the Brillioun linewidth. By placing acoustic generators, such as piezo crystals along the length of the fiber and modulating them at a predetermined frequency, the Brillioun spectrum can be broadened effectively decreasing the SBS gain. For example, crystals, speakers, mechanical vibrators, or any other mechanism for inducing acoustic vibrations into the fiber may be used to effectively suppress the SBS gain. Additionally, acoustic radiation can be created by the escape of compressed air through predefined holes, creating a whistle effect.

The interaction of the source linewidth and the Brillioun linewidth in part defines the gain function. Varying the linewidth of the source can suppress the gain function and thus suppress nonlinear phenomena such as SBS. The source linewidth can be varied, for example, by FM modulation or closely spaced wavelength combined sources, an example of which is illustrated in FIG. 5. Thus, a fiber laser can be directly FM modulated by a number of means, one method is simply stretching the fiber with a piezo-electric element which induces an index change in the fiber medium, resulting in a change in the length of the cavity of the laser which produces a shift in the natural frequency of the fiber laser. This FM modulation scheme can achieve very broadband modulation of the fiber laser with relatively slow mechanical and electrical components. A more direct method for FM modulating these laser sources can be to pass the beam through a non-linear crystal such as Lithium Niobate, operating in a phase modulation mode, and modulate the phase at the desired frequency for suppressing the gain.

Additionally, a spectral beam combination of laser sources which may be used to suppress Stimulated Brillioun Scattering. Thus the spaced wavelength beams, the spacing as described herein, can suppress the Stimulated Brillioun Scattering through the interference in the resulting acoustic waves, which will tend to broaden the Stimulated Brillioun Spectrum and thus resulting in lower Stimulated Brillioun Gain. Additionally, by utilizing multiple colors the total maximum transmission power can be increased by limiting SBS phenomena within each color. An example of such a laser system is illustrated in FIG. 4.

Raman scattering can be suppressed by the inclusion of a wavelength-selective filter in the optical path. This filter can be a reflective, transmissive, or absorptive filter. Moreover, an optical fiber connector can include a Raman rejection filter. Additionally a Raman rejection filter could be integral to the fiber. These filters may be, but are not limited to, a bulk filter, such as a dichroic filter or a transmissive grating filter, such as a Bragg grating filter, or a reflective grating filter, such as a ruled grating. For any backward propagating Raman energy, as well as, a means to introduce pump energy to an active fiber amplifier integrated into the overall fiber path, is contemplated, which, by way of example, could include a method for integrating a rejection filter with a coupler to suppress Raman Radiation, which suppresses the Raman Gain. Further, Brillioun scattering can be suppressed by filtering as well. Faraday isolators, for example, could be integrated into the system. A Bragg Grating reflector tuned to the Brillioun Scattering frequency could also be integrated into the coupler to suppress the Brillioun radiation.

Figure 7:
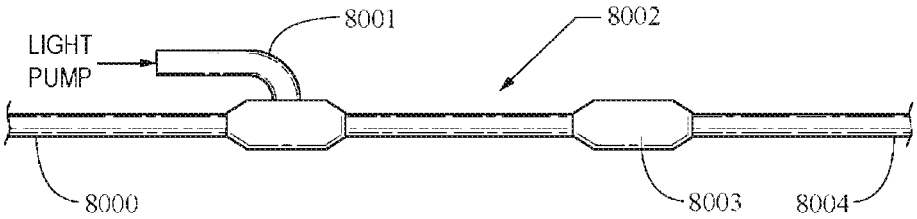
FIG. 7 is a schematic diagram of a laser fiber amplifier.

To overcome power loss in the fiber as a function of distance, active amplification of the laser signal can be used. An active fiber amplifier can provide gain along the optical fiber to offset the losses in the fiber. For example, by combining active fiber sections with passive fiber sections, where sufficient pump light is provided to the active, i.e., amplified section, the losses in the passive section will be offset. Thus, there is provided a means to integrate signal amplification into the system. In FIG. 7 there is illustrated an example of such a means having a first passive fiber section 8000 with, for example, −1 dB loss, a pump source 8001 optically associated with the fiber amplifier 8002, which may be introduced into the outer clad, to provide for example, a +1 dB gain of the propagating signal power. The fiber amplifier 8002 is optically connected to a coupler 8003, which can be free spaced or fused, which is optically connected to a passive section 8004. This configuration may be repeated numerous times, for varying lengths, power losses, and downhole conditions. Additionally, the fiber amplifier could act as the delivery fiber for the entirety of the transmission length. The pump source may be uphole, downhole, or combinations of uphole and downhole for various borehole configurations.

A further method is to use dense wavelength beam combination of multiple laser sources to create an effective linewidth that is many times the natural linewidth of the individual laser effectively suppressing the SBS gain. Here multiple lasers each operating at a predetermined wavelength and at a predetermined wavelength spacing are superimposed on each other, for example by a grating. The grating can be transmissive or reflective.

The optical fiber or fiber bundle can be encased in an environmental shield to enable it to survive at high pressures and temperatures. The cable could be similar in construction to the submarine cables that are laid across the ocean floor and maybe buoyant if the hole is filled with water. The cable may consist of one or many optical fibers in the cable, depending on the power handling capability of the fiber and the power required to achieve economic drilling rates. It being understood that in the field several km of optical fiber will have to be delivered down the borehole. The fiber cables maybe made in varying lengths such that shorter lengths are used for shallower depths so higher power levels can be delivered and consequently higher drilling rates can be achieved. This method requires the fibers to be changed out when transitioning to depths beyond the length of the fiber cable. Alternatively a series of connectors could be employed if the connectors could be made with low enough loss to allow connecting and reconnecting the fiber(s) with minimal losses.

Thus, there is provided in Tables 4 and 5 herein power transmissions for exemplary optical cable configurations.

TABLE 4

| Power in | Length of fiber(s) | Diameter of bundle | # of fibers in bundle | Power out |
|---|---|---|---|---|
| 20 kW | 5 km | 500 microns | 1 | 15 kW |
| 20 kW | 7 km | 500 microns | 1 | 13 kW |
| 20 kW | 5 km | 200 microns-1 mm | 2 to 100 | 15 kW |
| 20 kW | 7 km | 200 microns-1 mm | 2 to 100 | 13 kW |
| 20 kW | 5 km | 100-200 microns | 1 | 10 kW |
| 20 kW | 7 km | 100-200 microns | 1 | 8 kW |

TABLE 5

(with active amplification)

| Power in | Length of fiber(s) | Diameter of bundle | # of fibers in bundle | Power out |
|---|---|---|---|---|
| 20 kW | 5 km | 500 microns | 1 | 17 kW |
| 20 kW | 7 km | 500 microns | 1 | 15 kW |
| 20 kW | 5 km | 200 microns-1 mm | 2 to 100 | 20 kW |
| 20 kW | 7 km | 200 microns-1 mm | 2 to 100 | 18 kW |
| 20 kW | 5 km | 100-200 microns | 1 | 15 kW |
| 20 kW | 7 km | 100-200 microns | 1 | 13 kW |

The optical fibers are preferably placed inside the coiled tubing for advancement into and removal from the borehole. In this manner the coiled tubing would be the primary load bearing and support structure as the tubing is lowered into the well. It can readily be appreciated that in wells of great depth the tubing will be bearing a significant amount of weight because of its length. To protect and secure the optical fibers, including the optical fiber bundle contained in the, for example, ¼" stainless steel tubing, inside the coiled tubing stabilization devices are desirable. Thus, at various intervals along the length of the coiled tubing supports can be located inside the coiled tubing that fix or hold the optical fiber in place relative to the coiled tubing. These supports, however, should not interfere with, or otherwise obstruct, the flow of fluid, if fluid is being transmitted through the coiled tubing. An example of a commercially available stabilization system is the ELECTROCOIL System. These support structures, as described above, may be used to provide strain to the fiber for the suppression of nonlinear phenomena.

Although it is preferable to place the optical fibers within the tubing, the fibers may also be associated with the tubing by, for example, being run parallel to the tubing, and being affixed thereto, by being run parallel to the tubing and being slidably affixed thereto, or by being placed in a second tubing that is associated or not associated with the first tubing. In this way, it should be appreciated that various combinations of tubulars may be employed to optimize the delivery of laser energy, fluids, and other cabling and devices into the borehole. Moreover, the optical fiber may be segmented and employed with conventional strands of drilling pipe and thus be readily adapted for use with a conventional mechanical drilling rig outfitted with connectable tubular drill pipe.

During drilling operations, and in particular during deep drilling operations, e.g., depths of greater than 1 km, it may be desirable to monitor the conditions at the bottom of the borehole, as well as, monitor the conditions along and in the long distance high powered laser beam transmission means. Thus, there is further provided the use of an optical pulse, train of pulses, or continuous signal, that are continuously monitored that reflect from the distal end of the fiber and are used to determine the continuity of the fiber. Further, there is provided for the use of the fluorescence from the illuminated surface as a means to determine the continuity of the optical fiber. A high power laser will sufficiently heat the rock material to the point of emitting light. This emitted light can be monitored continuously as a means to determine the continuity of the optical fiber. This method is faster than the method of transmitting a pulse through the fiber because the light only has to propagate along the fiber in one direction. Additionally there is provided the use of a separate fiber to send a probe signal to the distal end of the armored fiber bundle at a wavelength different than the high power signal and by monitoring the return signal on the high power optical fiber, the integrity of the fiber can be determined.

These monitoring signals may transmit at wavelengths substantially different from the high power signal such that a wavelength selective filter may be placed in the beam path uphole or downhole to direct the monitoring signals into equipment for analysis. For example, this selective filter may be placed in the creel or spool described herein.

To facilitate such monitoring an Optical Spectrum Analyzer or Optical Time Domain Reflectometer or combinations thereof may be used. An AnaritsuMS9710C Optical Spectrum Analyzer having: a wavelength range of 600 nm-1.7 microns; a noise floor of 90 dBm @ 10 Hz, −40 dBm @ 1 MHz; a 70 dB dynamic range at 1 nm resolution; and a maximum sweep width: 1200 nm and an Anaritsu CMA 4500 OTDR may be used.

The efficiency of the laser's cutting action can also be determined by monitoring the ratio of emitted light to the reflected light. Materials undergoing melting, spallation, thermal dissociation, or vaporization will reflect and absorb different ratios of light. The ratio of emitted to reflected light may vary by material further allowing analysis of material type by this method. Thus, by monitoring the ratio of emitted to reflected light material type, cutting efficiency, or both may be determined. This monitoring may be performed uphole, downhole, or a combination thereof.

Moreover, for a variety of purposes such as powering downhole monitoring equipment, electrical power generation may take place in the borehole including at or near the bottom of the borehole. This power generation may take place using equipment known to those skilled in the art, including generators driven by drilling muds or other downhole fluids, means to convert optical to electrical power, and means to convert thermal to electrical power.

The bottom hole assembly contains the laser optics, the delivery means for the fluid and other equipment. In general the bottom hole assembly contains the output end, also referred to as the distal end, of the long distance high power laser beam transmission means and preferably the optics for directing the laser beam to the earth or rock to be removed for advancing the borehole, or the other structure intended to be cut.

The present systems and in particular the bottom hole assembly, may include one or more optical manipulators. An optical manipulator may generally control a laser beam, such as by directing or positioning the laser beam to spall material, such as rock. In some configurations, an optical manipulator may strategically guide a laser beam to spall material, such as rock. For example, spatial distance from a borehole wall or rock may be controlled, as well as the impact angle. In some configurations, one or more steerable optical manipulators may control the direction and spatial width of the one or more laser beams by one or more reflective mirrors or crystal reflectors. In other configurations, the optical manipulator can be steered by an electro-optic switch, electroactive polymers, galvanometers, piezoelectrics, and/or rotary/linear motors. In at least one configuration, an infrared diode laser or fiber laser optical head may generally rotate about a vertical axis to increase aperture contact length. Various programmable values such as specific energy, specific power, pulse rate, duration and the like maybe implemented as a function of time. Thus, where to apply energy may be strategically determined, programmed and executed so as to enhance a rate of penetration and/or laser/rock interaction, to enhance the overall efficiency of borehole advancement, and to enhance the overall efficiency of borehole completion, including reducing the number of steps on the critical path for borehole completion. One or more algorithms may be used to control the optical manipulator.

Figure 8:
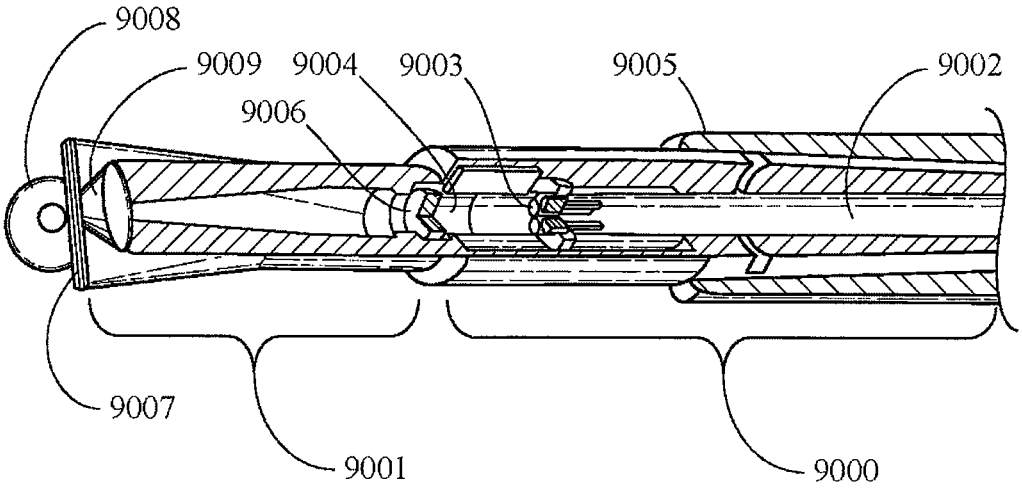
FIG. 8 is a perspective cutaway of a bottom hole assembly.

Thus, by way of example, as illustrated in FIG. 8 the bottom hole assembly comprises an upper part 9000 and a lower part 9001. The upper part 9000 may be connected to the lower end of the coiled tubing, drill pipe, or other means to lower and retrieve the bottom hole assembly from the borehole. Further, it may be connected to stabilizers, drill collars, or other types of downhole assemblies (not shown in the figure) which in turn are connected to the lower end of the coiled tubing, drill pipe, or other means to lower and retrieve the bottom hole assembly from the borehole. The upper part 9000 further contains the means 9002 that transmitted the high power energy down the borehole and the lower end 9003 of the means. In FIG. 8 this means is shown as a bundle of four optical cables. The upper part 9000 may also have air amplification nozzles 9005 that discharge a portion up to 100% of the fluid, for example $N_2$. The upper part 9000 is joined to the lower part 9001 with a sealed chamber 9004 that is transparent to the laser beam and forms a pupil plane for the beam shaping optics 9006 in the lower part 9001. The lower part 9001 may be designed to rotate and in this way for example an elliptical shaped laser beam spot can be rotated around the bottom of the borehole. The lower part 9001 has a laminar flow outlet 9007 for the fluid and two hardened rollers 9008, 9009 at its lower end, although non-laminar flows and turbulent flows may be employed.

In use, the high energy laser beam, for example greater than 10 kW, would travel down the fibers 9002, exit the ends of the fibers 9003 and travel through the sealed chamber and pupil plane 9004 into the optics 9006, where it would be shaped and focused into an elliptical spot. The laser beam would then strike the bottom of the borehole spalling, melting, thermally dissociating, and/or vaporizing the rock and earth struck and thus advance the borehole. The lower part 9001 would be rotating and this rotation would cause the elliptical laser spot to rotate around the bottom of the borehole. This rotation would also cause the rollers 9008, 9009 to physically dislodge any material that was crystallized by the laser or otherwise sufficiently fixed to not be able to be removed by the flow of the fluid alone. The cuttings would be cleared from the laser path by the laminar flow of the fluid, as well as, by the action of the rollers 9008, 9009 and the cuttings would then be carried up the borehole by the action of the fluid from the air amplifier 9005, as well as, the laminar flow opening 9007.

In general, the LBHA may contain an outer housing that is capable of withstanding the conditions of a downhole environment, a source of a high power laser beam, and optics for the shaping and directing a laser beam on the desired surfaces of the borehole, casing, or formation. The high power laser beam may be greater than about 1 kW, from about 2 kW to about 20 kW, greater than about 5 kW, from about 5 kW to about 10 kW, preferably at least about 10 kW, at least about 15 kW, and at least about 20 kW. The assembly may further contain or be associated with a system for delivering and directing fluid to the desired location in the borehole, a system for reducing or controlling or managing debris in the laser beam path to the material surface, a means to control or manage the temperature of the optics, a means to control or manage the pressure surrounding the optics, and other components of the assembly, and monitoring and measuring equipment and apparatus, as well as, other types of downhole equipment that are used in conventional mechanical drilling operations. Further, the LBHA may incorporate a means to enable the optics to shape and propagate the beam which for example would include a means to control the index of refraction of the environment through which the laser is propagating. Thus, as used herein the terms control and manage are understood to be used in their broadest sense and would include active and passive measures as well as design choices and materials choices.

The LBHA should be construed to withstand the conditions found in boreholes including boreholes having depths of about 1,640 ft (0.5 km) or more, about 3,280 ft (1 km) or more, about 9,830 ft (3 km) or more, about 16,400 ft (5 km) or more, and up to and including about 22,970 ft (7 km) or more. While drilling, i.e. advancement of the borehole, is taking place the desired location in the borehole may have dust, drilling fluid, and/or cuttings present. Thus, the LBHA should be constructed of materials that can withstand these pressures, temperatures, flows, and conditions, and protect the laser optics that are contained in the LBHA. Further, the LBHA should be designed and engineered to withstand the downhole temperatures, pressures, and flows and conditions while managing the adverse effects of the conditions on the operation of the laser optics and the delivery of the laser beam.

The LBHA should also be constructed to handle and deliver high power laser energy at these depths and under the extreme conditions present in these deep downhole environments. Thus, the LBHA and its laser optics should be capable of handling and delivering laser beams having energies of 1 kW or more, 5 kW or more, 10 kW or more and 20 kW or more. This assembly and optics should also be capable of delivering such laser beams at depths of about 1,640 ft (0.5 km) or more, about 3,280 ft (1 km) or more, about 9,830 ft (3 km) or more, about 16,400 ft (5 km) or more, and up to and including about 22,970 ft (7 km) or more.

The LBHA should also be able to operate in these extreme downhole environments for extended periods of time. The lowering and raising of a bottom hole assembly has been referred to as tripping in and tripping out. While the bottom hole assembling is being tripped in or out the borehole is not being advanced. Thus, reducing the number of times that the bottom hole assembly needs to be tripped in and out will reduce the critical path for advancing the borehole, i.e., drilling the well, and thus will reduce the cost of such drilling. (As used herein the critical path referrers to the least number of steps that must be performed in serial to complete the well.) This cost savings equates to an increase in the drilling rate efficiency. Thus, reducing the number of times that the bottom hole assembly needs to be removed from the borehole directly corresponds to reductions in the time it takes to drill the well and the cost for such drilling. Moreover, since most drilling activities are based upon day rates for drilling rigs, reducing the number of days to complete a borehole will provided a substantial commercial benefit. Thus, the LBHA and its laser optics should be capable of handling and delivering laser beams having energies of 1 kW or more, 5 kW or more, 10 kW or more and 20 kW or more at depths of about 1,640 ft (0.5 km) or more, about 3,280 ft (1 km) or more, about 9,830 ft (3 km) or more, about 16,400 ft (5 km) or more, and up to and including about 22,970 ft (7 km) or more, for at least about ½ hr or more, at least about 1 hr or more, at least about 2 hours or more, at least about 5 hours or more, and at least about 10 hours or more, and preferably longer than any other limiting factor in the advancement of a borehole. In this way using the LBHA of the present invention could reduce tripping activities to only those that are related to casing and completion activities, greatly reducing the cost for drilling the well.

Thus, in general the cutting removal system may be typical of that used in an oil drilling system. These would include by way of example a shale shaker. Further, desanders and desilters and then centrifuges may be employed. The purpose of this equipment is to remove the cuttings so that the fluid can be recirculated and reused. If the fluid, i.e., circulating medium is gas, than a water misting systems may also be employed.

Figure 9:
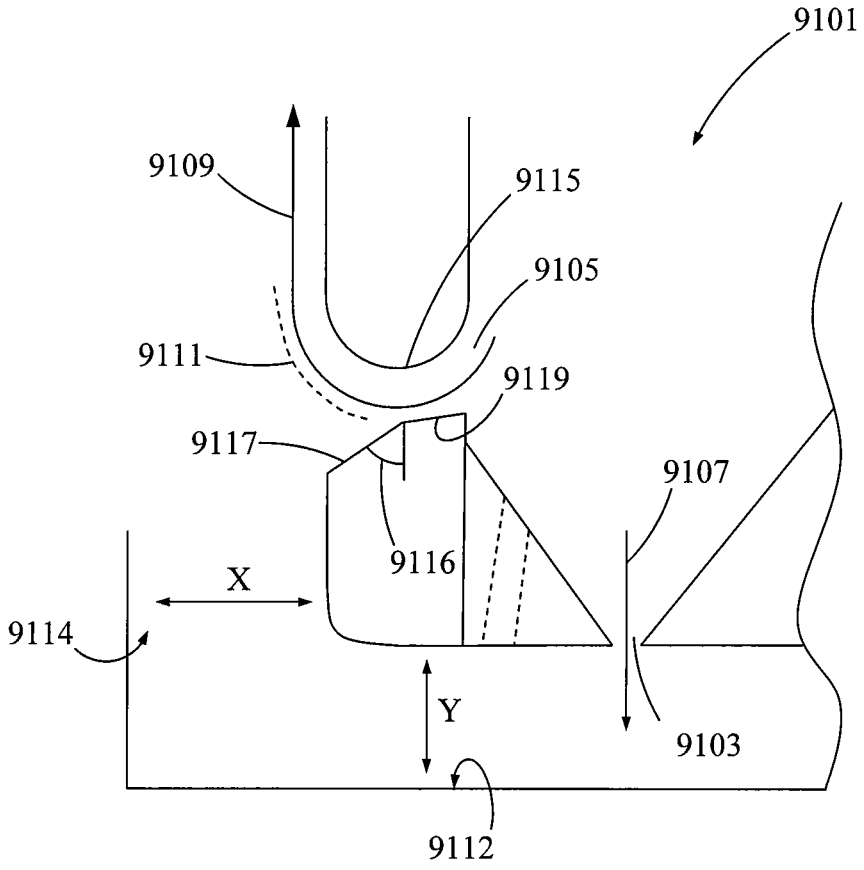
FIG. 9 is a cross sectional view of a portion of an LBHA.

There is provided in FIG. 9 an illustration of an example of a LBHA configuration with two fluid outlet ports shown in the Figure. This example employees the use of fluid amplifiers and in particular for this illustration air amplifier techniques to remove material from the borehole. Thus, there is provided a section of an LBHA 9101, having a first outlet port 9103, and a second outlet port 9105. The second outlet port, as configured, provides a means to amplify air, or a fluid amplification means. The first outlet port 9103 also provides an opening for the laser beam and laser path. There is provided a first fluid flow path 9107 and a second fluid flow path 9109. There is further a boundary layer 9111 associated with the second fluid flow path 9109. The distance between the first outlet 9103 and the bottom of the borehole 9112 is shown by distance y and the distance between the second outlet port 9105 and the side wall of the borehole 9114 is shown by distance x. Having the curvature of the upper side 9115 of the second port 9105 is important to provide for the flow of the fluid to curve around and move up the borehole. Additionally, having the angle 9116 formed by angled surface 9117 of the lower side 9119 is similarly important to have the boundary layer 9111 associate with the fluid flow 9109. Thus, the second flow path 9109 is primarily responsible for moving waste material up and out of the borehole. The first flow path 9117 is primarily responsible for keeping the optical path optically open from debris and reducing debris in that path and further responsible for moving waste material from the area below the LBHA to its sides and a point where it can be carried out of the borehole by second flow 9105.

It is presently believed that the ratio of the flow rates between the first and the second flow paths should be from about 100% for the first flow path, 1:1, 1:10, to 1:100. Further, the use of fluid amplifiers are exemplary and it should be understood that a LBHA, or laser drilling in general, may be employed without such amplifiers. Moreover, fluid jets, air knives, or similar fluid directing means many be used in association with the LBHA, in conjunction with amplifiers or in lieu of amplifiers. A further example of a use of amplifiers would be to position the amplifier locations where the diameter of the borehole changes or the area of the annulus formed by the tubing and borehole change, such as the connection between the LBHA and the tubing. Further, any number of amplifiers, jets or air knifes, or similar fluid directing devices may be used, thus no such devices may be used, a pair of such devices may be used, and a plurality of such devices may be use and combination of these devices may be used. The cuttings or waste that is created by the laser (and the laser-mechanical means interaction) have terminal velocities that must be overcome by the flow of the fluid up the borehole to remove them from the borehole. Thus for example if cuttings have terminal velocities of for sandstone waste from about 4 m/sec. to about 7 m/sec., granite waste from about 3.5 m/sec. to 7 m/sec., basalt waste from about 3 m/sec. to 8 m/sec., and for limestone waste less than 1 m/sec these terminal velocities would have to be overcome.

Figure 10:
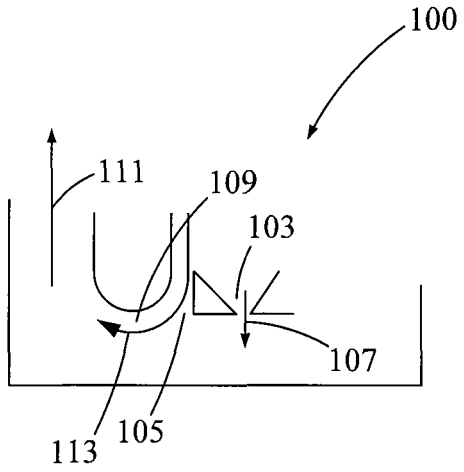
FIG. 10 is a cross sectional view of a portion of an LBHA

In FIG. 10 there is provided an example of a LBHA. Thus there is shown a portion of a LBHA 100, having a first port 103 and a second port 105. In this configuration the second port 105, in comparison to the configuration of the example in FIG. 3, is moved down to the bottom of the LBHA. There second port provides for a flow path 109 that can be viewed has two paths; an essentially horizontal path 113 and a vertical path 111. There is also a flow path 107, which is primarily to keep the laser path optically clear of debris. Flow paths 113 and 107 combine to become part of path 111.

Figure 12:
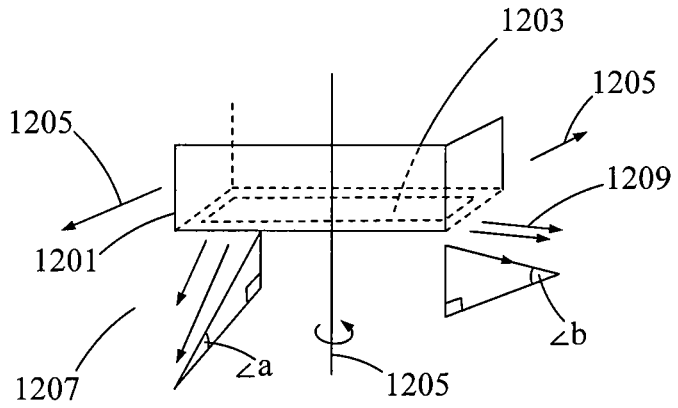
FIG. 12 is a perspective view of a fluid outlet.

There is provided in FIG. 12 an example of a rotating outlet port that may be part of or associated with a LBHA, or employed in laser drilling. Thus, there is provided a port 1201 having an opening 1203. The port rotates in the direction of arrows 1205. The fluid is then expelled from the port in two different angularly directed flow paths. Both flow paths are generally in the direction of rotation. Thus, there is provided a first flow path 1207 and a second flow path 1209. The first flow path has an angle "a" with respect to and relative to the outlet's rotation. The second flow path has an angle "b" with respect to and relative to the outlet's rotation. In this way the fluid may act like a knife or pusher and assist in removal of the material.

The illustrative outlet port of FIG. 12 may be configured to provide flows 1207 and 1209 to be in the opposite direction of rotation, the outlet may be configured to provide flow 1207 in the direction of the rotation and flow 1209 in a direction opposite to the rotation. Moreover, the outlet may be configured to provide a flow angles a and b that are the same or are different, which flow angles can range from 90° to almost 0° and may be in the ranges from about 80° to 10°, about 70° to 20°, about 60° to 30°, and about 50° to 40°, including variations of these where "a" is a different angle and/or direction than "b."

Figure 13:
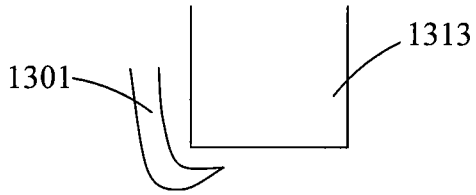
FIG. 13 is a perspective view of an air knife assembly fluid outlet.

There is provided in FIG. 13 an example of an air knife configuration that is associated with a LBHA. Thus, there is provided an air knife 1301 that is associated with a LBHA 1313. In this manner the air knife and its related fluid flow can be directed in a predetermined manner, both with respect to angle and location of the flow. Moreover, in additional to air knives, other fluid directing and delivery devices, such as fluid jets may be employed.

To further illustrate the advantages, uses, operating parameters and applications of the present invention, by way of example and without limitation, the following suggested exemplary studies are proposed.

EXAMPLE 1

Test exposure times of 0.05 s, 0.1 s, 0.2 s, 0.5 s and 1 s will be used for granite and limestone. Power density will be varied by changing the beam spot diameter (circular) and elliptical area of 12.5 mm×0.5 mm with a time-average power of 0.5 kW, 1.6 kW, 3 kW, 5 kW will be used. In addition to continuous wave beam, pulsed power will also be tested for spallation zones.

| Experimental Setup | |
|---|---|
| Fiber Laser | IPG Photonics 5 kW ytterbium-doped multi-clad fiber laser |
| Dolomite/Barre Granite Rock Size | 12" × 12" × 5" or and 5" × 5" × 5" |
| Limestone | 12" × 12" × 5" or and 5" × 5" × 5" |
| Beam Spot Size (or diameter) | 0.3585", 0.0625" (12.5 mm, 0.5 mm), 0.1", |
| Exposure Times | 0.05 s, 0.1 s, 0.2 s, 0.5 s, 1 s |
| Time-average Power | 0.25 kW, 0.5 kW, 1.6 kW, 3 kW, 5 kW |
| Pulse | 0.5 J/pulse to 20 J/pulse at 40 to 600 1/s |

EXAMPLE 2

| The general parameters of Example 1 will be repeated using sandstone and shale. Experimental Setup | |
|---|---|
| Fiber Laser | IPG Photonics 5 kW ytterbium-doped mufti-clad fiber laser |
| Berea Gray (or Yellow) Sandstone | 12" × 12" × 5" and 5" × 5" × 5" |
| Shale | 12" × 12" × 5" and 5" × 5" × 5" |
| Beam Type | CW/Collimated |
| Beam Spot Size (or diameter) | 0.0625" (12.5 mm × 0.5 mm), 0.1" |
| Power | 0.25 kW, 0.5 kW, 1.6 kW, 3 kW, 5 kW |
| Exposure Times | 1 s, 0.5 s. 0.1 s |

EXAMPLE 3

The ability to chip a rectangular block of material, such as rock will be demonstrated in accordance with the systems and methods disclosed herein. The setup is presented in the table below, and the end of the block of rock will be used as a ledge. Blocks of granite, sandstone, limestone, and shale (if possible) will each be spalled at an angle at the end of the block (chipping rock around a ledge). The beam spot will then be moved consecutively to other parts of the newly created ledge from the chipped rock to break apart a top surface of the ledge to the end of the block. Chipping approximately 1"×1"×1" sized rock particles will be the goal. Applied SP and SE will be selected based on previously recorded spallation data and information gleaned from Experiments 1 and 2 presented above. ROP to chip the rock will be determined, and the ability to chip rock to desired specifications will be demonstrated.

| Experimental Setup | |
|---|---|
| Fixed: | |
| Fiber Laser | IPG Photonics 5 kW ytterbium-doped multi-clad fiber laser |
| Dolomite/Barre Granite Rock Size | 12" × 12" × 12" and 12" × 12" × 24" |
| Limestone | 12" × 12" × 12" and 12" × 12" × 24" |
| Berea Gray (or Yellow) Sandstone | 12" × 12" × 12" and 12" × 12" × 24" |
| Shale | 12" × 12" × 12" and 12" × 12" × 24" |
| Beam Type | CW/Collimated and Pulsed at Spallation Zones |
| Specific Power | Spallation zones (920 W/cm2 at ~2.6 kJ/cc for Sandstone & 4 kW/cm2 at ~0.52 kJ/cc for Limestone) |
| Beam Size | 12.5 mm × 0.5 mm |
| Exposure Times | See Experiments 1 & 2 |
| Purging | 189 l/min Nitrogen Flow |

EXAMPLE 4

Multiple beam chipping will be demonstrated. Spalling overlap in material, such as rock resulting from two spaced apart laser beams will be tested. Two laser beams will be run at distances of 0.2", 0.5", 1", 1.5" away from each other, as outlined in the experimental setup below. Granite, sandstone, limestone, and shale will each be used. Rock fractures will be tested by spalling at the determined spalling zone parameters for each material. Purge gas will be accounted for. Rock fractures will overlap to chip away pieces of rock. The goal will be to yield rock chips of the desired 1"×1"×1" size.

Chipping rock from two beams at a spaced distance will determine optimal particle sizes that can be chipped effectively, providing information about particle sizes to spall and ROP for optimization.

| Experimental Setup | |
|---|---|
| Fiber Laser | IPG Photonics 5 kW ytterbium-doped multi-clad fiber laser |
| Dolomite/Barre Granite Rock Size | 5" × 5" × 5" |
| Limestone | 5" × 5" × 5" |
| Berea Gray (or Yellow) Sandstone | 5" × 5" × 5" |
| Shale | 5" × 5" × 5" |
| Beam Type | CW/Collimated or Pulsed at Spallation Zones |
| Specific Power | Spallation zones (~920 W/cm2 at ~2.6 kJ/cc for Sandstone & 4 kW/cm2 at ~0.52 kJ/cc for Limestone) |
| Beam Size | 12.5 mm × 0.5 mm |
| Exposure Times | See Experiments 1 & 2 |
| Purging | 1891/min Nitrogen Flow |
| Distance between two laser beams | 0.2", 0.5", 1", 1.5" |

EXAMPLE 5

Spalling multiple points with multiple beams will be performed to demonstrate the ability to chip material, such as rock in a pattern. Various patterns will be evaluated on different types of rock using the parameters below. Patterns utilizing a linear spot approximately 1 cm×15.24 cm, an elliptical spot with major axis approximately 15.24 cm and minor axis approximately 1 cm, a single circular spot having a diameter of 1 cm, an array of spots having a diameter of 1 cm with the spacing between the spots being approximately equal to the spot diameter, the array having 4 spots spaced in a square, spaced along a line. The laser beam will be delivered to the rock surface in a shot sequence pattern wherein the laser is fired until spallation occurs and then the laser is directed to the next shot in the pattern and then fired until spallation occurs with this process being repeated. In the movement of the linear and elliptical patterns the spots are in effect rotated about their central axis. In the pattern comprising the array of spots the spots may be rotated about their central axis, and rotated about an axis point as in the hands of a clock moving around a face.

| Experimental Setup | |
|---|---|
| Fiber Laser | IPG Photonics 5 kW ytterbium-doped multi-clad fiber laser |
| Dolomite/Barre Granite Rock Size | 12" × 12" × 12" and 12" × 12" × 5" |
| Limestone | 12" × 12" × 12" and 12" × 12" × 5" |
| Berea Gray (or Yellow) Sandstone | 12" × 12" × 12" and 12" × 12" × 5" |
| Shale | 12" × 12" × 12" and 12" × 12" × 5" |
| Beam Type | CW/Collimated or Pulsed at Spallation Zones |
| Specific Power | Spallation zones {~920 W/cm2 at −2.6 kJ/cc for Sandstone & 4 kW/cm2 at ~0.52 kJ/cc for Limestone) |
| Beam Size | 12.5 mm × 0.5 mm |
| Exposure Times | See Experiments 1 & 2 |
| Purging | 189 l/min Nitrogen Flow |

From the foregoing examples and detailed teaching it can be seen that in general one or more laser beams may spall, chip, vaporize, or melt the material, such as rock in a pattern using an optical manipulator. Thus, the rock may be patterned by spalling to form rock fractures surrounding a segment of the rock to chip that piece of rock. The laser beam spot size may spall, vaporize, or melt the rock at one angle when interacting with rock at high power. Further, the optical manipulator system may control two or more laser beams to converge at an angle so as to meet close to a point near a targeted piece of rock. Spallation may then form rock fractures overlapping and surrounding the target rock to chip the target rock and enable removal of larger rock pieces, such as incrementally. Thus, the laser energy may chip a piece of rock up to 1" depth and 1" width or greater. Of course, larger or smaller rock pieces may be chipped depending on factors such as the type of rock formation, and the strategic determination of the most efficient technique.

There is provided by way of examples illustrative and simplified plans of potential drilling scenarios using the laser drilling systems and apparatus of the present invention.

Drilling Plan Example 1

| | Depth | Rock type | Drilling type/Laser power down hole |
|---|---|---|---|
| Drill 17½ inch hole | Surface - 3000 ft | Sand and shale | Conventional mechanical drilling |
| Run 13⅜ inch casing | Length 3000 ft | | |
| Drill 12¼ inch hole | 3000 ft-8,000 ft | basalt | 40 kW (minimum) |
| Run 9⅝ inch casing | Length 8,000 ft | | |
| Drill 8½ inch hole | 8,000 ft-11,000 ft | limestone | Conventional mechanical drilling |
| Run 7 inch casing | Length 11,000 ft | | |
| Drill 6¼ inch hole | 11,000 ft-14,000 ft | Sand stone | Conventional mechanical drilling |
| Run 5 inch liner | Length 3000 ft | | |

Drilling Plan Example 2

| | Depth | Rock type | Drilling type/Laser power down hole |
|---|---|---|---|
| Drill 17½ inch hole | Surface - 500 ft | Sand and shale | Conventional mechanical drilling |
| Run 13⅜ casing | Length 500 ft | | |
| Drill 12¼ hole | 500 ft-4,000 ft | granite | 40 kW (minimum) |
| Run 9⅝ inch casing | Length 4,000 ft | | |
| Drill 8½ inch hole | 4,000 ft-11,000 ft | basalt | 20 kW (minimum) |
| Run 7 inch casing | Length 11,000 ft | | |
| Drill 6¼ inch hole | 11,000 ft-14,000 ft | Sand stone | Conventional mechanical drilling |
| Run 5 inch liner | Length 3000 ft | | |

Moreover, one or more laser beams may form a ledge out of material, such as rock by spalling the rock in a pattern. One or more laser beams may spall rock at an angle to the ledge forming rock fractures surrounding the ledge to chip the piece of rock surrounding the ledge. Two or more beams may chip the rock to create a ledge. The laser beams can spall the rock at an angle to the ledge forming rock fractures surrounding the ledge to further chip the rock. Multiple rocks can be chipped simultaneously by more than one laser beams after one or more rock ledges are created to chip the piece of rock around the ledge or without a ledge by converging two beams near a point by spalling; further a technique known as kerfing may be employed.

In accordance with the teaching of the invention, a fiber laser or liquid crystal laser may be optically pumped in a range from 750 nm to 2100 nm wavelength by an infrared laser diode. A fiber laser or liquid crystal laser may be supported or extend from the infrared laser diode downhole connected by an optical fiber transmitting from infrared diode laser to fiber laser or liquid crystal laser at the infrared diode laser wavelength. The fiber cable may be composed of a material such as silica, PMMA/perfluirnated polymers, hollow core photonic crystals, or solid core photonic crystals that are in single-mode or multimode. Thus, the optical fiber may be encased by a coiled tubing or reside in a rigid drill-string. On the other hand, the light may be transmitted from the infrared diode range from the surface to the fiber laser or liquid crystal laser downhole. One or more infrared diode lasers may be on the surface.

A laser may be conveyed into the wellbore by a conduit made of coiled tubing or rigid drill-string. A power cable may be provided. A circulation system may also be provided. The circulation system may have a rigid or flexible tubing to send a liquid or gas downhole. A second tube may be used to raise the rock cuttings up to the surface. A pipe may send or convey gas or liquid in the conduit to another pipe, tube or conduit. The gas or liquid may create an air knife by removing material, such as rock debris from the laser head. A nozzle, such as a Laval nozzle may be included. For example, a Laval-type nozzle may be attached to the optical head to provide pressurized gas or liquid. The pressurized gas or liquid may be transmissive to the working wavelength of the infrared diode laser or fiber laser light to force drilling muds away from the laser path. Additional tubing in the conduit may send a lower temperature liquid downhole than ambient temperature at a depth to cool the laser in the conduit. One or more liquid pumps may be used to return cuttings and debris to the surface by applying pressure uphole drawing incompressible fluid to the surface.

The drilling mud in the well may be transmissive to visible, near-IR range, and mid-IR wavelengths so that the laser beam has a clear optical path to the rock without being absorbed by the drilling mud.

Further, spectroscopic sample data may be detected and analyzed. Analysis may be conducted simultaneously while drilling from the heat of the rock being emitted. Spectroscopic samples may be collected by laser-induced breakdown derivative spectroscopy. Pulsed power may be supplied to the laser-rock impingement point by the infrared diode laser. The light may be analyzed by a single wavelength detector attached to the infrared diode laser. For example, Raman-shifted light may be measured by a Raman spectrometer. Further, for example, a tunable diode laser using a few-mode fiber Bragg grating may be implemented to analyze the band of frequencies of the fluid sample by using ytterbium, thulium, neodymium, dysprosium, praseodymium, or erbium as the active medium. In some embodiments, a chemometric equation, or least mean square fit may be used to analyze the Raman spectra. Temperature, specific heat, and thermal diffusivity may be determined. In at least one embodiment, data may be analyzed by a neural network. The neural network may be updated real-time while drilling. Updating the diode laser power output from the neural network data may optimize drilling performance through rock formation type.

An apparatus to geo-navigate the well for logging may be included or associated with the drilling system. For example, a magnemometer, 3-axis accelerometer, and/or gyroscope may be provided. As discussed with respect to the laser, the geo-navigation device may be encased, such as with steel, titanium, diamond, or tungsten carbide. The geo-navigation device may be encased together with the laser or independently. In some embodiments, data from the geo-navigation device may direct the directional movement of the apparatus downhole from a digital signal processor.

A high power optical fiber bundle may, by way of example, hang from an infrared diode laser or fiber laser downhole. The fiber may generally be coupled with the diode laser to transmit power from the laser to the rock formation. In at least one embodiment, the infrared diode laser may be fiber coupled at a wavelength range between 800 nm to 1000 nm. In some embodiments, the fiber optical head may not be in contact with the borehole. The optical cable may be a hollow core photonic crystal fiber, silica fiber, or plastic optical fibers including PMMA/perfluorinated polymers that are in single or multimode. In some embodiments, the optical fiber may be encased by a coiled or rigid tubing. The optical fiber may be attached to a conduit with a first tube to apply gas or liquid to circulate the cuttings. A second tube may supply gas or liquid to, for example, a Laval nozzle jet to clear debris from the laser head. In some embodiments, the ends of the optical fibers are encased in a head composed of a steerable optical manipulator and mirrors or crystal reflector. The encasing of the head may be composed of sapphire or a related material. An optical manipulator may be provided to rotate the optical fiber head. In some embodiments, the infrared diode laser may be fully encased by steel, titanium, diamond, or tungsten carbide residing above the optical fibers in the borehole. In other embodiments, it may be partially encased.

Single or multiple fiber optical cables may be tuned to wavelengths of the near-IR, mid-IR, and far-IR received from the infrared diode laser inducement of the material, such as rock for derivative spectroscopy sampling. A second optical head powered by the infrared diode laser above the optical head drilling may case the formation liner. The second optical head may extend from the infrared diode laser with light being transmitted through a fiber optic. In some configurations, the fiber optic may be protected by coiled tubing. The infrared diode laser optical head may perforate the steel and concrete casing. In at least one embodiment, a second infrared diode laser above the first infrared diode laser may case the formation liner while drilling.

In accordance with one or more configurations, a fiber laser or infrared diode laser downhole may transmit coherent light down a hollow tube without the light coming in contact with the tube when placed downhole. The hollow tube may be composed of any material. In some configurations, the hollow tube may be composed of steel, titanium or silica. A mirror or reflective crystal may be placed at the end of the hollow tube to direct collimated light to the material, such as a rock surface being drilled. In some embodiments, the optical manipulator can be steered by an electro-optic switch, electroactive polymers, galvanometers, piezoelectrics, or rotary/linear motors. A circulation system may be used to raise cuttings. One or more liquid pumps may be used to return cuttings to the surface by applying pressure uphole, drawing incompressible fluid to the surface. In some configurations, the optical fiber may be attached to a conduit with two tubes, one to apply gas or liquid to circulate the cuttings and one to supply gas or liquid to a Laval nozzle jet to clear debris from the laser head.

In a further embodiment of the present inventions there is provided a drilling rig for making a borehole in the earth to a depth of from about 1 km to about 5 km or greater, the rig comprising an armored fiber optic delivery bundle, consisting of from 1 to a plurality of coated optical fibers, having a length that is equal to or greater than the depth of the borehole, and having a means to coil and uncoil the bundle while maintaining an optical connection with a laser source. In yet a further embodiment of the present invention there is provided the method of uncoiling the bundle and delivering the laser beam to a point in the borehole and in particular a point at or near the bottom of the borehole. There is further provided a method of advancing the borehole, to depths in excess of 1 km, 2 km, up to and including 5 km, in part by delivering the laser beam to the borehole through armored fiber optic delivery bundle.

The novel and innovative armored bundles and associated coiling and uncoiling apparatus and methods of the present invention, which bundles may be a single or plurality of fibers as set forth herein, may be used with conventional drilling rigs and apparatus for drilling, completion and related and associated operations. The apparatus and methods of the present invention may be used with drilling rigs and equipment such as in exploration and field development activities. Thus, they may be used with, by way of example and without limitation, land based rigs, mobile land based rigs, fixed tower rigs, barge rigs, drill ships, jack-up platforms, and semi-submersible rigs. They may be used in operations for advancing the well bore, finishing the well bore and work over activities, including perforating the production casing. They may further be used in window cutting and pipe cutting and in any application where the delivery of the laser beam to a location, apparatus or component that is located deep in the well bore may be beneficial or useful.

Figure 14A:
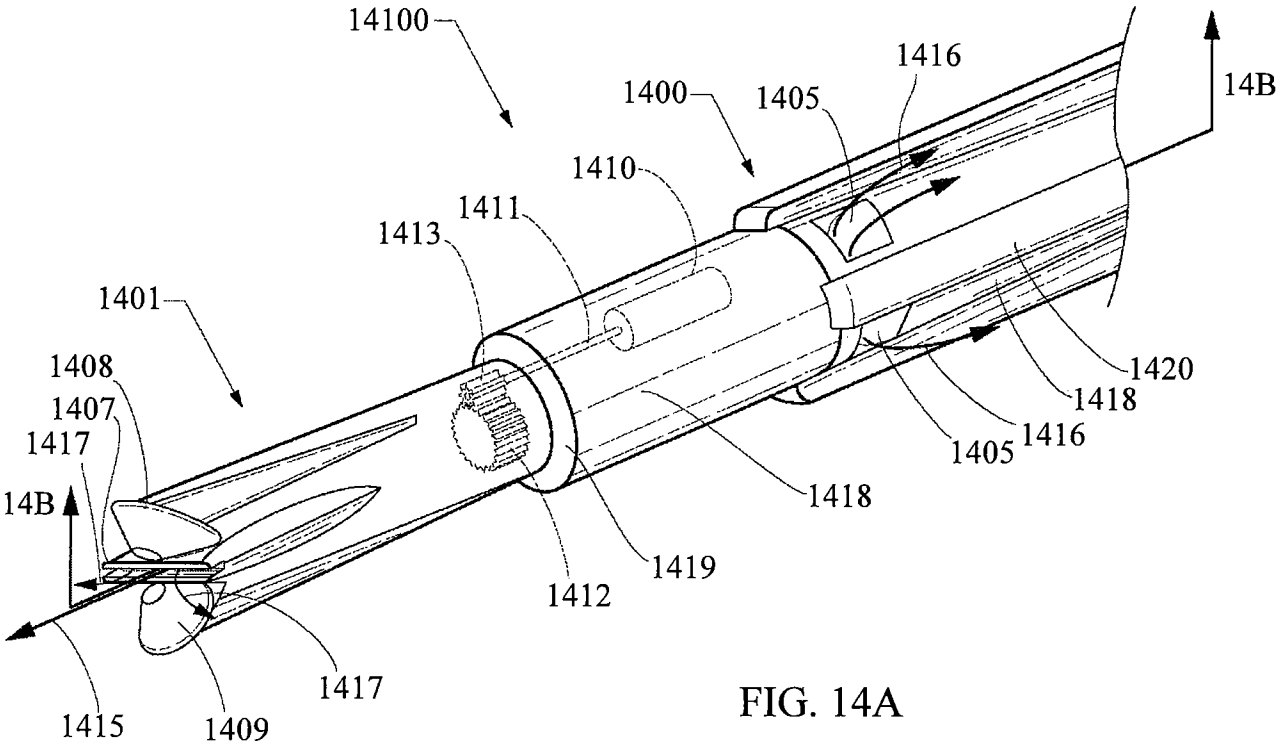
FIG. 14A is a perspective view of an LBHA.
Figure 14B:
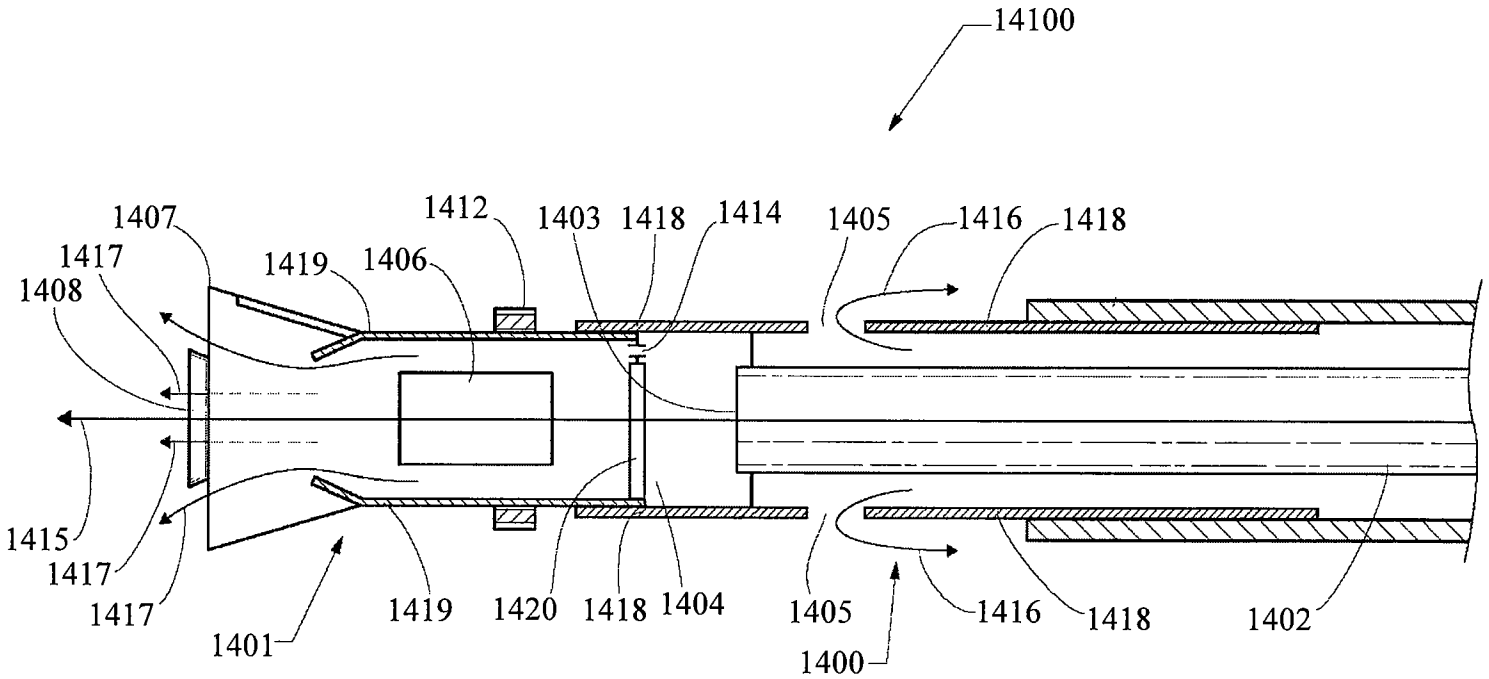
FIG. 14B is a cross sectional view of the LBHA of FIG. 14A taken along B-B.

Thus, by way of example, an LBHA is illustrated in FIGS. 14A and B, which are collectively referred as FIG. 14. There is provided a LBHA 14100, which has an upper part 1400 and a lower part 1401. The upper part 1400 has housing 1418 and the lower part 1401 has housing 1419. The LBHA 14100, the upper part 1400, the lower part 1401 and in particular the housings 1418,1419 should be constructed of materials and designed structurally to withstand the extreme conditions of the deep downhole environment and protect any of the components that are contained within them.

The upper part 1400 may be connected to the lower end of the coiled tubing, drill pipe, or other means to lower and retrieve the LBHA 14100 from the borehole. Further, it may be connected to stabilizers, drill collars, or other types of downhole assemblies (not shown in the figure), which in turn are connected to the lower end of the coiled tubing, drill pipe, or other means to lower and retrieve the LBHA 14100 from the borehole. The upper part 1400 further contains, is connect to, or otherwise optically associated with the means 1402 that transmitted the high power laser beam down the borehole so that the beam exits the lower end 1403 of the means 1402 and ultimately exits the LBHA 14100 to strike the intended surface of the borehole. The beam path of the high power laser beam is shown by arrow 1415. In FIG. 14 the means 1402 is shown as a single optical fiber. The upper part 1400 may also have air amplification nozzles 1405 that discharge the drilling fluid, for example $N_2$, to among other things assist in the removal of cuttings up the borehole.

The upper part 1400 further is attached to, connected to or otherwise associated with a means to provide rotational movement 1410. Such means, for example, would be a downhole motor, an electric motor or a mud motor. The motor may be connected by way of an axle, drive shaft, drive train, gear, or other such means to transfer rotational motion 1411, to the lower part 1401 of the LBHA 14100. It is understood, as shown in the drawings for purposes of illustrating the underlying apparatus, that a housing or protective cowling may be placed over the drive means or otherwise associated with it and the motor to protect it form debris and harsh down hole conditions. In this manner the motor would enable the lower part 1401 of the LBHA 14100 to rotate. An example of a mud motor is the CAVO 1.7" diameter mud motor. This motor is about 7 ft long and has the following specifications: 7 horsepower @ 110 ft-lbs full torque; motor speed 0-700 rpm; motor can run on mud, air, $N_2$, mist, or foam; 180 SCFM, 500-800 psig drop; support equipment extends length to 12 ft; 10:1 gear ratio provides 0-70 rpm capability; and has the capability to rotate the lower part 1401 of the LBHA through potential stall conditions.

The upper part 1400 of the LBHA 14100 is joined to the lower part 1401 with a sealed chamber 1404 that is transparent to the laser beam and forms a pupil plane 1420 to permit unobstructed transmission of the laser beam to the beam shaping optics 1406 in the lower part 1401. The lower part 1401 is designed to rotate. The sealed chamber 1404 is in fluid communication with the lower chamber 1401 through port 1414. Port 1414 may be a one way valve that permits clean transmissive fluid and preferably gas to flow from the upper part 1400 to the lower part 1401, but does not permit reverse flow, or if may be another type of pressure and/or flow regulating value that meets the particular requirements of desired flow and distribution of fluid in the downhole environment. Thus, for example there is provided in FIG. 14 a first fluid flow path, shown by arrows 1416, and a second fluid flow path, shown by arrows 1417. In the example of FIG. 14 the second fluid flow path is a laminar flow although other flows including turbulent flows may be employed.

The lower part 1401 has a means for receiving rotational force from the motor 1410, which in the example of the figure is a gear 1412 located around the lower part housing 1419 and a drive gear 1413 located at the lower end of the axle 1411. Other means for transferring rotational power may be employed or the motor may be positioned directly on the lower part. It being understood that an equivalent apparatus may be employed which provide for the rotation of the portion of the LBHA to facilitate rotation or movement of the laser beam spot while that he same time not providing undue rotation, or twisting forces, to the optical fiber or other means transmitting the high power laser beam down the hole to the LBHA. In his way laser beam spot can be rotated around the bottom of the borehole. The lower part 1401 has a laminar flow outlet 1407 for the fluid to exit the LBHA 14100, and two hardened rollers 1408, 1409 at its lower end. Although a laminar flow is contemplated in this example, it should be understood that non-laminar flows, and turbulent flows may also be employed.

The two hardened rollers may be made of a stainless steel or a steel with a hard face coating such as tungsten carbide, chromium-cobalt-nickel alloy, or other similar materials. They may also contain a means for mechanically cutting rock that has been thermally degraded by the laser. They may range in length, i.e., from about 1 in to about 4 in and preferably are about 2-3 in and may be as large as or larger than 6 inches. Moreover in LBHAs for drilling larger diameter boreholes they may be in the range of 10-20 inches in diameter or greater.

Thus, FIG. 14 provides for a high power laser beam path 1415 that enters the LBHA 14100, travels through beam spot shaping optics 1406, and then exits the LBHA to strike its intended target on the surface of a borehole. Further, although it is not required, the beam spot shaping optics may also provide a rotational element to the spot, and if so, would be considered to be beam rotational and shaping spot optics.

In use the high energy laser beam, for example greater than 15 kW, would enter the LBHA 14100, travel down fiber 1402, exit the end of the fiber 1403 and travel through the sealed chamber 1404 and pupil plane 1420 into the optics 1406, where it would be shaped and focused into a spot, the optics 1406 would further rotate the spot. The laser beam would then illuminate, in a potentially rotating manner, the bottom of the borehole spalling, chipping, melting, and/or vaporizing the rock and earth illuminated and thus advance the borehole. The lower part would be rotating and this rotation would further cause the rollers 1408, 1409 to physically dislodge any material that was effected by the laser or otherwise sufficiently fixed to not be able to be removed by the flow of the drilling fluid alone.

The cuttings would be cleared from the laser path by the flow of the fluid along the path 1417, as well as, by the action of the rollers 1408, 1409 and the cuttings would then be carried up the borehole by the action of the drilling fluid from the air amplifiers 1405, as well as, the laminar flow opening 1407.

It is understood that the configuration of the LBHA is FIG. 14 is by way of example and that other configurations of its components are available to accomplish the same results. Thus, the motor may be located in the lower part rather than the upper part, the motor may be located in the upper part but only turn the optics in the lower part and not the housing. The optics may further be located in both the upper and lower parts, which the optics for rotation being positioned in that part which rotates. The motor may be located in the lower part but only rotate the optics and the rollers. In this later configuration the upper and lower parts could be the same, i.e., there would only be one part to the LBHA. Thus, for example the inner portion of the LBHA may rotate while the outer portion is stationary or vice versa, similarly the top and/or bottom portions may rotate or various combinations of rotating and non-rotating components may be employed, to provide for a means for the laser beam spot to be moved around the bottom of the borehole.

The optics 1406 should be selected to avoid or at least minimize the loss of power as the laser beam travels through them. The optics should further be designed to handle the extreme conditions present in the downhole environment, at least to the extent that those conditions are not mitigated by the housing 1419. The optics may provide laser beam spots of differing power distributions and shapes as set forth herein above. The optics may further provide a sign spot or multiple spots as set forth herein above.

Drilling may be conducted in a dry environment or a wet environment. An important factor is that the path from the laser to the rock surface should be kept as clear as practical of debris and dust particles or other material that would interfere with the delivery of the laser beam to the rock surface. The use of high brightness lasers provides another advantage at the process head, where long standoff distances from the last optic to the work piece are important to keeping the high pressure optical window clean and intact through the drilling process. The beam can either be positioned statically or moved mechanically, opto-mechanically, electro-optically, electromechanically, or any combination of the above to illuminate the earth region of interest.

In general, and by way of further example, the LBHA may comprise a housing, which may by way of example, be made up of sub-housings. These sub-housings may be integral, they may be separable, they may be removably fixedly connected, they may be rotatable, or there may be any combination of one or more of these types of relationships between the sub-housings. The LBHA may be connected to the lower end of the coiled tubing, drill pipe, or other means to lower and retrieve the LBHA from the borehole. Further, it may be connected to stabilizers, drill collars, or other types of down-hole assemblies, which in turn are connected to the lower end of the coiled tubing, drill pipe, or other means to lower and retrieve the bottom hole assembly from the borehole. The LBHA has associated therewith a means that transmitted the high power energy from down the borehole.

The LBHA may also have associated with, or in, it means to handle and deliver drilling fluids. These means may be associated with some or all of the sub-housings. There are further provided mechanical scraping means, e.g. a PDC bit, to remove and/or direct material in the borehole, although other types of known bits and/or mechanical drilling heads by also be employed in conjunction with the laser beam. These scrapers or bits may be mechanically interacted with the surface or parts of the borehole to loosen, remove, scrap or manipulate such borehole material as needed. These scrapers may be from less than about 1 in to about 20 in. In use the high energy laser beam, for example greater than 15 kW, would travel down the fibers through optics and then out the lower end of the LBHA to illuminate the intended part of the borehole, or structure contained therein, spalling, melting and/or vaporizing the material so illuminated and thus advance the borehole or otherwise facilitating the removal of the material so illuminated.

Figure 15A:
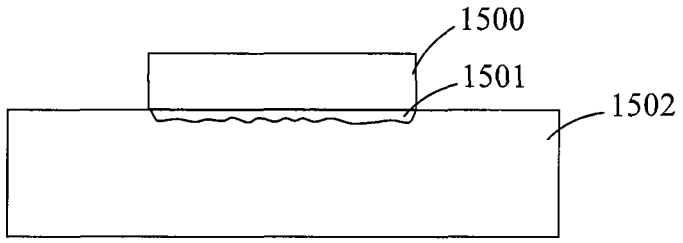
FIGS. 15A and 15B, is a graphic representation of an example of a laser beam basalt illumination.
Figure 15B:
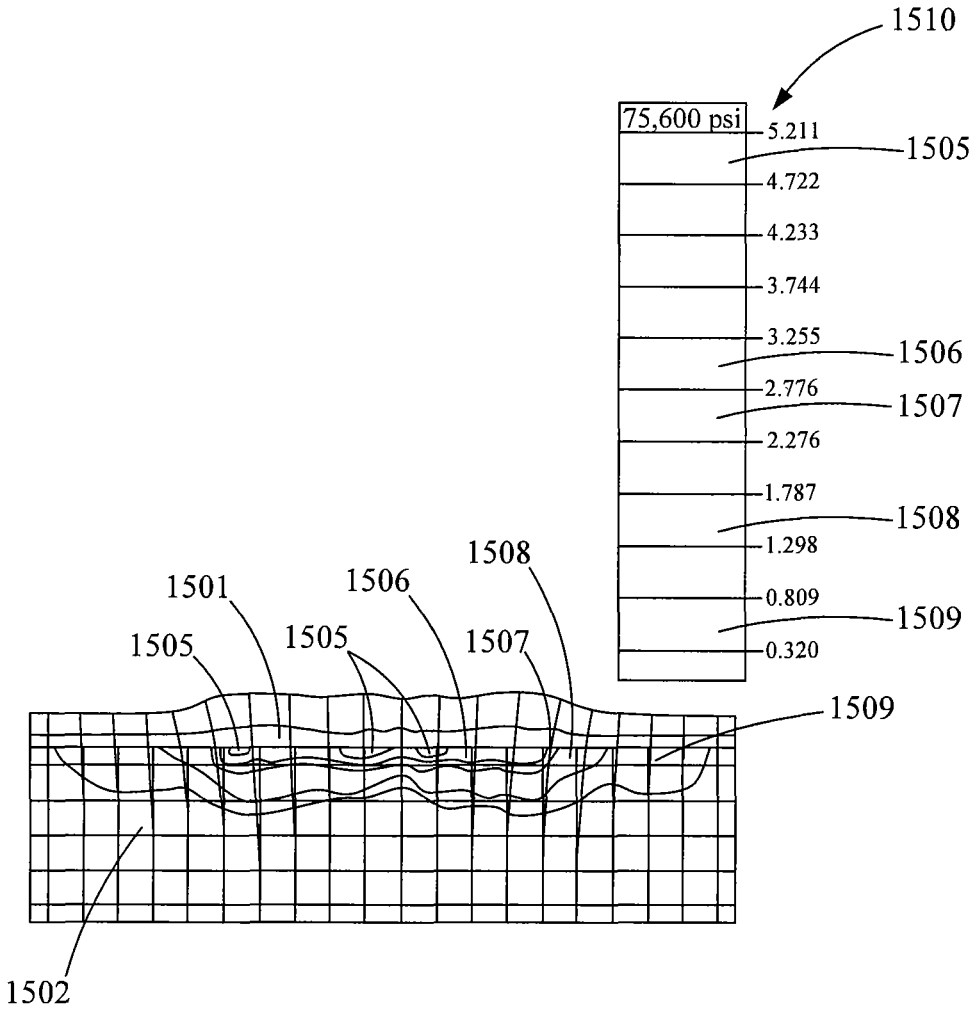

In FIGS. 15A and 15B, there is provided a graphic representation of an example of a laser beam-borehole surface interaction. Thus, there is shown a laser beam 1500, an area of beam illumination 1501, i.e., a spot (as used herein unless expressly provided otherwise the term "spot" is not limited to a circle), on a borehole wall or bottom 1502. There is further provided in FIG. 1B a more detailed representation of the interaction and a corresponding chart 1510 categorizing the stress created in the area of illumination. Chart 1510 provides von Mises Stress in $\sigma_M$ $10^8$ N/m$^2$ wherein the cross hatching and shading correspond to the stress that is created in the illuminated area for a 30 mill-second illumination period, under down hole conditions of 2000 psi and a temperature of 150 F, with a beam having a fluence of 2 kW/cm$^2$. Under these conditions the compressive strength of basalt is about $2.6\times10^8$ N/m$^2$, and the cohesive strength is about $0.66\times10^8$ N/m$^2$. Thus, there is shown a first area 1505 of relative high stress, from about 4.722 to $5.211\times10^8$ N/m$^2$, a second area 1506 of relative stress at or exceeding the compressive stress of basalt under the downhole conditions, from about 2.766 to $3.255\times10^8$ N/m$^2$, a third area 1507 of relative stress about equal to the compressive stress of basalt under the downhole conditions, from about 2.276 to $2.766\times10^8$ N/m$^2$, a fourth area 1508 of relative lower stress that is below the compressive stress of basalt under the downhole conditions yet greater than the cohesive strength, from about 2.276 to $2.766\times10^8$ N/m$^2$, and a fifth area 1509 of relative stress that is at or about the cohesive strength of basalt under the downhole conditions, from about 0.320 to $0.899\times10^8$ N/m$^2$.

Figure 16A:
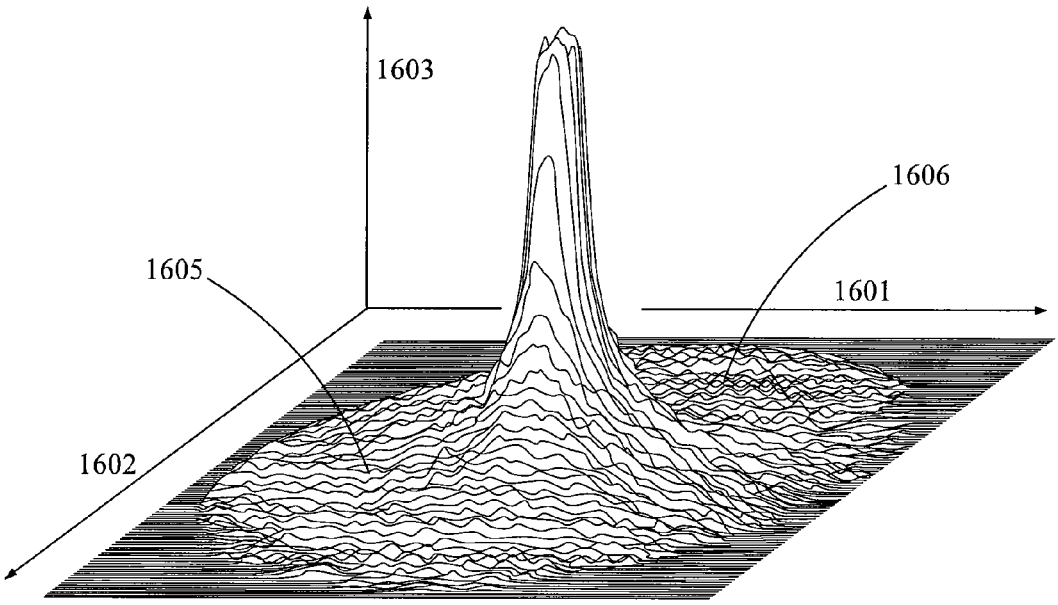
FIGS. 16A and 16B illustrate the energy deposition profile of an elliptical spot rotated about its center point for a beam that is either uniform or Gaussian.
Figure 16B:
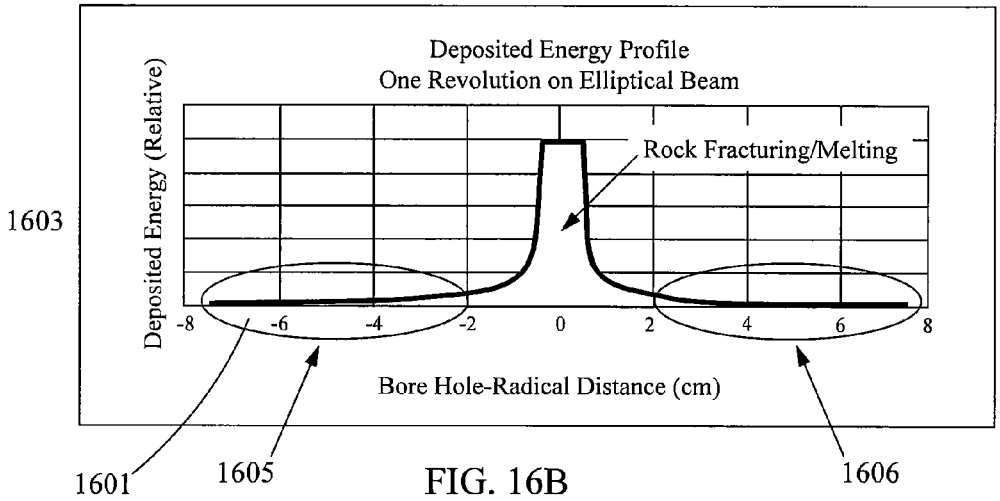

Accordingly, the profiles of the beam interaction with the borehole to obtain a maximum amount of stress in the borehole in an efficient manner, and thus, increase the rate of advancement of the borehole can be obtained. Thus, for example if an elliptical spot is rotated about its center point for a beam that is either uniform or Gaussian the energy deposition profile is illustrated in FIGS. 16A and 16B. Where the area of the borehole from the center point of the beam is shown as x and y axes 1601 and 1602 and the amount of energy deposited is shown on the z axis 1603. From this it is seen that inefficiencies are present in the deposition of energy to the borehole, with the outer sections of the borehole 1605 and 1606 being the limiting factor in the rate of advancement.

Figure 17A:
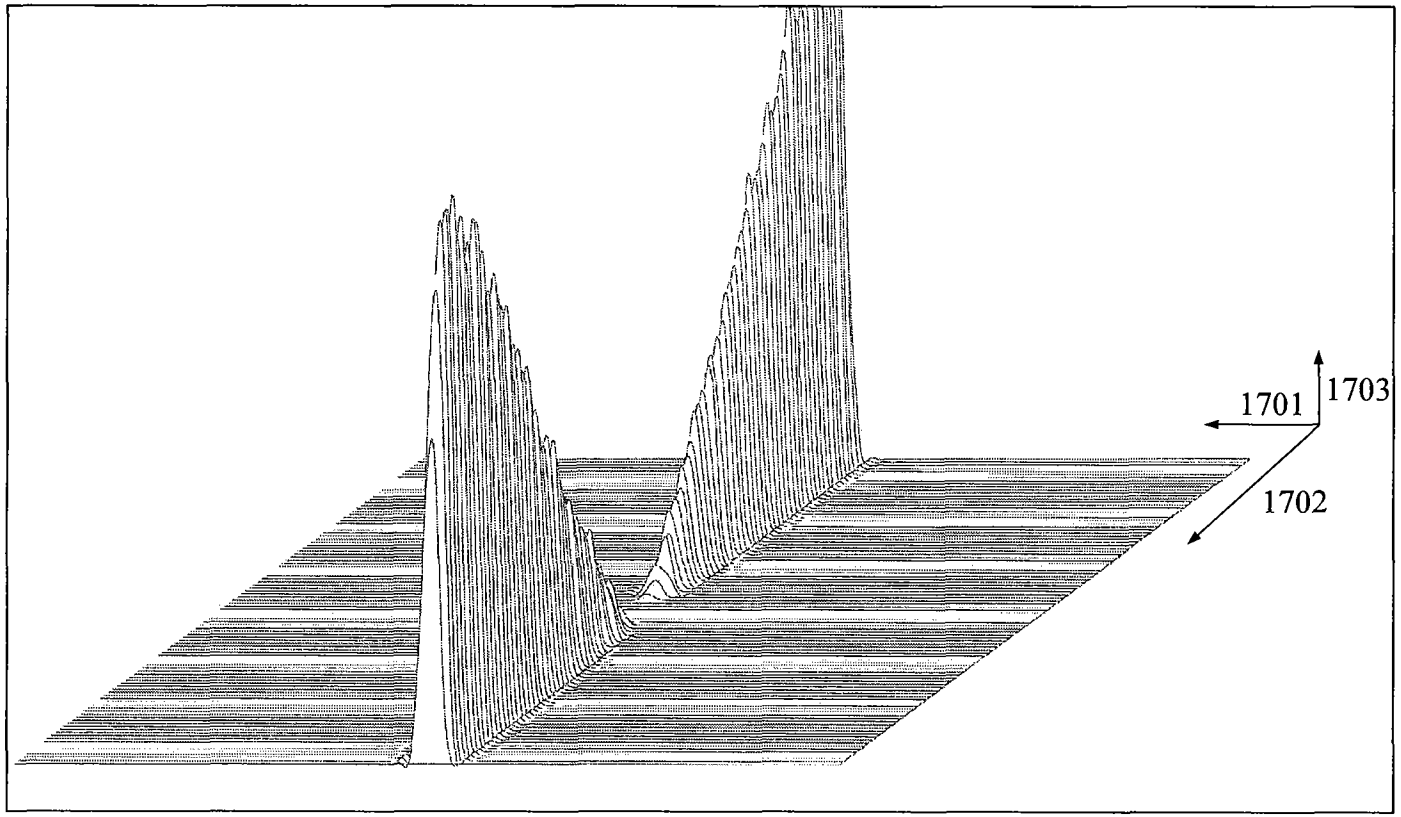
FIG. 17A shows the energy deposition profile with no rotation.
Figure 17B:
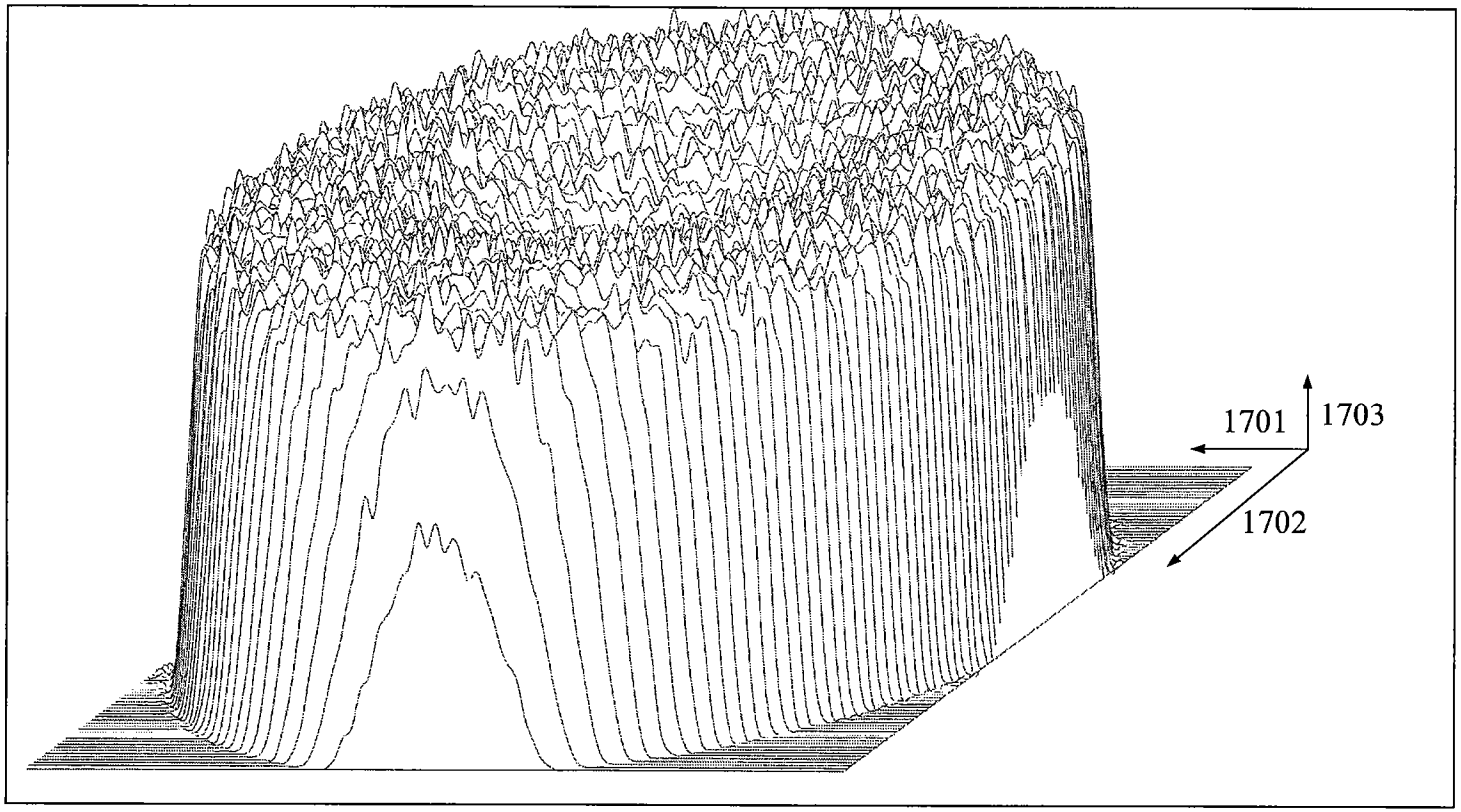
FIG. 17B shows the substantially even and uniform energy deposition profile upon rotation of the beam that provides the energy deposition profile of FIG. 17A.
Figure 18A:
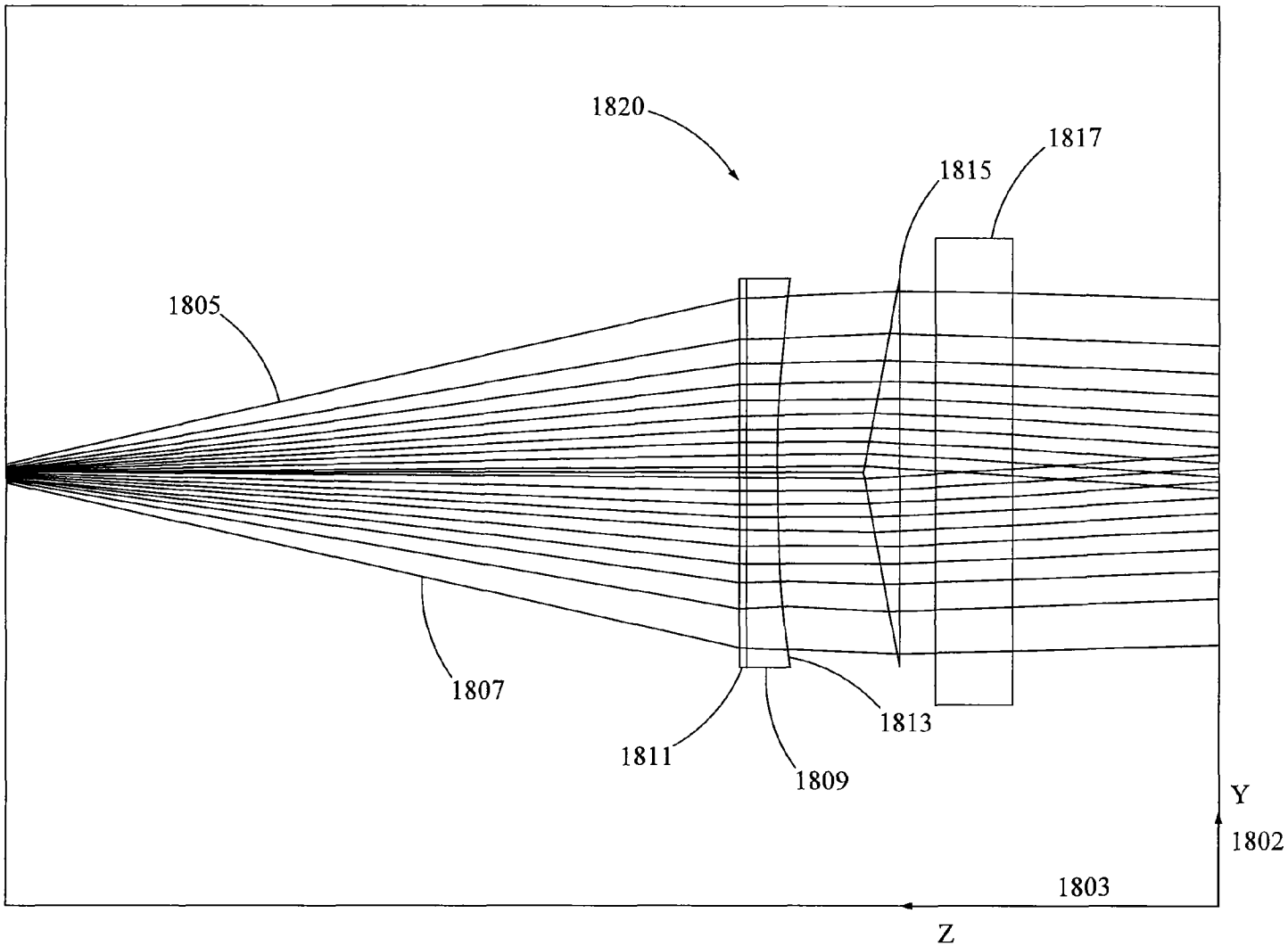
FIGS. 18A to 18D illustrate an optical assembly.
Figure 18B:
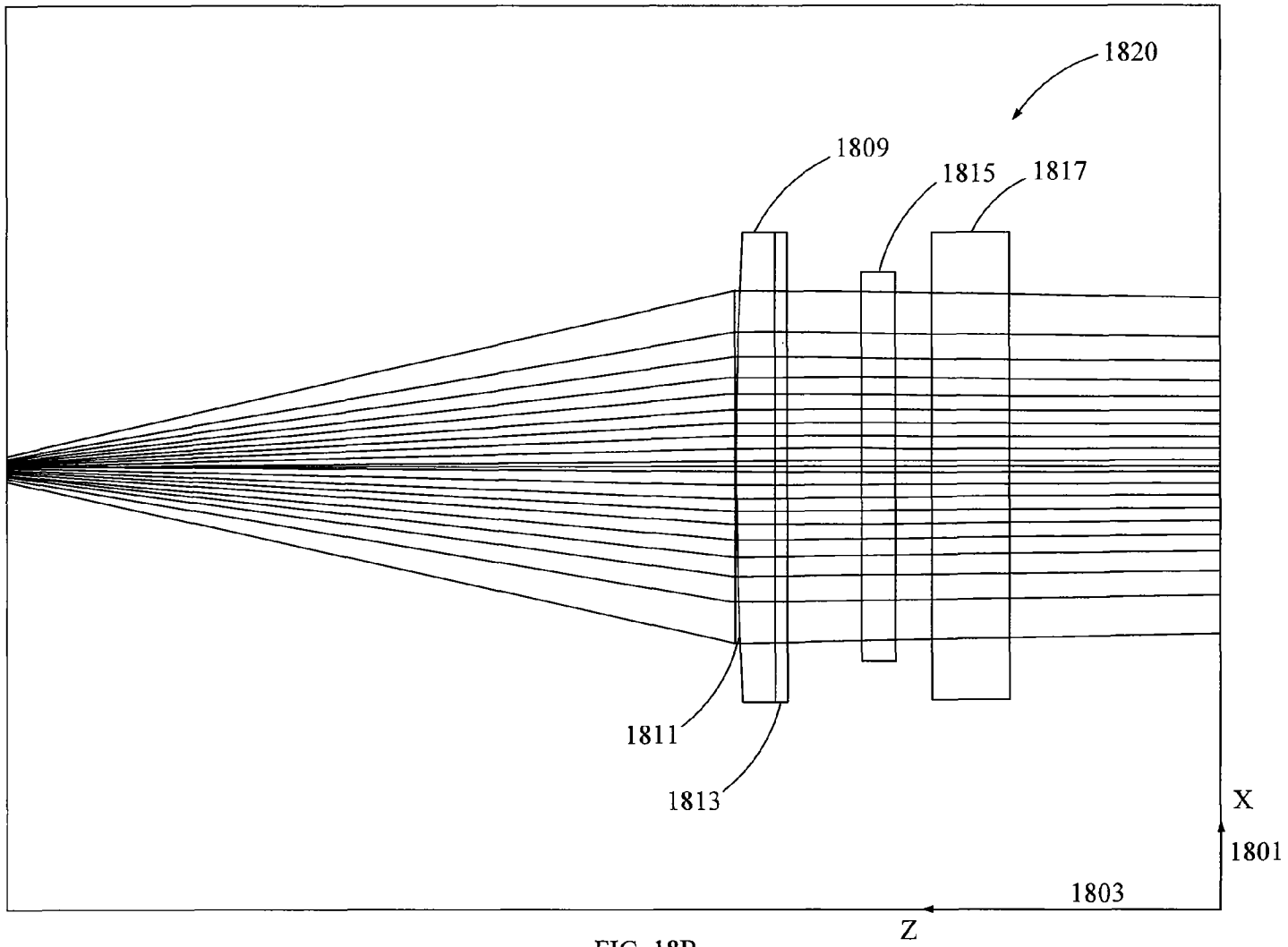
Figure 18C:
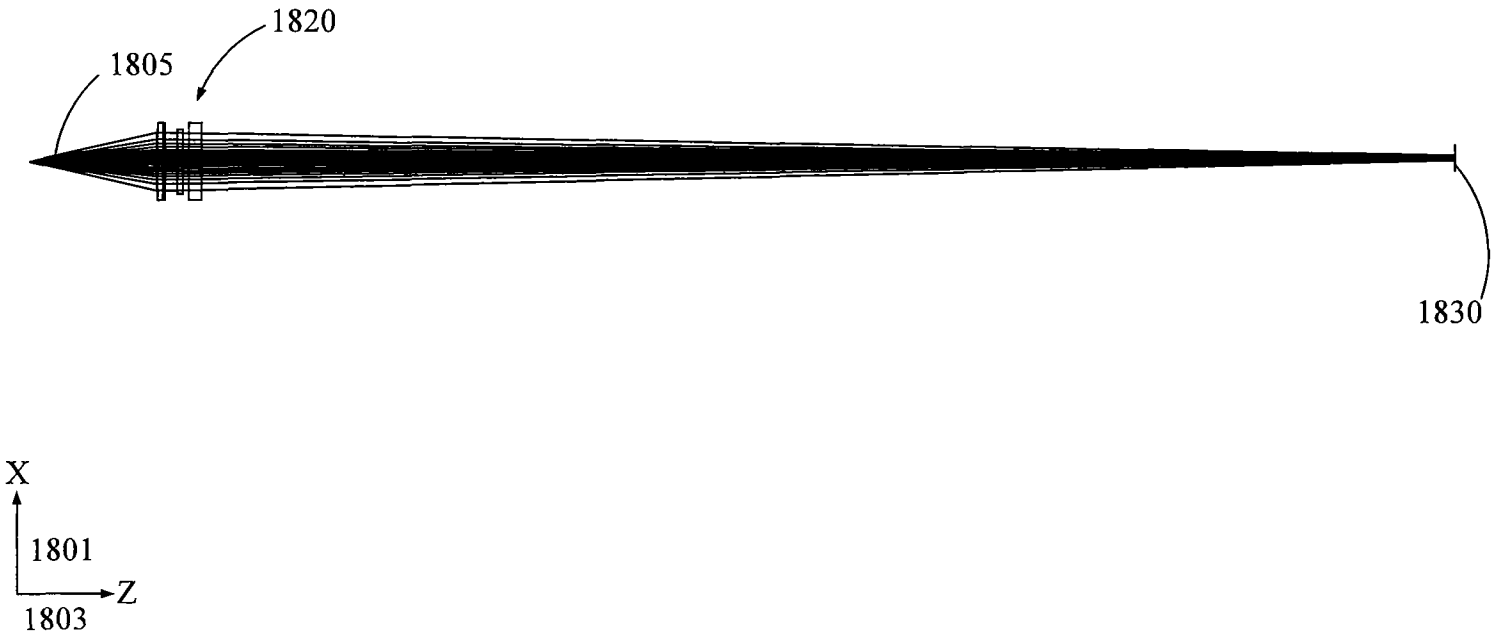
Figure 18D:
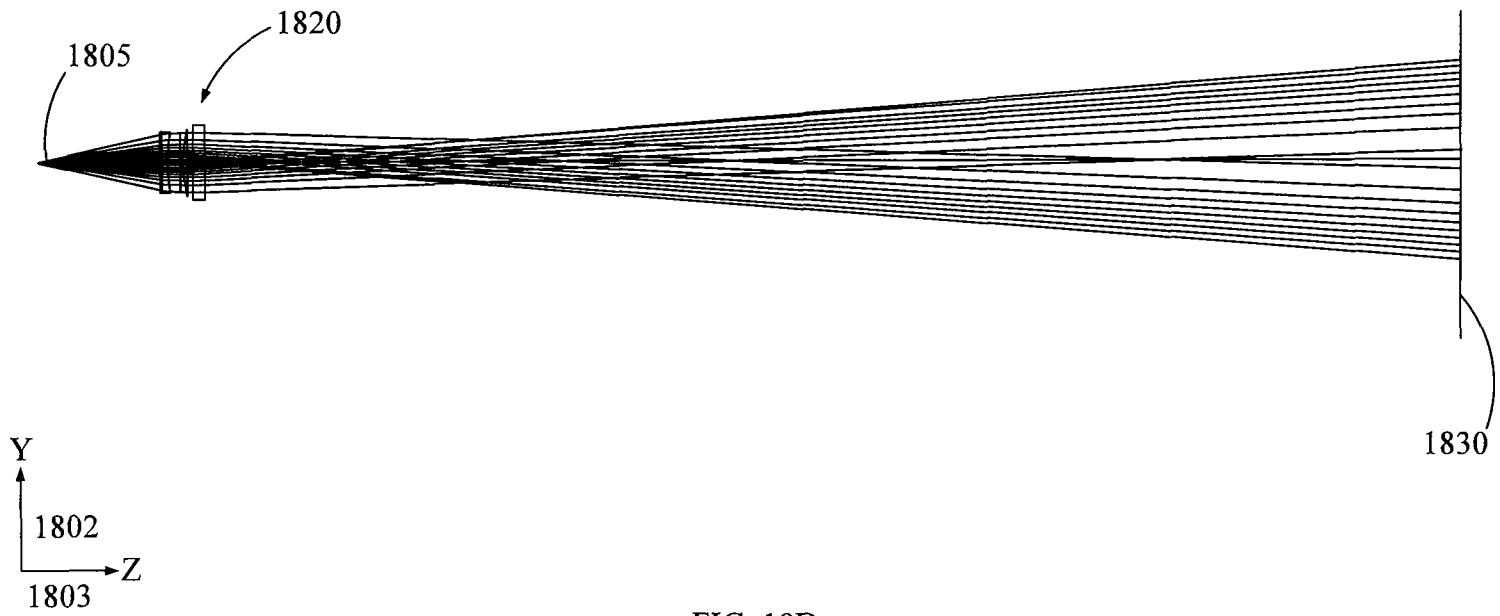

Thus, it is desirable to modify the beam deposition profile to obtain a substantially even and uniform deposition profile upon rotation of the beam. An example of such a preferred beam deposition profile is provided in FIG. 17A and 17B, where FIG. 17A shows the energy deposition profile with no rotation, and FIG. 17B shows the energy deposition profile when the beam profile of 17A is rotated through one rotation, i.e., 360 degrees; having x and y axes 1701 and 1702 and energy on z axis 1703. This energy deposition distribution would be considered substantially uniform.

To obtain this preferable beam energy profile there are provided examples of optical assemblies that may be used with a LBHA. Thus, an example is illustrated in FIGS. 18A to 18D, having x and y axes 1801 and 1802 and z axis 1803, wherein there is provided a laser beam 1805 having a plurality of rays 1807. The laser beam 1805 enters an optical assembly 1820, having a culminating lens 1809, having input curvature 1811 and an output curvature 1813. There is further provided an axicon lens 1815 and a window 1817. The optical assembly of Example 1 would provide a desired beam intensity profile from an input beam having a substantially Gaussian, Gaussian, or super-Gaussian distribution for applying the beam spot to a borehole surface 1830.

Figure 19:
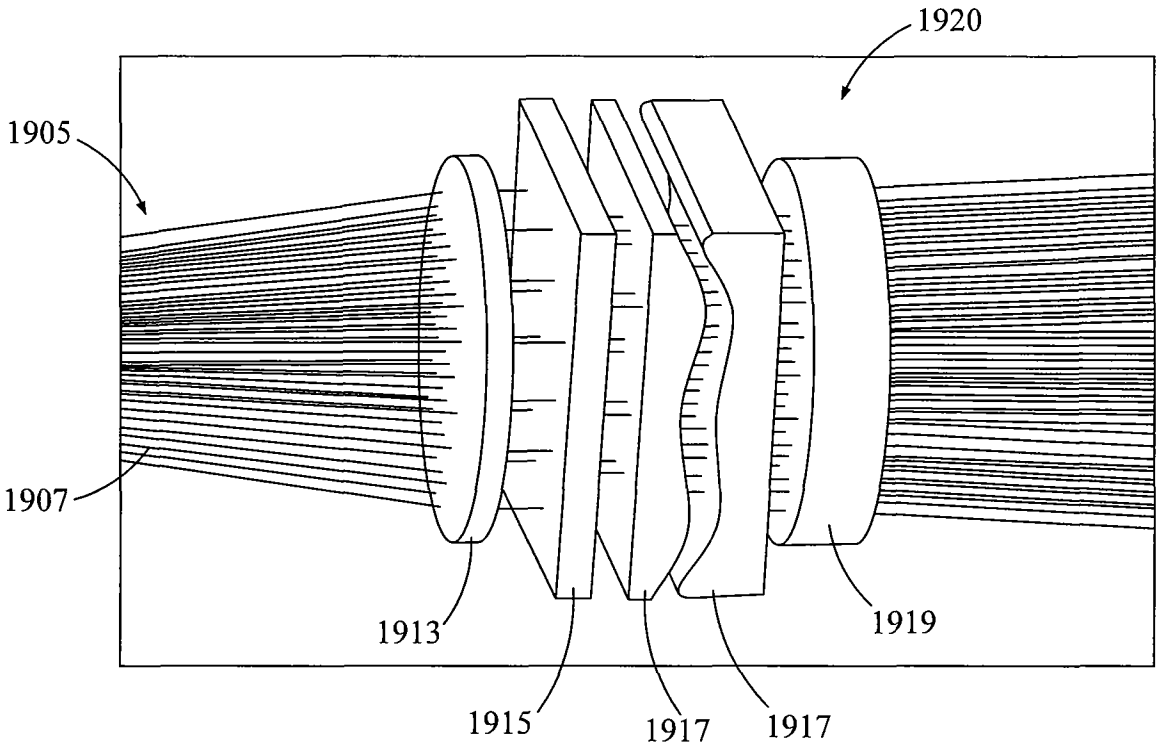
FIG. 19 illustrates an optical assembly.

A further example is illustrated in FIG. 19 and has an optical assembly 1920 for providing the desired beam intensity profile of FIGS. 17A and energy deposition of FIG. 17B to a borehole surface from a laser beam having a uniform distribution. Thus, there is provided in this example a laser beam 1905 having a uniform profile and rays 1907, that enters a spherical lens 1913, which collimates the output of the laser from the downhole end of the fiber, the beam then exits 1913 and enters a toroidal lens 1915, which has power in the x-axis to form the minor-axis of the elliptical beam. The beam then exits 1915 and enters a pair of aspherical toroidal lens 1917, which has power in the y-axis to map the y-axis intensity profiles form the pupil plane to the image plane. The beam then exits the lens 1917 and enters flat window 1919, which protects the optics from the outside environment.

Figure 20:
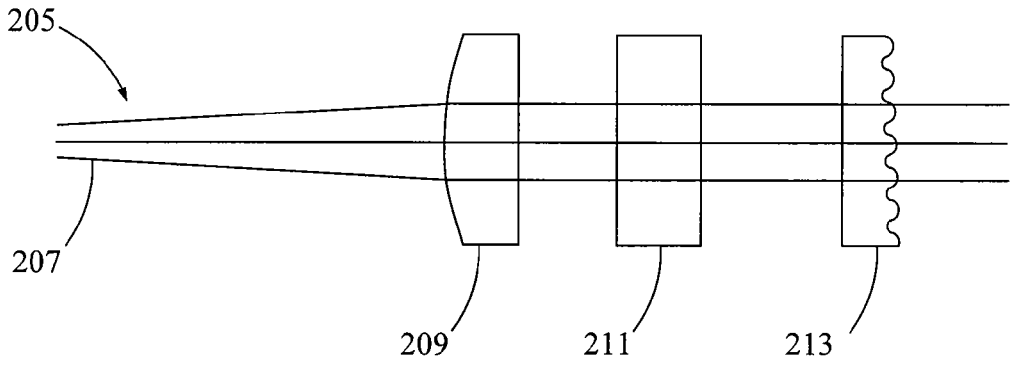
FIG. 20 illustrates an optical assembly.

A further example is illustrated in FIG. 20, which provides a further optical assembly for providing predetermined beam energy profiles. Thus, there is provided a laser beam 205 having rays 207, which enters collimating lens 209, spot shape forming lens 211, which is preferably an ellipse, and a micro optic array 213. The micro optic array 213 may be a micro-prism array, or a micro lens array. Further the micro optic array may be specifically designed to provide a predetermined energy deposition profile, such as the profile of FIGS. 17.

Figure 21A:
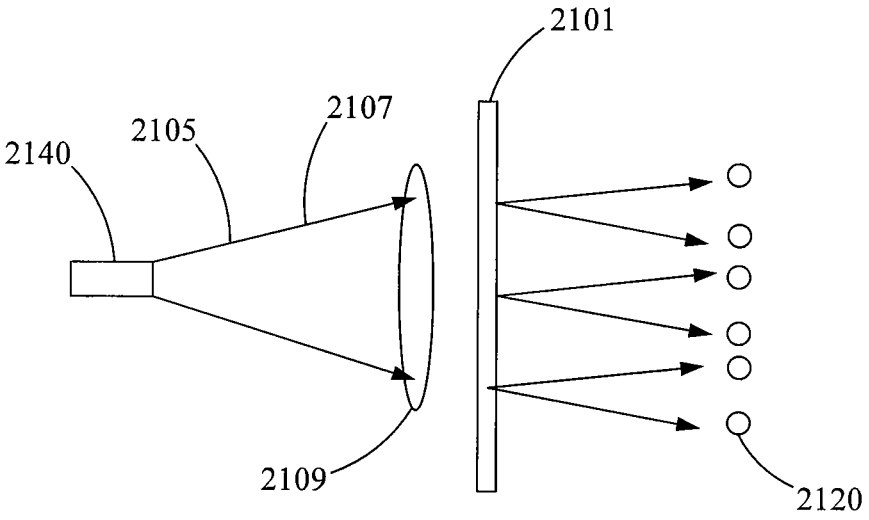
FIGS. 21A and 21B illustrate an optical assembly.
Figure 21B:
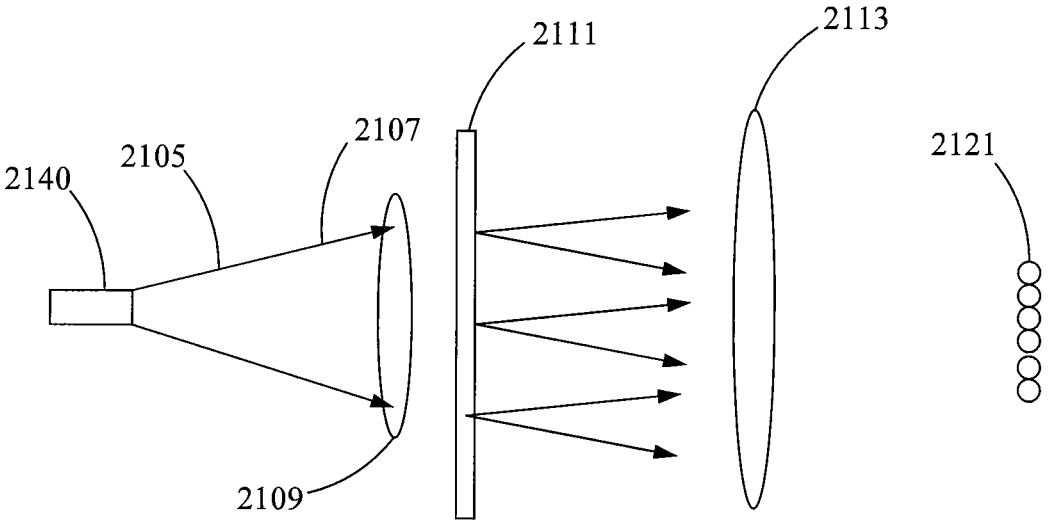

A further example is illustrated in FIG. 21, which provides an optical assembly for providing a predetermined beam pattern. Thus, there is provided a laser beam 2105, exiting the downhole end of fiber 2140, having rays 2107, which enters collimating lens 2109, a diffractive optic 2111, which could be a micro optic, or a corrective optic to a micro optic, that provides pattern 2120, which may but not necessary pass through reimaging lens 2113, which provides pattern 2121.

Figure 22:
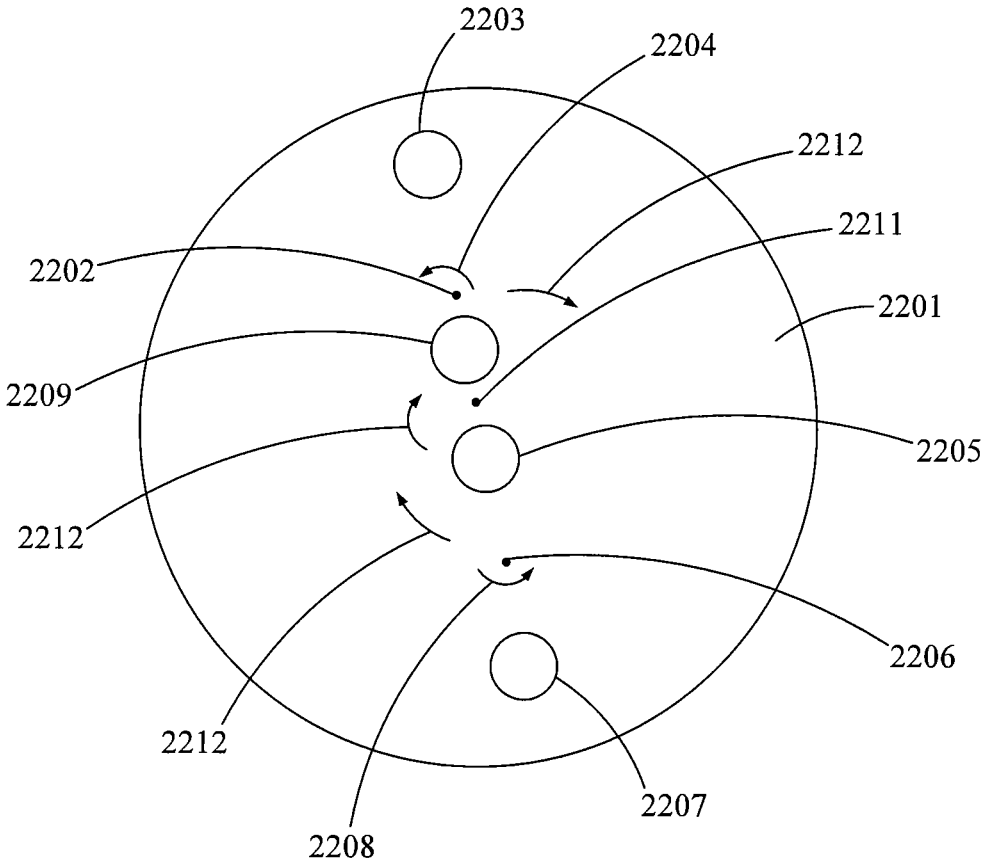
FIG. 22 illustrates a multi-rotating laser shot pattern.

There is further provided shot patterns for illuminating a borehole surface with a plurality of spots in a multi-rotating pattern. Accordingly in FIG. 22 there is provided a first pair of spots 2203, 2205, which illuminate the bottom surface 2201 of the borehole. The first pair of spots rotate about a first axis of rotation 2202 in the direction of rotation shown by arrow 2204 (the opposite direction of rotation is also contemplated herein). There is provided a second pair of spots 2207, 2209, which illuminate the bottom surface 2201 of the borehole. The second pair of shots rotate about axis 2206 in the direction of rotation shown by arrow 2208 (the opposite direction of rotation is also contemplated herein). The distance between the spots in each pair of spots may be the same or different. The first and second axis of rotation simultaneously rotate around the center of the borehole 2212 in a rotational direction, shown by arrows 2212, that is preferably in counter-rotation to the direction of rotation 2208, 2204. Thus, preferably although not necessarily, if 2208 and 2204 are clockwise, then 2212 should be counter-clockwise. This shot pattern provides for a substantially uniform energy deposition.

Figure 23:
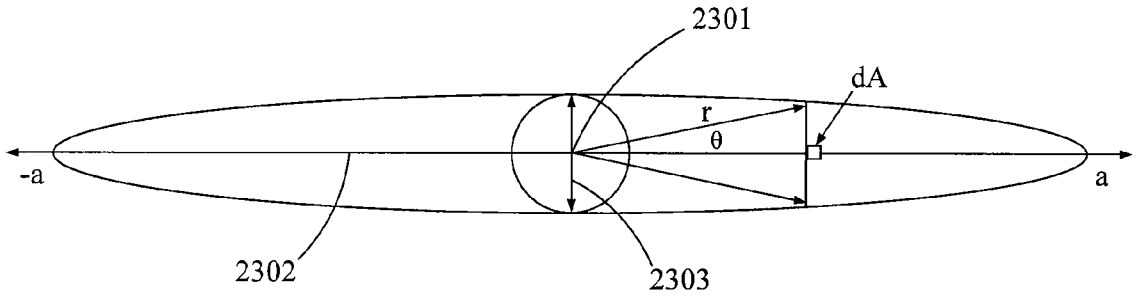
FIG. 23 illustrates an elliptical shaped shot.

There is illustrated in FIG. 23 an elliptical shot pattern of the general type discussed with respect to the forgoing illustrated examples having a center 2301, a major axis 2302, a minor axis 2303 and is rotated about the center. In this way the major axis of the spot would generally correspond to the diameter of the borehole, ranging from any known or contemplated diameters such as about 30, 20, 17½, 13⅜, 12¼, 9⅝, 8½, 7, and 6¼ inches.

Figure 24:
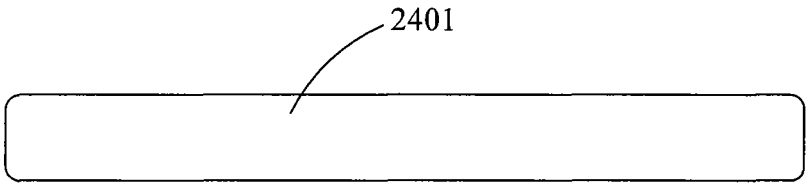
FIG. 24 illustrates a rectangular shaped spot.
Figure 25:
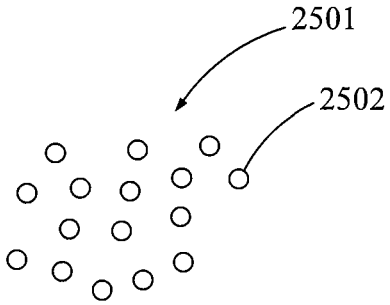
FIG. 25 illustrates a multi-shot shot pattern.
Figure 26:
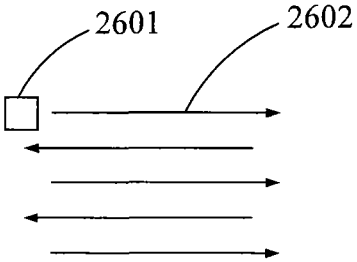
FIG. 26 illustrates a shot pattern.

There is further illustrated in FIG. 24 a rectangular shaped spot 2401 that would be rotated around the center of the borehole. There is illustrated in FIG. 25 a pattern 2501 that has a plurality of individual shots 2502 that may be rotated, scanned or moved with respect to the borehole to provide the desired energy deposition profile. The is further illustrated in FIG. 26 a squared shot 2601 that is scanned 2601 in a raster scan matter along the bottom of the borehole, further a circle, square or other shape shot may be scanned.

In accordance with one or more aspects, one or more fiber optic distal fiber ends may be arranged in a pattern. The multiplexed beam shape may comprise a cross, an x shape, a viewfinder, a rectangle, a hexagon, lines in an array, or a related shape where lines, squares, and cylinders are connected or spaced at different distances.

In accordance with one or more aspects, one or more refractive lenses, diffractive elements, transmissive gratings, and/or reflective lenses may be added to focus, scan, and/or change the beam spot pattern from the beam spots emitting from the fiber optics that are positioned in a pattern. One or more refractive lenses, diffractive elements, transmissive gratings, and/or reflective lenses may be added to focus, scan, and/or change the one or more continuous beam shapes from the light emitted from the beam shaping optics. A collimator may be positioned after the beam spot shaper lens in the transversing optical path plane. The collimator may be an aspheric lens, spherical lens system composed of a convex lens, thick convex lens, negative meniscus, and bi-convex lens, gradient refractive lens with an aspheric profile and achromatic doublets. The collimator may be made of the said materials, fused silica, ZnSe, SF glass, or a related material. The collimator may be coated to reduce or enhance reflectivity or transmission. Said optical elements may be cooled by a purging liquid or gas.

It is readily understood in the art that the terms lens and optic(al) elements, as used herein is used in its broadest terms and thus may also refer to any optical elements with power, such as reflective, transmissive or refractive elements, In some aspects, the refractive positive lens may be a microlens. The microlens can be steered in the light propagating plane to increase/decrease the focal length as well as perpendicular to the light propagating plane to translate the beam. The microlens may receive incident light to focus to multiple foci from one or more optical fibers, optical fiber bundle pairs, fiber lasers, diode lasers; and receive and send light from one or more collimators, positive refractive lenses, negative refractive lenses, one or more mirrors, diffractive and reflective optical beam expanders, and prisms.

In some aspects, a diffractive optical element beam splitter could be used in conjunction with a refractive lens. The diffractive optical element beam splitter may form double beam spots or a pattern of beam spots comprising the shapes and patterns set forth above.

There is additionally provided a system and method for creating a borehole in the earth wherein the system and method employ means for providing the laser beam to the bottom surface in a predetermined energy deposition profile, including having thee laser beam as delivered from the bottom hole assembly illuminating the bottom surface of the borehole with a predetermined energy deposition profile, illuminating the bottom surface with an any one of or combination of: a predetermined energy deposition profile biased toward the outside area of the borehole surface; a predetermined energy deposition profile biased toward the inside area of the borehole surface; a predetermined energy deposition profile comprising at least two concentric areas having different energy deposition profiles; a predetermined energy deposition profile provided by a scattered laser shot pattern; a predetermined energy deposition profile based upon the mechanical stresses applied by a mechanical removal means; a predetermined energy deposition profile having at least two areas of differing energy and the energies in the areas correspond inversely to the mechanical forces applied by a mechanical means.

There is yet further provided a method of advancing a borehole using a laser, the method comprising: advancing a high power laser beam transmission means into a borehole; the borehole having a bottom surface, a top opening, and a length extending between the bottom surface and the top opening of at least about 1000 feet; the transmission means comprising a distal end, a proximal end, and a length extending between the distal and proximal ends, the distal end being advanced down the borehole; the transmission means comprising a means for transmitting high power laser energy; providing a high power laser beam to the proximal end of the transmission means; transmitting substantially all of the power of the laser beam down the length of the transmission means so that the beam exits the distal end; transmitting the laser beam from the distal end to an optical assembly in a laser bottom hole assembly, the laser bottom hole assembly directing the laser beam to the bottom surface of the borehole; and, providing a predetermined energy deposition profile to the bottom of the borehole; whereby the length of the borehole is increased, in part, based upon the interaction of the laser beam with the bottom of the borehole.

Moreover there is provided a method of advancing a borehole using a laser, wherein the laser beam is directed to the bottom surface of the borehole in a substantially uniform energy deposition profile and thereby the length of the borehole is increased, in part, based upon the interaction of the laser beam with the bottom of the borehole.

In accordance with one or more aspects, a method for laser drilling using an optical pattern to chip rock formations is disclosed. The method may comprise irradiating the rock to spall, melt, or vaporize with one or more lasing beam spots, beam spot patterns and beam shapes at non-overlapping distances and timing patterns to induce overlapping thermal rock fractures that cause rock chipping of rock fragments. Single or multiple beam spots and beam patterns and shapes may be formed by refractive and reflective optics or fiber optics. The optical pattern, the pattern's timing, and spatial distance between non-overlapping beam spots and beam shapes may be controlled by the rock type thermal absorption at specific wavelength, relaxation time to position the optics, and interference from rock removal.

In some aspects, the lasing beam spot's power is either not reduced, reduced moderately, or fully during relaxation time when repositioning the beam spot on the rock surface. To chip the rock formation, two lasing beam spots may scan the rock surface and be separated by a fixed position of less than 2" and non-overlapping in some aspects. Each of the two beam spots may have a beam spot area in the range between 0.1 $cm^2$ and 25 $cm^2$. The relaxation times when moving the two lasing beam spots to their next subsequent lasing locations on the rock surface may range between 0.05 ms and 2 s. When moving the two lasing beam spots to their next position, their power may either be not reduced, reduced moderately, or fully during relaxation time.

In accordance with one or more aspects, a beam spot pattern may comprise three or more beam spots in a grid pattern, a rectangular grid pattern, a hexagonal grid pattern, lines in an array pattern, a circular pattern, a triangular grid pattern, a cross grid pattern, a star grid pattern, a swivel grid pattern, a viewfinder grid pattern or a related geometrically shaped pattern. In some aspects, each lasing beam spot in the beam spot pattern has an area in the range of 0.1 $cm^2$ and 25 $cm^2$. To chip the rock formation all the neighboring lasing beam spots to each lasing beam spot in the beam spot pattern may be less than a fixed position of 2" and non-overlapping in one or more aspects.

In some aspects, more than one beam spot pattern to chip the rock surface may be used. The relaxation times when positioning one or more beam spot patterns to their next subsequent lasing location may range between 0.05 ms and 2 s. The power of one or more beam spot patterns may either be not reduced, reduced moderately, or fully during relaxation time. A beam shape may be a continuous optical beam spot forming a geometrical shape that comprises of, a cross shape, hexagonal shape, a spiral shape, a circular shape, a triangular shape, a star shape, a line shape, a rectangular shape, or a related continuous beam spot shape.

In some aspects, positioning one line either linear or non-linear to one or more neighboring lines either linear or non-linear at a fixed distance less than 2" and non-overlapping may be used to chip the rock formation. Lasing the rock surface with two or more beam shapes may be used to chip the rock formation. The relaxation times when moving the one or more beam spot shapes to their next subsequent lasing location may range between 0.05 ms and 2 s.

In accordance with one or more aspects, the one or more continuous beam shapes powers are either not reduced, reduced moderately, or fully during relaxation time. The rock surface may be irradiated by one or more lasing beam spot patterns together with one or more beam spot shapes, or one or two beam spots with one or more beam spot patterns. In some aspects, the maximum diameter and circumference of one or more beam shapes and beam spot patterns is the size of the borehole being chipped when drilling the rock formation to well completion.

In accordance with one or more aspects, rock fractures may be created to promote chipping away of rock segments for efficient borehole drilling. In some aspects, beam spots, shapes, and patterns may be used to create the rock fractures so as to enable multiple rock segments to be chipped away.

The rock fractures may be strategically patterned. In at least some aspects, drilling rock formations may comprise applying one or more non-overlapping beam spots, shapes, or patterns to create the rock fractures. Selection of one or more beam spots, shapes, and patterns may generally be based on the intended application or desired operating parameters. Average power, specific power, timing pattern, beam spot size, exposure time, associated specific energy, and optical generator elements may be considerations when selecting one or more beam spots, a shape, or a pattern. The material to be drilled, such as rock formation type, may also influence the one or more beam spot, a shape, or a pattern selected to chip the rock formation. For example, shale will absorb light and convert to heat at different rates than sandstone.

In accordance with one or more aspects, rock may be patterned with one or more beam spots. In at least one embodiment, beam spots may be considered one or more beam spots moving from one location to the next subsequent location lasing the rock surface in a timing pattern. Beam spots may be spaced apart at any desired distance. In some non-limiting aspects, the fixed position between one beam spot and neighboring beam spots may be non-overlapping. In at least one non-limiting embodiment, the distance between neighboring beam spots may be less than 2".

In accordance with one or more aspects, rock may be patterned with one or more beam shapes. In some aspects, beam shapes may be continuous optical shapes forming one or more geometric patterns. A pattern may comprise the geometric shapes of a line, cross, viewfinder, swivel, star, rectangle, hexagon, circular, ellipse, squiggly line, or any other desired shape or pattern. Elements of a beam shape may be spaced apart at any desired distance. In some non-limiting aspects, the fixed position between each line linear or non-linear and the neighboring lines linear or non-linear are in a fixed position may be less than 2" and non-overlapping.

In accordance with one or more aspects, rock may be patterned with a beam pattern. Beam patterns may comprise a grid or array of beam spots that may comprise the geometric patterns of line, cross, viewfinder, swivel, star, rectangle, hexagon, circular, ellipse, squiggly line. Beam spots of a beam pattern may be spaced apart at any desired distance. In some non-limiting aspects, the fixed position between each beam spot and the neighboring beam spots in the beam spot pattern may be less than 2" and non-overlapping.

In accordance with one or more aspects, the beam spot being scanned may have any desired area. For example, in some non-limiting aspects the area may be in a range between about 0.1 $cm^2$ and about 25 $cm^2$. The beam line, either linear or non-linear, may have any desired specific diameter and any specific and predetermined power distribution. For example, the specific diameter of some non-limiting aspects may be in a range between about 0.05 $cm^2$ and about 25 $cm^2$. In some non-limiting aspects, the maximum length of a line, either linear or non-linear, may generally be the diameter of a borehole to be drilled. Any desired wavelength may be used. In some aspects, for example, the wavelength of one or more beam spots, a shape, or pattern, may range from 800 nm to 2000 nm. Combinations of one or more beam spots, shapes, and patterns are possible and may be implemented.

In accordance with one or more aspects, the timing patterns and location to chip the rock may vary based on known rock chipping speeds and/or rock removal systems. In one embodiment, relaxation scanning times when positioning one or more beam spot patterns to their next subsequent lasing location may range between 0.05 ms and 2 s. In another embodiment, a camera using fiber optics or spectroscopy techniques can image the rock height to determine the peak rock areas to be chipped. The timing pattern can be calibrated to then chip the highest peaks of the rock surface to lowest or peaks above a defined height using signal processing, software recognition, and numeric control to the optical lens system. In another embodiment, timing patterns can be defined by a rock removal system. For example, if the fluid sweeps from the left side the rock formation to the right side to clear the optical head and raise the cuttings, the timing should be chipping the rock from left to right to avoid rock removal interference to the one or more beam spots, shape, or pattern lasing the rock formation or vice-a-versa. For another example, if the rocks are cleared by a jet nozzle of a gas or liquid, the rock at the center should be chipped first and the direction of rock chipping should move then away from the center. In some aspects, the speed of rock removal will define the relaxation times.

In accordance with one or more aspects, the rock surface may be affected by the gas or fluids used to clear the head and raise the cuttings downhole. In one embodiment, heat from the optical elements and losses from the fiber optics downhole or diode laser can be used to increase the temperature of the borehole. This could lower the required temperature to induce spallation making it easier to spall rocks. In another embodiment, a liquid may saturate the chipping location, in this situation the liquid would be turned to steam and expand rapidly, this rapid expansion would thus create thermal shocks improving the growth of fractures in the rock. In another embodiment, an organic, volatile components, minerals or other materials subject to rapid and differential heating from the laser energy, may expand rapidly, this rapid expansion would thus create thermal shocks improving the growth of fractures in the rock. In another embodiment, the fluids of higher index of refraction may be sandwiched between two streams of liquid with lower index of refraction. The fluids used to clear the rock can act as a wavelength to guide the light. A gas may be used with a particular index of refraction lower than a fluid or another gas.

By way of example and to further illustrate the teachings of the present inventions, the thermal shocks can range from lasing powers between one and another beam spot, shape, or pattern. In some non-limiting aspects, the thermal shocks may reach 10 $kW/cm^2$ of continuous lasing power density. In some non-limiting aspects, the thermal shocks may reach up to 10 $MW/cm^2$ of pulsed lasing power density, for instance, at 10 nanoseconds per pulse. In some aspects, two or more beam spots, shapes, and patterns may have different power levels to thermally shock the rock. In this way, a temperature gradient may be formed between lasing of the rock surface.

Figure 27:
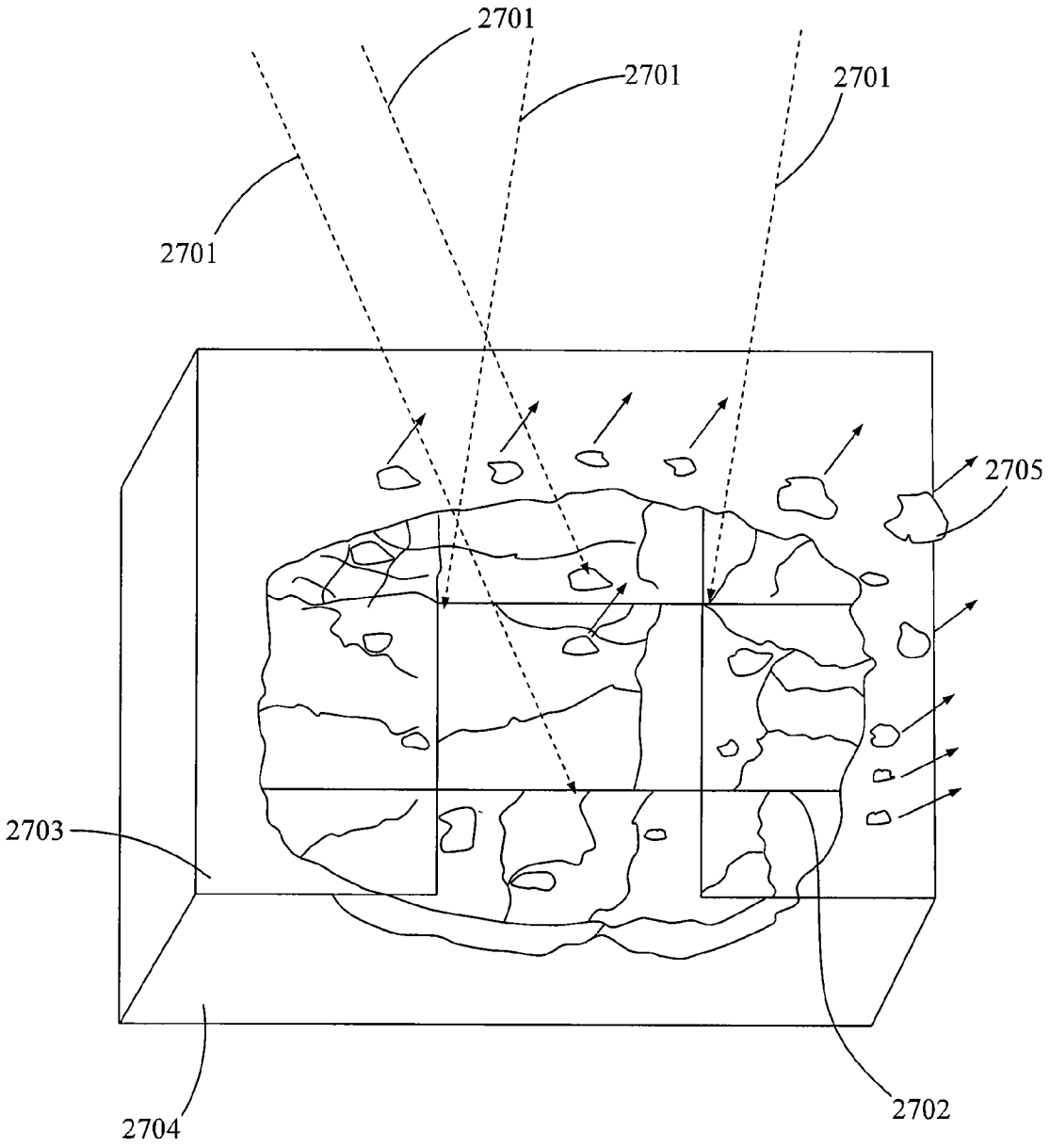
FIGS. 27 to 36 illustrate LBHAs.

By way of example and to further demonstrate the present teachings of the inventions, there are provided examples of optical heads, i.e., optical assemblies, and beam shot patterns, i.e., illumination patterns, that may be utilized with, as a part of, or provided by an LBHA. FIG. 27 illustrates chipping a rock formation using a lasing beam shape pattern. An optical beam 2701 shape lasing pattern forming a checkerboard of lines 2702 irradiates the rock surface 2703 of a rock 2704. The distance between the beam spots shapes are non-overlapping because stress and heat absorption cause natural rock fractures to overlap inducing chipping of rock segments. These rock segments 2705 may peel or explode from the rock formation.

Figure 28:
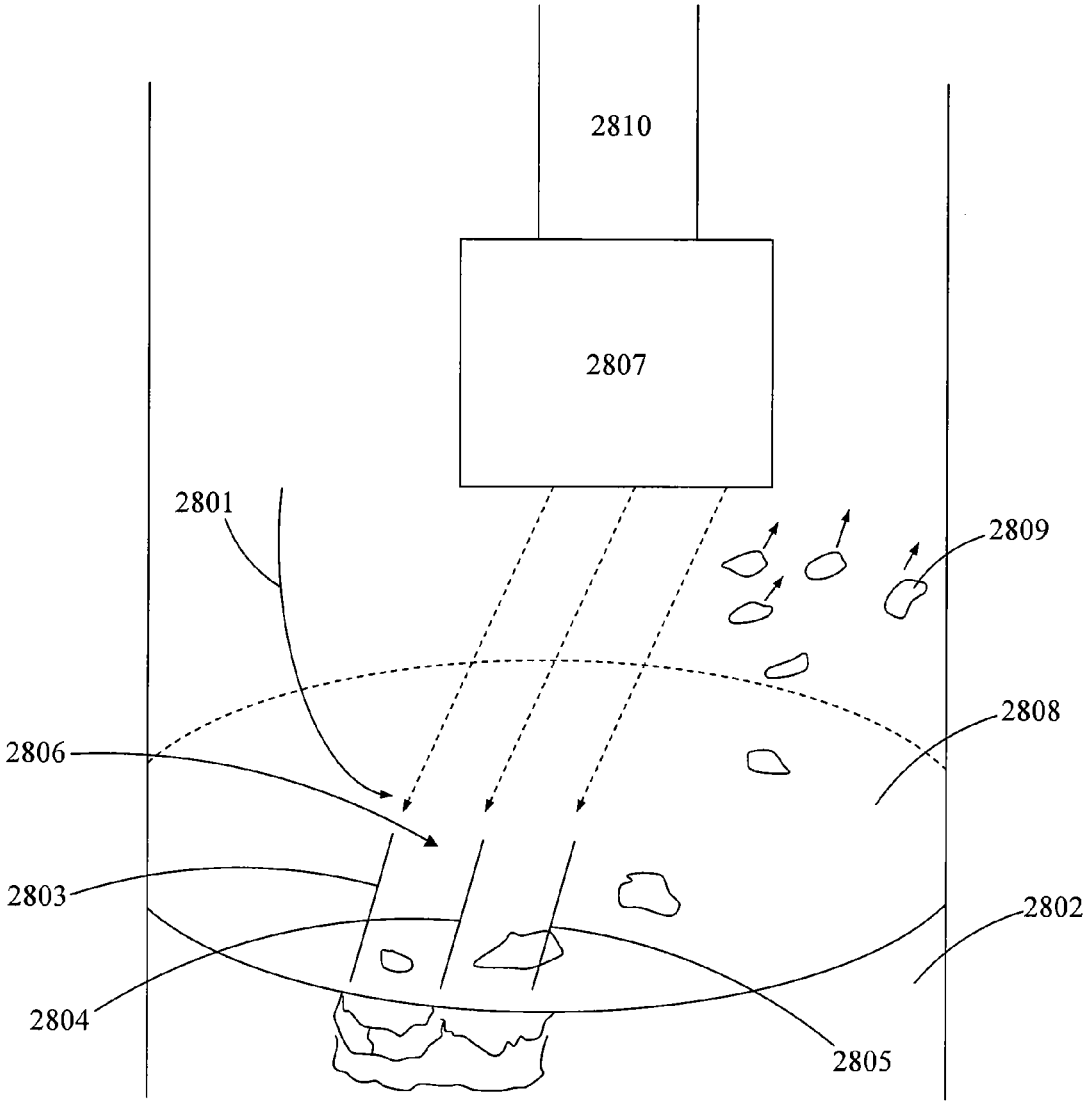

By way of example and to further demonstrate the present teachings, FIG. 28 illustrates removing rock segments by sweeping liquid or gas flow 2801 when chipping a rock formation 2802. The rock segments are chipped by a pattern 1606 of non-overlapping beam spot shaped lines 2803, 2804, 2805. The optical head 2807, optically associated with an optical fiber bundle, the optical head 2807 having an optical element system irradiates the rock surface 2808. A sweeping from left to right with gas or liquid flow 2801 raises the rock fragments 2809 chipped by the thermal shocks to the surface.

Figure 29:
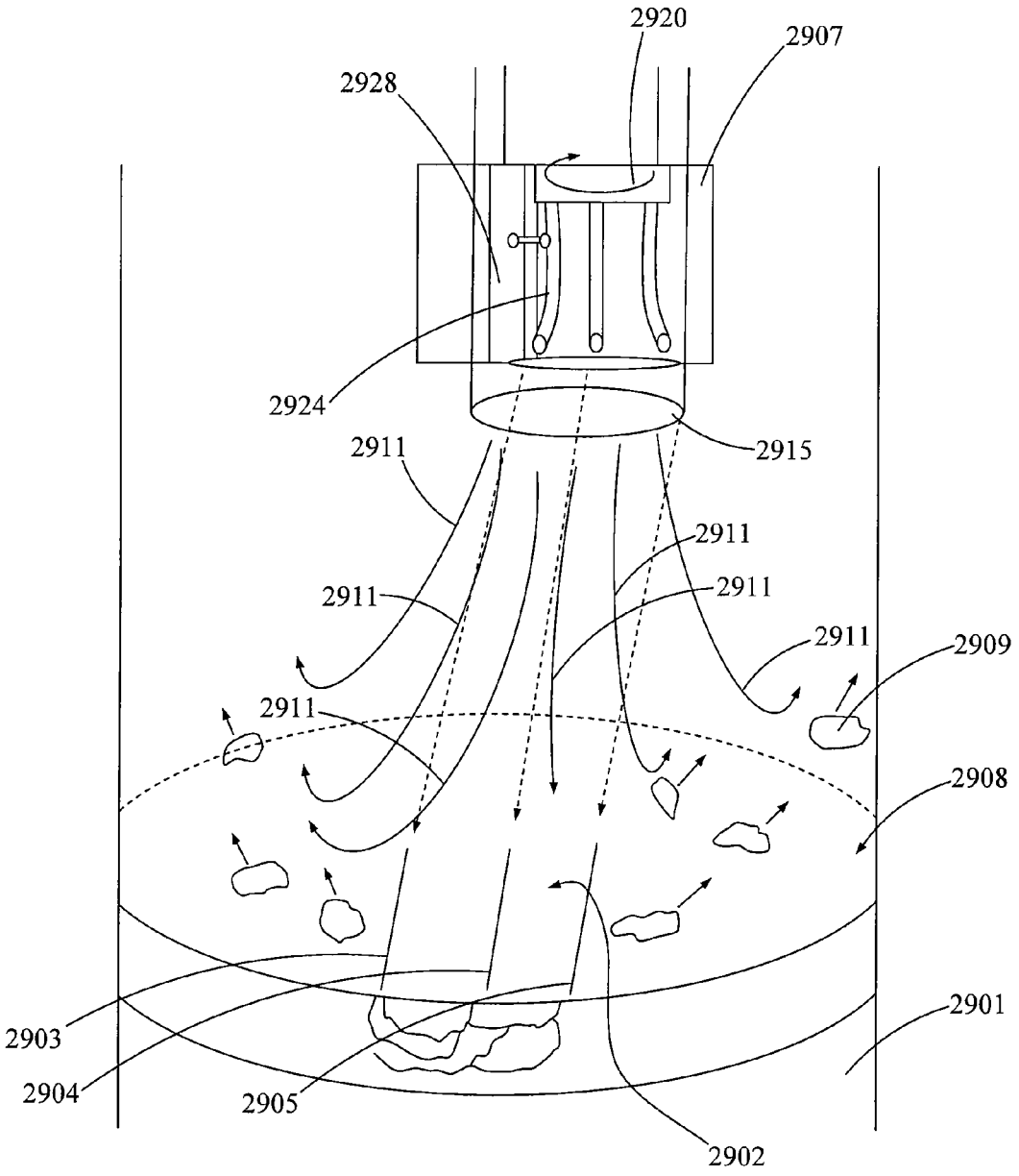

By way of example and to further demonstrate the present teachings, FIG. 29 illustrates removing rock segments by liquid or gas flow directed from the optical head when chipping a rock formation 2901. The rock segments are chipped by a pattern 2902 of non-overlapping beam spot shaped lines 2903, 2904, 2905. The optical head 2907 with an optical element system irradiates the rock surface 2908. Rock segment debris 2909 is swept from a nozzle 2915 flowing a gas or liquid 2911 from the center of the rock formation and away. The optical head 2907 is shown attached to a rotating motor 2920 and fiber optics 2924 spaced in a pattern. The optical head also has rails 2928 for z-axis motion if necessary to focus. The optical refractive and reflective optical elements form the beam path.

Figure 30:
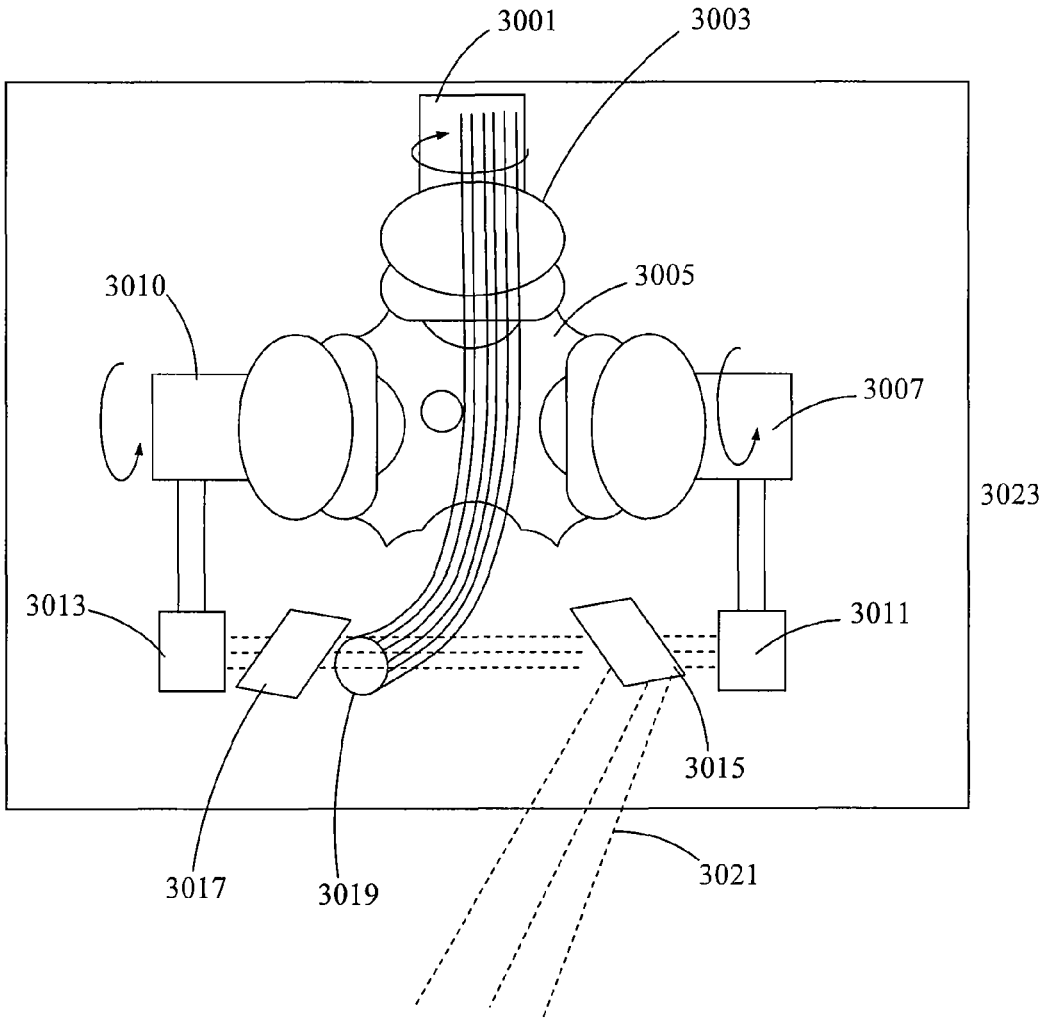

By way of example and to further demonstrate the present teachings, FIG. 30 illustrates optical mirrors scanning a lasing beam spot or shape to chip a rock formation in the XY-plane. Thus, there is shown, with respect to a casing 3023 in a borehole, a first motor of rotating 3001, a plurality of fiber optics in a pattern 3003, a gimbal 3005, a second rotational motor 3007 and a third rotational motor 3010. The second rotational motor 3007 having a stepper motor 3011 and a mirror 3015 associated therewith. The third rotational motor 3010 having a stepper motor 3013 and a mirror 3017 associated therewith. The optical elements 3019 optically associated with optical fibers 3003 and capable of providing laser beam along optical path 3021. As the gimbal rotates around the z-axis and repositions the mirrors in the XY-plane. The mirrors are attached to a stepper motor to rotate stepper motors and mirrors in the XY-plane. In this embodiment, fiber optics are spaced in a pattern forming three beam spots manipulated by optical elements that scan the rock formation a distance apart and non-overlapping to cause rock chipping. Other fiber optic patterns, shapes, or a diode laser can be used.

Figure 31:
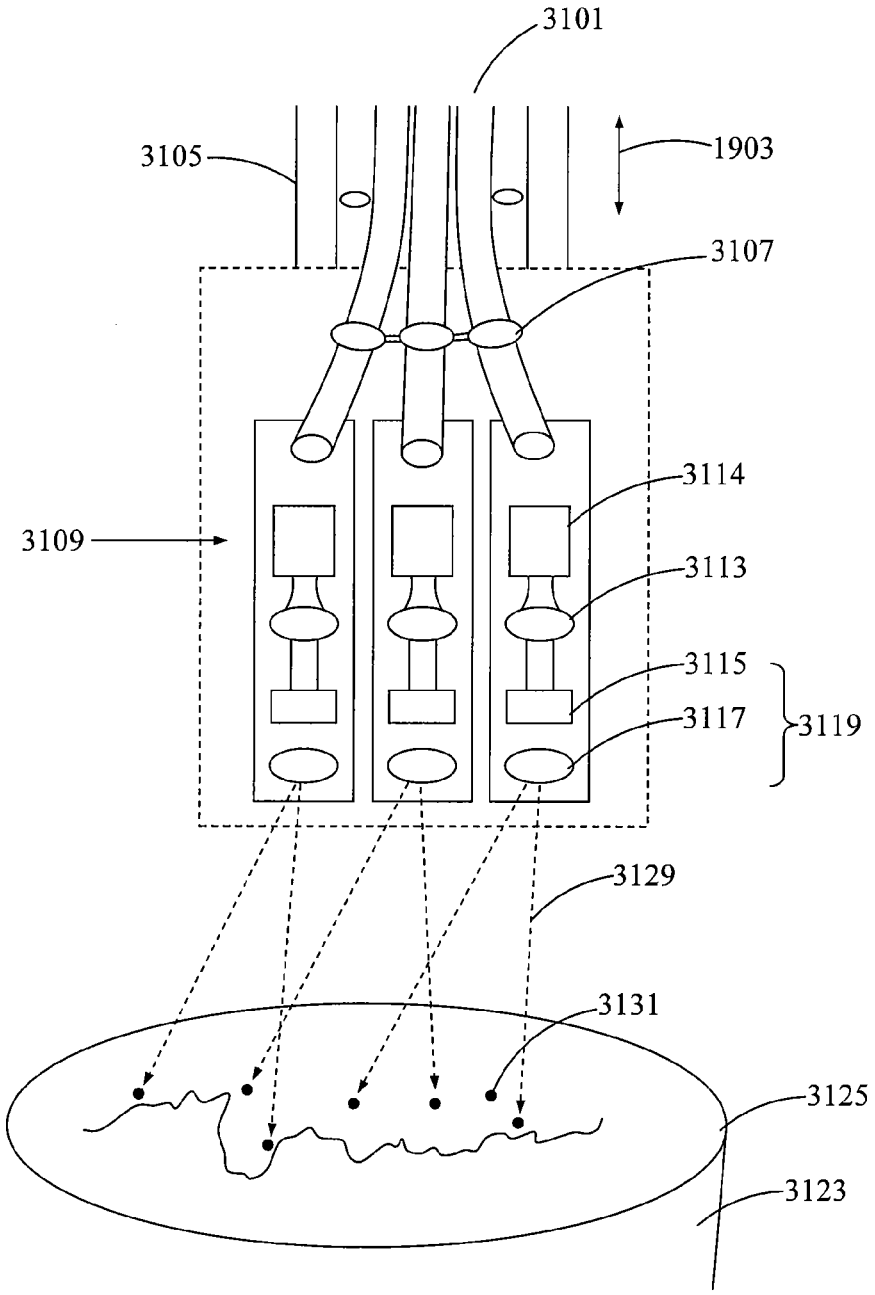

By way of example and to further demonstrate the present teachings, FIG. 31 illustrates using a beam splitter lens to form multiple beam foci to chip a rock formation. There is shown fibers 3101 in a pattern, a rail 3105 for providing z direction movement shown by arrow 3103, a fiber connector 3107, an optical head 3109, having a beam expander 3119, which comprises a DOE/ROE 3115, a positive lens 3117, a collimator 3113, a beam expander 3111. This assembly is capable of delivering one or more laser beams, as spots 3131 in a pattern, along optical paths 3129 to a rock formation 3123 having a surface 3125. Fiber optics are spaced a distance apart in a pattern. An optical element system composed of a beam expander and collimator feed a diffractive optical element attached to a positive lens to focus multiple beam spots to multiple foci. The distance between beam spots are non-overlapping and will cause chipping. In this figure, rails move in the z-axis to focus the optical path. The fibers are connected by a connector. Also, an optical element can be attached to each fiber optic as shown in this figure to more than one fiber optics.

Figure 32:
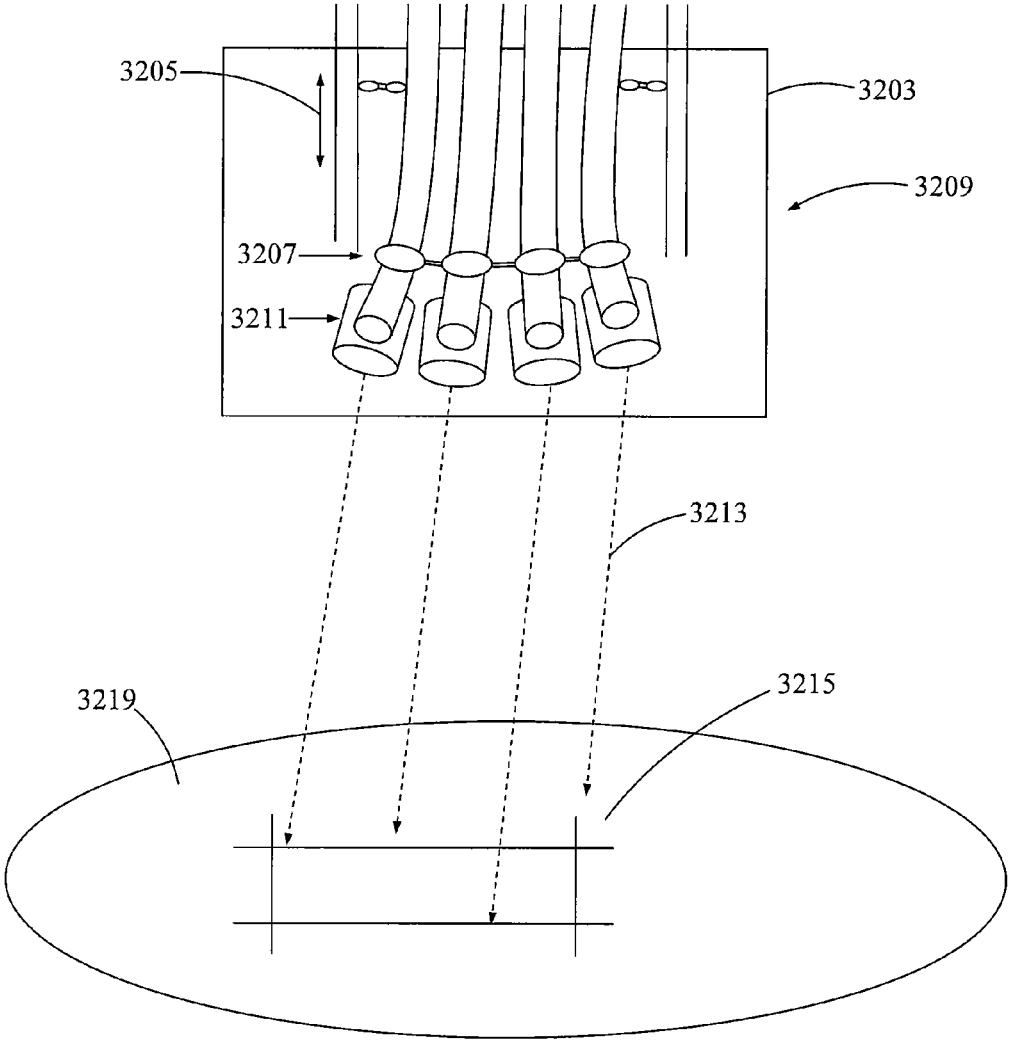

By way of example and to further demonstrate the present teachings, FIG. 32 illustrates using a beam spot shaper lens to shape a pattern to chip a rock formation. There is provided an array of optical fibers 3201, an optical head 3209. The optical head having a rail 3203 for facilitating movement in the z direction, shown by arrow 3205, a fiber connector 3207, an optics assembly 3201 for shaping the laser beam that is transmitted by the fibers 3201. The optical head capable of transmitting a laser beam along optical path 3213 to illuminate a surface 3219 with a laser beam shot pattern 3221 that has separate, but intersection lines in a grid like pattern. Fiber optics are spaced a distance apart in a pattern connected by a connector. The fiber optics emit a beam spot to a beam spot shaper lens attached to the fiber optic. The beam spot shaper lens forms a line in this figure overlapping to form a tick-tack-toe laser pattern on the rock surface. The optical fiber bundle wires are attached to rails moving in the z-axis to focus the beam spots.

Figure 33:
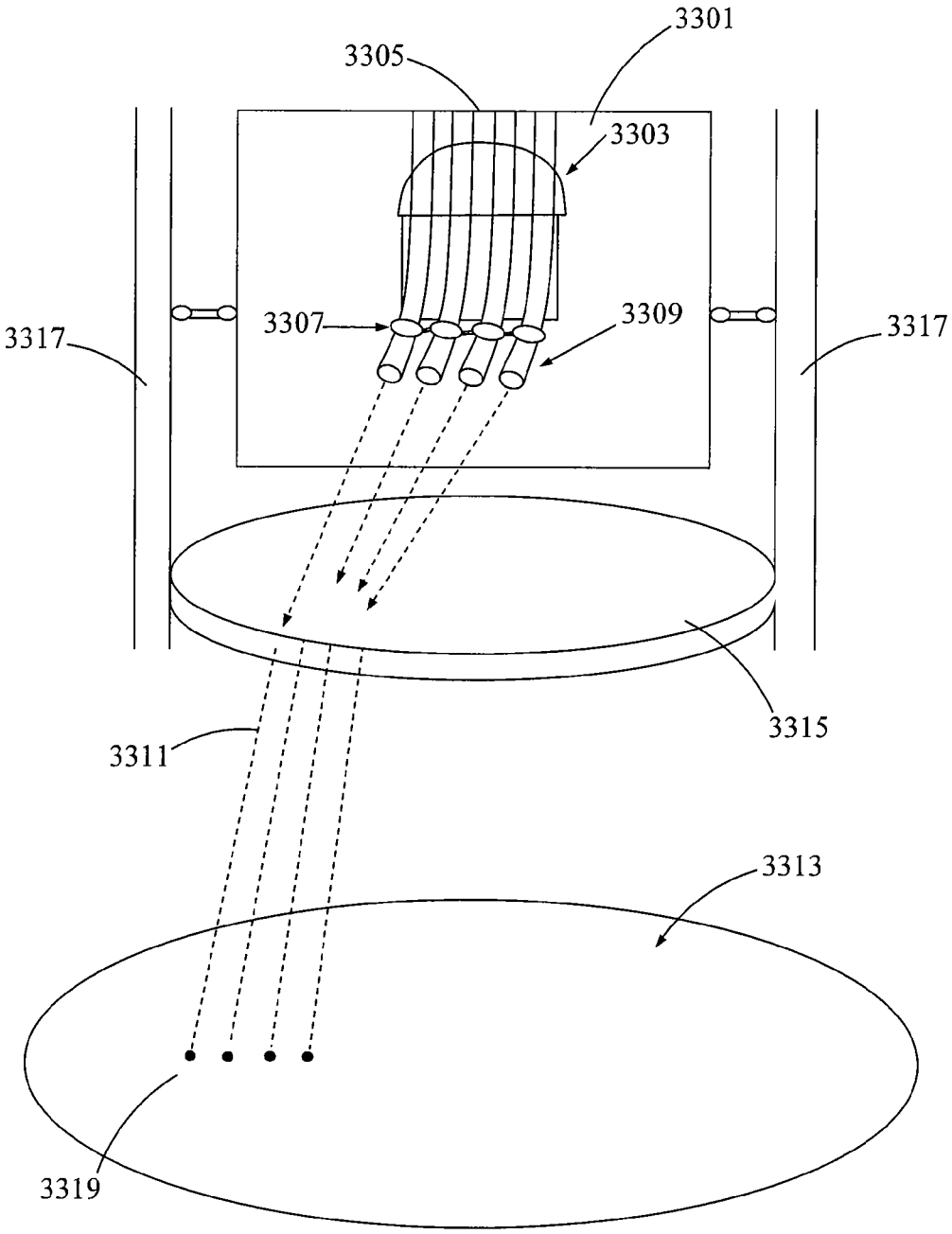

By way of example and to further demonstrate the present teachings, FIG. 33 illustrates using a F-theta objective to focus a laser beam pattern to a rock formation to cause chipping. There is provided an optical head 3301, a first motor for providing rotation 3303, a plurality of optical fibers 3305, a connector 3307, which positions the fibers in a predetermined pattern 3309. The laser beam exits the fibers and travels along optical path 3311 through F-Theta optics 3315 and illuminates rock surface 3313 in shot pattern 3310. There is further shown rails 3317 for providing z-direction movement. Fiber optics connected by connectors in a pattern are rotated in the z-axis by a gimbal attached to the optical casing head. The beam path is then refocused by an F-theta objective to the rock formation. The beam spots are a distance apart and non-overlapping to induce rock chipping in the rock formation. A rail is attached to the optical fibers and F-theta objective moving in the z-axis to focus the beam spot size.

It is understood that the rails in these examples for providing z-direction movement are provided by way of illustration and that z-direction movement, i.e. movement toward or away from the bottom of the borehole may be obtained by other means, for example winding and unwinding the spool or raising and lowering the drill string that is used to advance the LBHA into or remove the LBHA from the borehole.

Figure 34:
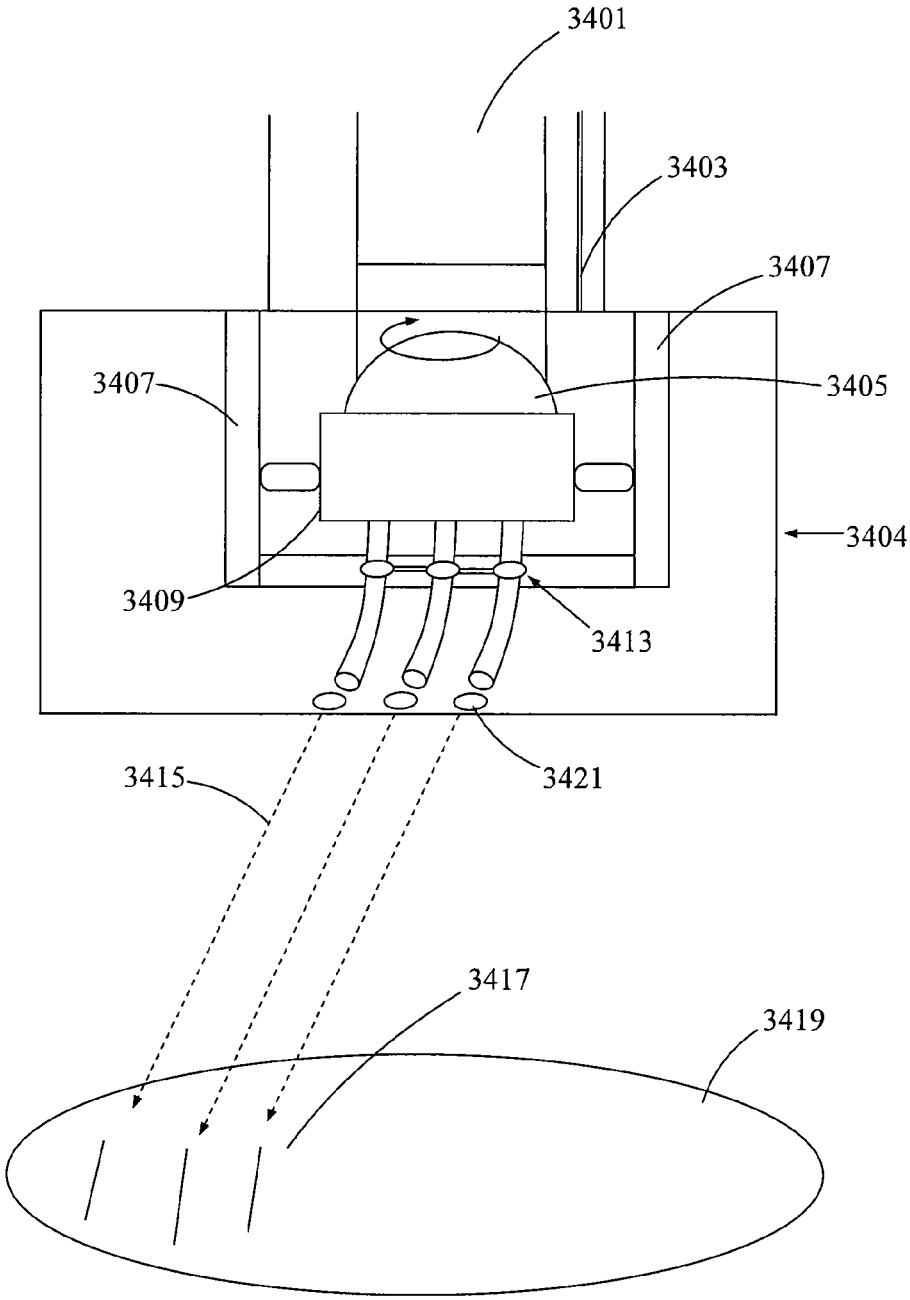

By way of example and to further demonstrate the present teachings, FIG. 34 illustrates mechanical control of fiber optics attached to beam shaping optics to cause rock chipping. There is provided a bundle of a plurality of fibers 3401 first motor 3405 for providing rotational movement a power cable 3403, an optical head 3406, and rails 3407. There is further provided a second motor 3409, a fiber connector 3413 and a lens 3421 for each fiber to shape the beam. The laser beams exit the fibers and travel along optical paths 3415 and illumate the rock surface 3419 in a plurality of individual line shaped shot patterns 3417. Fiber optics are connected by connectors in a pattern and are attached to a rotating gimbal motor around the z-axis. Rails are attached to the motor moving in the z-axis. The rails are structurally attached to the optical head casing and a support rail. A power cable powers the motors. In this figure, the fiber optics emit a beam spot to a beam spot shaper lens forming three non-overlapping lines to the rock formation to induce rock chipping.

Figure 35:
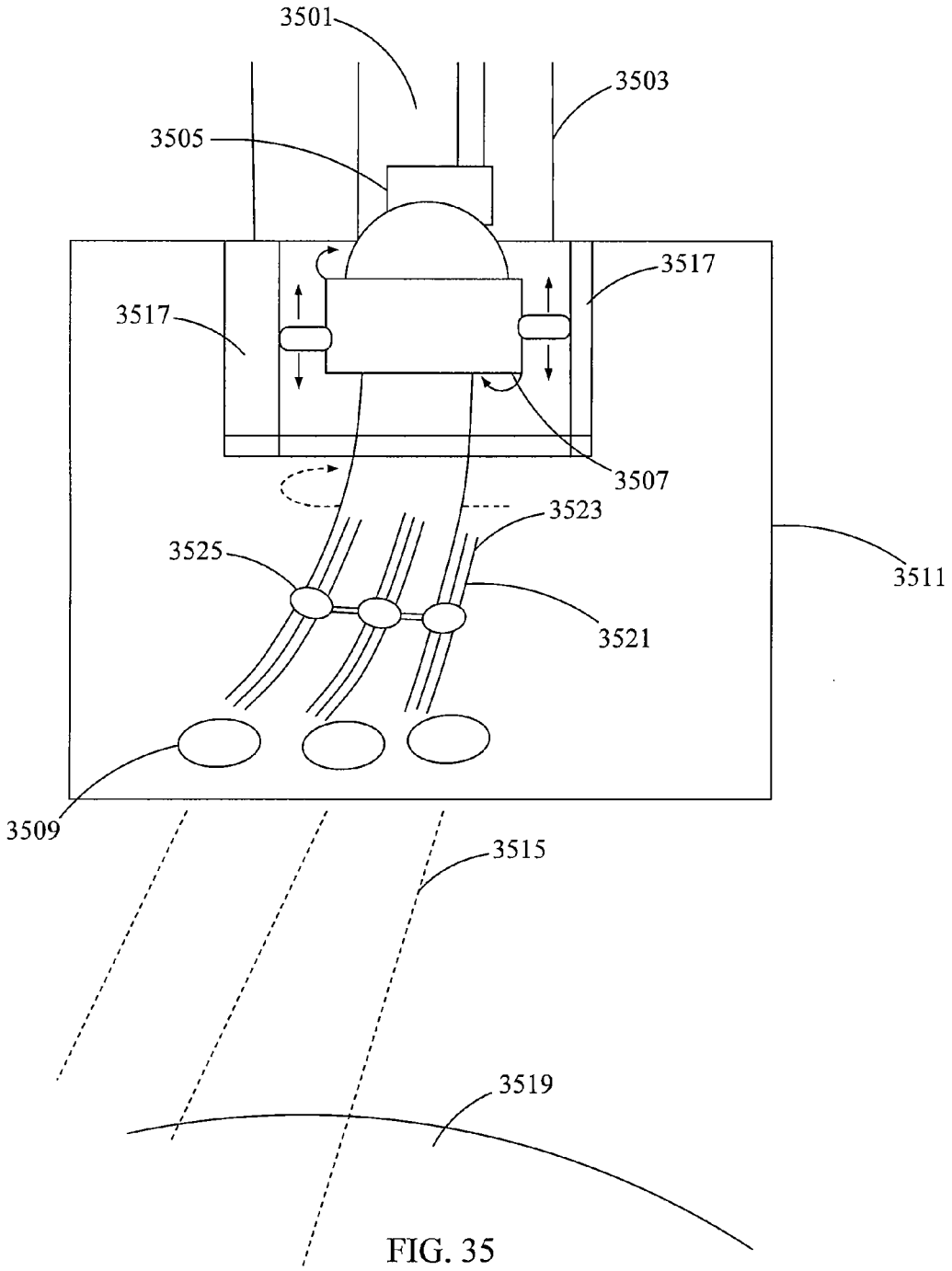

By way of example and to further demonstrate the present teachings, FIG. 35 illustrates using a plurality of fiber optics to form a beam shape line. There is provided an optical assembly 3511 having a source of laser energy 3501, a power cable 3503, a first rotational motor 3505, which is mounted as a gimbal, a second motor 3507, and rails 3517 for z-direction movement. There is also provided a plurality of fiber bundles 3521, with each bundle containing a plurality of individual fibers 3523. The bundles 3521 are held in a predetermined position by connector 3525. Each bundle 3521 is optically associated with a beam shaping optics 3509. The laser beams exit the beam shaping optics 3509 and travel along optical path 3515 to illuminate surface 3519. The motors 3507, 3505 provide for the ability to move the plurality of beam spots in a plurality of predetermined and desired patterns on the surface 3519, which may be the surface the borehole, such as the bottom surface, side surface, or casing in the borehole. A plurality of fiber optics are connected by connectors in a pattern and are attached to a rotating gimbal motor around the z-axis. Rails are attached to the motor moving in the z-axis. The rails are structurally attached to the optical head casing and a support rail. A power cable powers the motors. In this figure, the plurality of fiber optics emits a beam spot to a beam spot shaper lens forming three lines that are non-overlapping to the rock formation. The beam shapes induce rock chipping.

Figure 36:
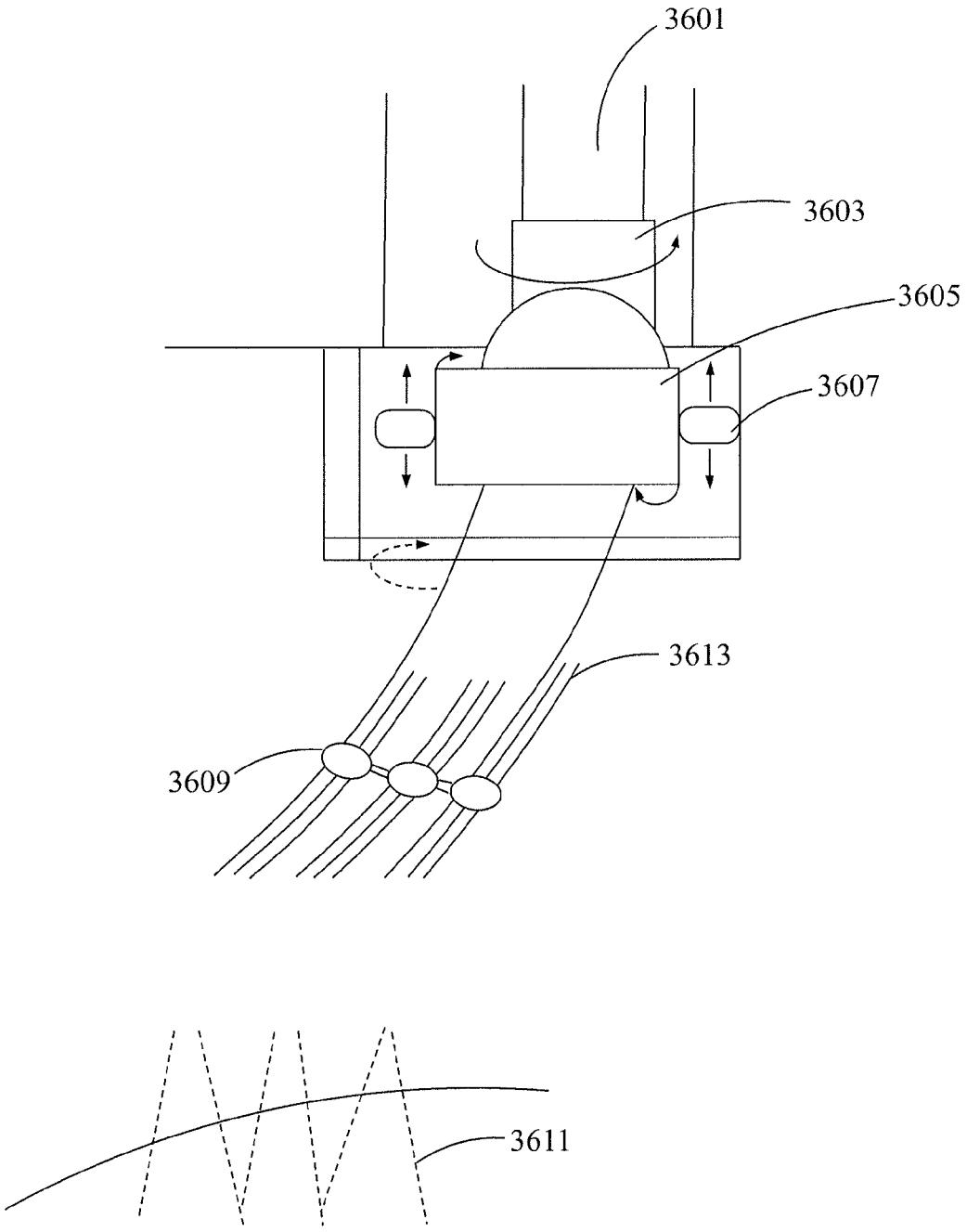

By way of example and to further demonstrate the present teachings, FIG. 36 illustrates using a plurality of fiber optics to form multiple beam spot foci being rotated on an axis. There is provided a laser source 3601, a first motor 3603, which is gimbal mounted, a second motor 3605 and a means for z-direction movement 3607. There is further provided a plurality of fiber bundles 3613 and a connector 3609 for positioning the plurality of bundles 3613, the laser beam exits the fibers and illuminates a surface in a diverging and crossing laser shot pattern. The fiber optics are connected by connectors at an angle being rotated by a motor attached to a gimbal that is attached to a second motor moving in the z-axis on rails. The motors receive power by a power cable. The rails are attached to the optical casing head and support rail beam. In this figure, a collimator sends the beam spot originating from the plurality of optical fibers to a beam splitter. The beam splitter is a diffractive optical element that is attached to positive refractive lens. The beam splitter forms multiple beam spot foci to the rock formation at non-overlapping distances to chip the rock formation. The foci is repositioned in the z-axis by the rails.

Figure 11:
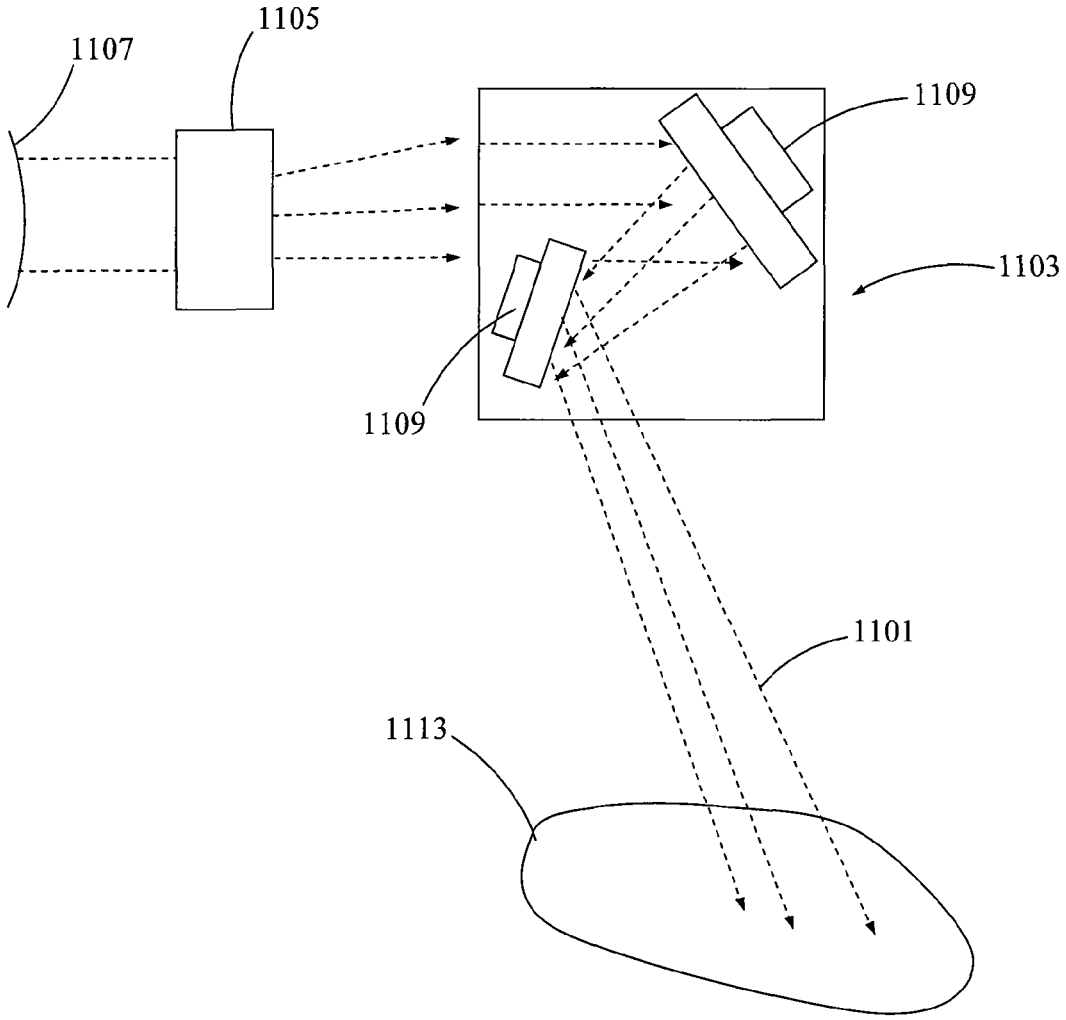
FIG. 11 is an LBHA.

By way of example and to further demonstrate the present teachings, FIG. 11 illustrates scanning the rock surface with a beam pattern and XY scanner system. There is provided an optical path 1101 for a laser beam, a scanner 1103, a diffractive optics 1105 and a collimator optics 1107. An optical fiber emits a beam spot that is expanded by a beam expander unit and focused by a collimator to a refractive optical element. The refractive optical element is positioned in front of an XY scanner unit to form a beam spot pattern or shape. The XY scanner composed of two mirrors controlled by galvanometer mirrors 1109 irradiate the rock surface 1113 to induce chipping.

From the foregoing description, one skilled in the art can readily ascertain the essential characteristics of this invention, and without departing from the spirit and scope thereof, can make various changes and/or modifications of the invention to adapt it to various usages and conditions.

What is claimed:

1. A spool assembly for rotatably coupling high power laser transmission cables for use in advancing boreholes, comprising:

a. a base;

b. a spool, the spool supported by the base through a load bearing bearing;

c. hollow tubing having a first end and a second end;

d. the hollow tubing comprising a means for transmitting a high power laser beam;

e. the spool comprising an axle around which the coiled tubing is wound, the axle supported by the load bearing bearing;

f. a first non-rotating optical connector for optically connecting a laser beam source to the axle;

g. a rotatable optical connector optically associated with the first optical connector; whereby a laser beam is capable of being transmitted from the first optical connector to the rotatable optical connector; and, h. a rotating optical connector optically associated with the rotatable optical connector; optically associated with the transmitting means; and, mechanically associated with the axle;

i. whereby the spool is capable of transmitting a laser beam from the first optical connector through the rotatable optical connector and into the transmitting means during winding and unwinding of the tubing on the spool while maintaining sufficient power to advance a borehole.

2. The spool of claim 1, comprising a rotational transition optical assembly, the optical assembly comprising:

a. a non-rotating adapter for receiving the non-rotating connector;

b. a non-rotation lens adjacent the non-rotating adapter, the non-rotating lens characterizing a Fourier Transform plane; and, c. a rotatable adapter for receiving the rotatable connector.

3. The spool of claim 1, comprising an isolation means associated with the rotational transition optical assembly, wherein the optical assembly is substantially isolated from movement of the load bearing bearings.

4. The spool of claim 3, wherein the isolation means comprises a precision bearing.

5. The spool of claim 3, wherein the means for transmitting the high power laser beam comprises a plurality of optical fibers characterized by having the ability to transmit a laser beam having at least about 20 kW of power and having a length of at least about 3000 feet and having a core having a diameter of at least about 500 μm.

6. The spool of claim 1, comprising a means for isolating vibrations, whereby the transmission of a laser beam within the rotating spool are substantially unaffected by a vibration from the rotating spool.

7. The spool of claim 6, wherein the means for transmitting the high power laser beam comprises an optical fiber characterized by having the ability to transmit a laser beam having at least about 15 kW of power and having a length of at least about 3000 feet.

8. The spool of claim 6, wherein the means for transmitting the high power laser beam comprises two optical fibers characterized by each optical fiber having the ability to transmit a laser beam having at least about 10 kW of power and having a length of at least about 3000 feet.

9. The spool of claim 6, wherein the means for transmitting the high power laser beam comprises a plurality of optical fibers characterized by having the ability to transmit a laser beam having at least about 15 kW of power and having a length of at least about 3000 feet.

10. The spool of claim 1, wherein the means for transmitting the high power laser beam comprises an optical fiber characterized by having the ability to transmit a laser beam having at least about 15 kW of power and having a length of at least about 3000 feet.

11. The spool of claim 1, wherein the means for transmitting the high power laser beam comprises two optical fibers characterized by each optical fiber having the ability to transmit a laser beam having at least about 10 kW of power and having a length of at least about 3000 feet.

12. The spool of claim 1, wherein the means for transmitting the high power laser beam comprises three optical fibers characterized by each optical fiber having the ability to transmit a laser beam having at least about 10 kW of power and having a length of at least about 3000 feet.

13. The spool of claim 1, wherein the means for transmitting the high power laser beam comprises an optical fiber characterized by having the ability to transmit a laser beam having at least about 10 kW of power and having a length of at least about 500 feet and having a core having a diameter of at least about 200 μm.

14. The spool of claim 1, wherein the means for transmitting the high power laser beam comprises an optical fiber characterized by having the ability to transmit a laser beam having at least about 20 kW of power and having a length of at least about 3000 feet and having a core having a diameter of at least about 500 μm.

15. The spool of claim 1, wherein the means for transmitting the high power laser beam comprises three optical fibers characterized by each optical fiber having the ability to transmit a laser beam having at least about 10 kW of power and having a length of at least about 3000 feet and having a core having a diameter of at least about 200 μm.

16. The spool of claim 1, wherein the means for transmitting the high power laser beam comprises an optical fiber having a core having a diameter of at least about 500 μm.

17. The spool of claim 1, wherein the means for transmitting the high power laser beam comprises an optical fiber having a core having a diameter of at least about 200 μm.

18. The spool of claim 1, wherein the hollow tubing comprises a coiled tubing containing a fluid line and a second line.

19. The spool of claim 1, comprising a means for providing buoyancy to the means for transmitting the high power laser beam.

20. A spool assembly for rotatably coupling high power laser transmission cables for use in advancing boreholes, comprising:

a. a base;
b. a spool, the spool supported by the base through a load bearing bearing;
c. a means for providing laser energy;
d. coiled tubing having a first end and a second end;
e. the coiled tubing comprising a means for transmitting a high power laser beam;
f. the spool comprising an axle around which the coiled tubing is wound, the axle supported by the load bearing bearing;
g. a first non-rotating optical connector for optically connecting a laser beam from the means for providing laser energy to the axle;
h. a rotatable optical connector optically associated with the first optical connector; whereby a laser beam is capable of being transmitted from the first optical connector to the rotatable optical connector; and,
i. a rotating optical connector optically associated with the rotatable optical connector, optically associated with the transmitting means and associated with the axle;
j. whereby the spool is capable of transmitting a laser beam from the first optical connector through the rotatable optical connector and into the transmitting means during winding and unwinding of the tubing on the spool while maintaining sufficient power to advance a borehole.

21. The spool of claim 20 wherein the means for providing laser energy is a single optical fiber from a laser.

22. The spool of claim 21 wherein the means for transmitting a high power laser beam is an optical fiber.

23. The spool of claim 21 wherein the means for transmitting a high power laser beam is a pair of optical fibers.

24. The spool of claim 21 wherein the means for transmitting a high power laser beam is a plurality of optical fibers.

25. The spool of claim 20 wherein the means for providing laser energy is a pair of optical fibers from a laser.

26. The spool of claim 25 wherein the means for transmitting a high power laser beam is an optical fiber.

27. The spool of claim 25 wherein the means for transmitting a high power laser beam is a pair of optical fibers.

28. The spool of claim 25 wherein the means for transmitting a high power laser beam is a plurality of optical fibers.

29. The spool of claim 20 wherein the means for providing laser energy is a plurality of optical fibers from a laser.

30. The spool of claim 29 wherein the means for transmitting a high power laser beam is an optical fiber.

31. The spool of claim 29 wherein the means for transmitting a high power laser beam is a pair of optical fibers.

32. The spool of claim 29 wherein the means for transmitting a high power laser beam is a plurality of optical fibers.

33. The spool of claim 20 wherein the means for providing laser energy is a plurality of lasers.

34. The spool of claim 20 wherein the means for providing laser energy is a pair of lasers.

35. The spool of claim 20 wherein the means for transmitting a high power laser beam is an optical fiber.

36. The spool of claim 20 wherein the means for transmitting a high power laser beam is a pair of optical fibers.

37. The spool of claim 20 wherein the means for transmitting a high power laser beam is a plurality of optical fibers.

38. A spool assembly for rotatably coupling high power laser transmission cables for use in advancing boreholes, comprising:

a. a base;
b. a spool, the spool supported by the base through a load bearing bearing;
c. hollow tubing having a first end and a second end;
d. the hollow tubing comprising a means for transmitting a high power laser beam;
e. the spool comprising an axle around which the coiled tubing is wound, the axle supported by the load bearing bearing;
f. a first non-rotating optical connector for optically connecting a laser beam source to the axle;
g. a rotatable optical connector optically associated with the first optical connector; whereby a laser beam is capable of being transmitted from the first optical connector to the rotatable optical connector; and,
h. a rotational transition optical assembly, the optical assembly comprising:
   i. a non-rotating adapter for receiving the non-rotating connector;
   ii. a first lens adjacent the non-rotating adapter, the first lens characterizing a Fourier Transform plane;
   iii. a rotatable adapter for receiving the rotatable connector; and, iv. the rotatable adapter substantially in the Fourier Transform plane;
i. whereby the spool is capable of transmitting a laser beam from the first optical connector through the rotatable optical connector and into the transmitting means during winding and unwinding of the tubing on the spool while maintaining sufficient power to advance a borehole.

39. The spool of claim 38, comprising an isolation means associated with the rotational transition optical assembly, wherein the optical assembly is substantially isolated from movement of the load bearing bearings.

40. The spool of claim 39, wherein the isolation means comprises a precision bearing.

41. The spool of claim 38, wherein the means for transmitting the high power laser beam comprises two optical fibers characterized by each optical fiber having the ability to transmit a laser beam having at least about 10 kW of power and having a length of at least about 3000 feet and having a core having a diameter of at least about 500 μm.

42. The spool of claim 38, wherein the means for transmitting the high power laser beam comprises a plurality of optical fibers characterized by having the ability to transmit a laser beam having at least about 20 kW of power and having a length of at least about 3000 feet and having a core having a diameter of at least about 500 μm.

43. The spool of claim 38, wherein the means for transmitting the high power laser beam comprises an optical fiber characterized by having the ability to transmit a laser beam having at least about 10 kW of power and having a length of at least about 500 feet.

44. The spool of claim 38, wherein the hollow tubing comprises a coiled tubing containing a fluid line and a data line.

45. The spool of claim 38, comprising a means for providing buoyancy to the means for transmitting the high power laser beam.

46. A spool assembly for rotatably coupling high power laser transmission cables for use in advancing boreholes, comprising:

a. a base;

b. a spool, the spool supported by the base through a load bearing bearing;

c. hollow tubing having a first end and a second end;

d. the hollow tubing comprising a means for transmitting a high power laser beam;

e. the spool comprising an axle around which the coiled tubing is wound, the axle supported by the load bearing bearing;

f. a first non-rotating optical connector for optically connecting a laser beam source to the axle;

g. a rotatable optical connector optically associated with the first optical connector; whereby a laser beam is capable of being transmitted from the first optical connector to the rotatable optical connector; and, h. a rotational transition optical assembly, the optical assembly comprising:

i. a non-rotating adapter for receiving the non-rotating connector;

ii. a launch lens adjacent the non-rotating adapter, the launch lens characterizing a Fourier Transform plane;

iii. a rotatable adapter for receiving the rotatable connector; and, iv. the rotatable connector as received by the rotatable adapter optically associated with the Fourier Transform plane;

i. whereby the spool is capable of transmitting a laser beam from the first optical connector through the rotatable optical connector and into the transmitting means during winding and unwinding of the tubing on the spool while maintaining sufficient power to advance a borehole.

47. The spool of claim 46, wherein the rotating connector is substantially within the axle.

48. The spool of claim 47, wherein the non-rotating connector is exterior to the axle.

49. The spool of claim 46, comprising an isolation means associated with the rotational transition optical assembly, wherein the optical assembly is substantially isolated from movement of the load bearing bearings.

50. The spool of claim 49, wherein the isolation means comprises a precision bearing.

51. The spool of claim 49, wherein the means for transmitting the high power laser beam comprises three optical fibers characterized by each optical fiber having the ability to transmit a laser beam having at least about 10 kW of power and having a length of at least about 3000 feet and having a core having a diameter of at least about 500 μm.

52. The spool of claim 49, wherein the means for transmitting the high power laser beam comprises an optical fiber having a core having a diameter of at least about 500 μm.

53. The spool of claim 46, wherein the means for transmitting the high power laser beam comprises a plurality of optical fibers characterized by having the ability to transmit a laser beam having at least about 15 kW of power and having a length of at least about 3000 feet.

54. The spool of claim 46, wherein the means for transmitting the high power laser beam comprises an optical fiber characterized by having the ability to transmit a laser beam having at least about 10 kW of power and having a length of at least about 500 feet and having a core having a diameter of at least about 500 μm.

* * * * *